US011554409B2

(12) United States Patent
Mizuno et al.

(10) Patent No.: US 11,554,409 B2
(45) Date of Patent: Jan. 17, 2023

(54) REBAR TYING TOOL AND ELECTRIC WORK MACHINE

(71) Applicant: MAKITA CORPORATION, Anjo (JP)

(72) Inventors: Shunta Mizuno, Anjo (JP); Masahiro Watanabe, Anjo (JP); Yuki Kawai, Anjo (JP)

(73) Assignee: MAKITA CORPORATION, Anjo (JP)

( * ) Notice: Subject to any disclaimer, the term of this patent is extended or adjusted under 35 U.S.C. 154(b) by 22 days.

(21) Appl. No.: 17/115,023

(22) Filed: Dec. 8, 2020

(65) Prior Publication Data

US 2021/0178454 A1 Jun. 17, 2021

(30) Foreign Application Priority Data

Dec. 17, 2019 (JP) ..... JP2019-227720
Dec. 17, 2019 (JP) ..... JP2019-227721
Dec. 17, 2019 (JP) ..... JP2019-227722

(51) Int. Cl.
*B21F 15/04* (2006.01)
*E04C 5/16* (2006.01)
*E04G 21/12* (2006.01)

(52) U.S. Cl.
CPC ..... *B21F 15/04* (2013.01); *E04C 5/162* (2013.01); *E04G 21/123* (2013.01)

(58) Field of Classification Search
CPC .... E04G 21/123; B65B 13/187; B65B 13/285
See application file for complete search history.

(56) References Cited

U.S. PATENT DOCUMENTS 5,279,336 A 1/1994 Kusakari et al.
5,831,404 A 11/1998 Ishii
5,874,816 A 2/1999 Ishii
(Continued)

FOREIGN PATENT DOCUMENTS

CN 201656223 U * 11/2010 ..... H01R 43/052
GB 2047430 A * 11/1980 ..... G05B 19/18
(Continued)

OTHER PUBLICATIONS

Unpublished U.S. Appl. No. 17/115,045.

*Primary Examiner* — Adam J Eiseman
*Assistant Examiner* — Matthew Stephens
(74) *Attorney, Agent, or Firm* — J-Tek Law PLLC; Jeffrey D. Tekanic; Scott T. Wakeman

(57) ABSTRACT

A rebar tying tool (2; 302; 402) include a feed mechanism (24), which includes a first motor (32; 304) and feeds a wire (W), and a twisting mechanism, which includes a second motor (76; 306) and twists together one or more portions of the wire. A control unit (202; 350) controls the first motor and the second motor and includes a general-purpose I/O port (202*c;* 350*c*) and a motor-control-signal output port (202*a;* 350*a*). A motor-control-signal-output-destination-switching circuit (204; 310; 406) inputs motor-control signals (UH, VH, WH, UL, VL, WL) from the control unit via the motor-control-signal output port and selectively outputs the inputted motor-control signals to either the first motor or the second motor in response to input of a switching signal (SW).

22 Claims, 39 Drawing Sheets

(56) References Cited

U.S. PATENT DOCUMENTS

| | | | | |
|---|---|---|---|---|
| 5,944,064 | A | 8/1999 | Saito et al. | |
| 7,398,800 | B2 | 7/2008 | Kusakari et al. | |
| 7,448,417 | B2 | 11/2008 | Itagaki | |
| 9,004,114 | B2 | 4/2015 | Kasahara et al. | |
| 9,667,176 | B2 * | 5/2017 | Ogawa | H02P 6/17 318/400.13 |
| 2009/0160373 | A1 * | 6/2009 | Katou | H02P 6/22 318/286 |
| 2009/0283167 | A1 * | 11/2009 | Nakagawa | B65H 51/30 100/2 |
| 2012/0160364 | A1 * | 6/2012 | Katou | H02P 6/22 140/93.6 |
| 2013/0112133 | A1 * | 5/2013 | Asensio | H02P 8/40 116/284 |
| 2013/0314007 | A1 * | 11/2013 | Yanagihara | H02P 6/28 318/286 |
| 2018/0202178 | A1 * | 7/2018 | Shima | E04G 21/123 116/284 |
| 2018/0207709 | A1 * | 7/2018 | Kasahara | B21F 15/04 318/400.13 |
| 2019/0193879 | A1 | 6/2019 | Yamamoto et al. | |
| 2020/0002963 | A1 * | 1/2020 | Kawazoe | E04G 21/123 116/284 |
| 2021/0067065 | A1 * | 3/2021 | Wang | H02P 6/24 116/284 |

FOREIGN PATENT DOCUMENTS

| | | | |
|---|---|---|---|
| JP | H1046821 | A | 2/1998 |
| JP | 2017024752 | A | 2/2017 |
| JP | 2019116307 | A | 7/2019 |

* cited by examiner

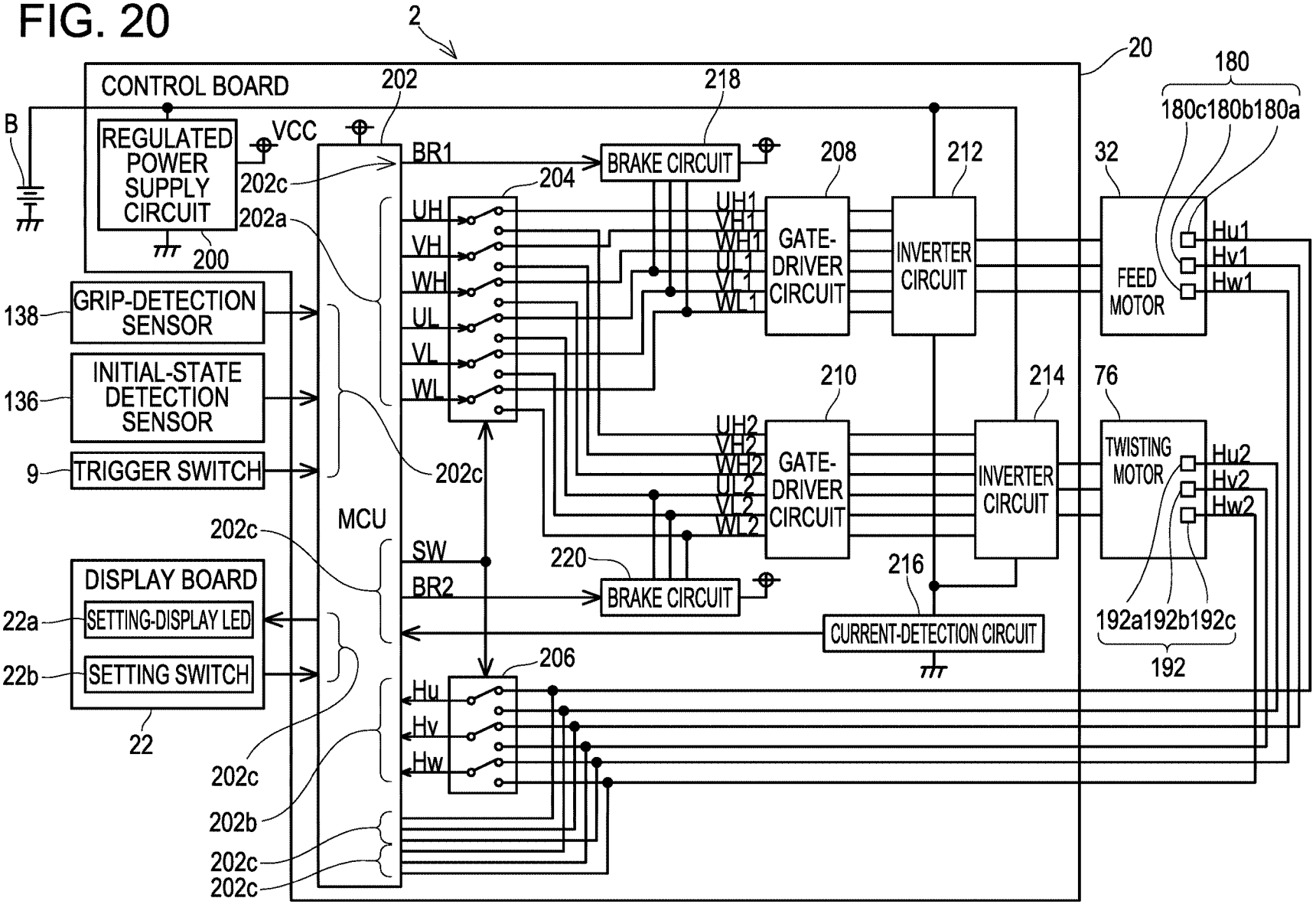
FIG. 20
2
20
180
180c180b180a
Hu1
Hv1
Hw1
FEED MOTOR
32
Hu2
Hv2
Hw2
TWISTING MOTOR
76
192a192b192c
192
214
INVERTER CIRCUIT
212
INVERTER CIRCUIT
216
CURRENT-DETECTION CIRCUIT
208
GATE-DRIVER CIRCUIT
210
GATE-DRIVER CIRCUIT
UH1
VH1
WH1
UL1
VL1
WL1
UH2
VH2
WH2
UL2
VL2
WL2
218
BRAKE CIRCUIT
BRAKE CIRCUIT
220
204
206
UH
VH
WH
UL
VL
WL
SW
BR2
Hu
Hv
Hw
BR1
202
202c
MCU
VCC
CONTROL BOARD
REGULATED POWER SUPPLY CIRCUIT
200
202c
202a
GRIP-DETECTION SENSOR
INITIAL-STATE DETECTION SENSOR
TRIGGER SWITCH
DISPLAY BOARD
SETTING-DISPLAY LED
SETTING SWITCH
22
202c
202b
202c
202c
B
138
136
9
22a
22b

REBAR TYING TOOL AND ELECTRIC WORK MACHINE

CROSS-REFERENCE TO RELATED APPLICATION

This application claims priority to Japanese patent application nos. 2019-227720, 2019-227721, and 2019-227722, all of which were filed on Dec. 17, 2019, the contents of each of which are fully incorporated herein by reference.

TECHNICAL FIELD

The present specification discloses techniques relating to power tools and electric work machines that are configured to tie together two or more reinforcing bars ("rebars") using a wire.

BACKGROUND ART

US Patent Publication 2019/0193879 A1 discloses a rebar tying tool that comprises: a feed mechanism, which has a first motor and is adapted/configured to feed (advance and retract) a wire to loop (wind) the wire multiple times around two or more rebars; a twisting mechanism, which has a second motor and is adapted/configured to twist an intermediate portion of the looped wire using a pair of rotatable hooks; and a control unit, which controls the first motor and the second motor.

SUMMARY OF THE INVENTION

In a configuration in which the first and second motors are controlled by the control unit as described above, the control unit further comprises, in addition to the usual general-purpose I/O ports, two motor-control-signal output ports that are capable of high-speed signal processing. If the control unit comprises two such high-speed motor-control-signal output ports, it becomes possible to control the two motors more accurately by outputting respective motor-control signals from the two high-speed motor-control-signal output ports.

However, if the control unit has multiple high-speed motor-control-signal output ports, then it will lead to an increase in cost of the control unit. That is, if a configuration is used in which a plurality of motors is controlled by a single control unit that has separate motor-control-signal output ports for respectively driving the two or more motors, it will adversely lead to a significant increase in cost of the control board on which the control unit is installed.

Therefore, it is one non-limiting object of the present teachings to disclose techniques for accurately controlling a plurality of motors using a single control unit in a cost-effective manner.

In one aspect of the present disclosure, a rebar tying tool may comprise: a feed mechanism, which comprises a first motor and feeds (is configured/adapted to feed) a wire; a twisting mechanism, which comprises a second motor and twists (is configured/adapted to twist) the wire (e.g., two end portions of the wire or an intermediate portion of a looped wire); a control unit, which controls the first motor and the second motor; and a motor-control-signal-output-destination-switching circuit (i.e. a circuit that switches the output destination of motor-control signals generated by the control unit). The control unit may comprise at least one general-purpose I/O port and a motor-control-signal output port, which is optionally capable of performing signal processing at a faster speed than the at least one general-purpose I/O port. The motor-control-signal-output-destination-switching circuit may be adapted/configured to output motor-control signals from the control unit (via the motor-control-signal output port) to one motor selected from among (either) the first motor or the second motor. The motor-control-signal-output-destination-switching circuit may be adapted/configured to select, in accordance with an output-switching signal (e.g., output from the control unit), the one of the first motor or the second motor to be driven using the motor-control signals output from the control unit via the motor-control-signal output port.

According to the above-mentioned configuration, the motor-control signals to the first motor and the motor-control signals to the second motor can be selectively output from the (preferably one or sole) motor-control-signal output port that corresponds to (is configured/adapted to drive only) one motor. In other words, the one or sole motor-control-signal output port has only the number of pins for outputting motor-control signals for driving (energizing) a single motor. By using such a configuration, both the first motor of the feed mechanism and the second motor of the twisting mechanism can be accurately controlled via the (preferably, high-speed) sole motor-control-signal output port, without leading to a significant increase in cost, because the one (sole) motor-control-signal output port outputs the motor-control signals for both the first motor and the second motor.

In another aspect of the present teachings, an electric work machine may comprise: a first motor; a second motor; a control unit, which controls the first motor and the second motor; and a motor-control-signal-output-destination-switching circuit (i.e. a circuit that switches the output destination of motor-control signals generated by the control unit). The control unit may comprise at least one general-purpose I/O port and a motor-control-signal output port. The motor-control-signal-output-destination-switching circuit may be adapted/configured to output motor-control signals from the control unit (via the motor-control-signal output port) to one motor selected from among (either) the first motor and the second motor. The motor-control-signal-output-destination-switching circuit may be adapted/configured to select, in accordance with a switching signal (e.g., an output-switching signal optionally output from the control unit), the one of the first motor or the second motor to be driven using the motor-control signals.

According to the above-mentioned configuration, the motor-control signals to the first motor and the motor-control signals to the second motor can be selectively output from the (one, sole) motor-control-signal output port that corresponds to (is configured/adapted to drive only) one motor. Similar to the aspect mentioned above, the one or sole motor-control-signal output port has only the number of pins for outputting motor-control signals for driving (energizing) a single motor. By using such a configuration, both the first motor and the second motor can be accurately controlled, without leading to a large increase in cost, because the one or sole motor-control-signal output port outputs the motor-control signals for both the first motor and the second motor.

BRIEF DESCRIPTION OF THE DRAWINGS

FIG. 20 is a diagram that shows the circuit configuration of a control board 20 of the rebar tying tool 2 according to working example 1.

DETAILED DESCRIPTION OF EMBODIMENTS OF THE INVENTION

Figure 1:
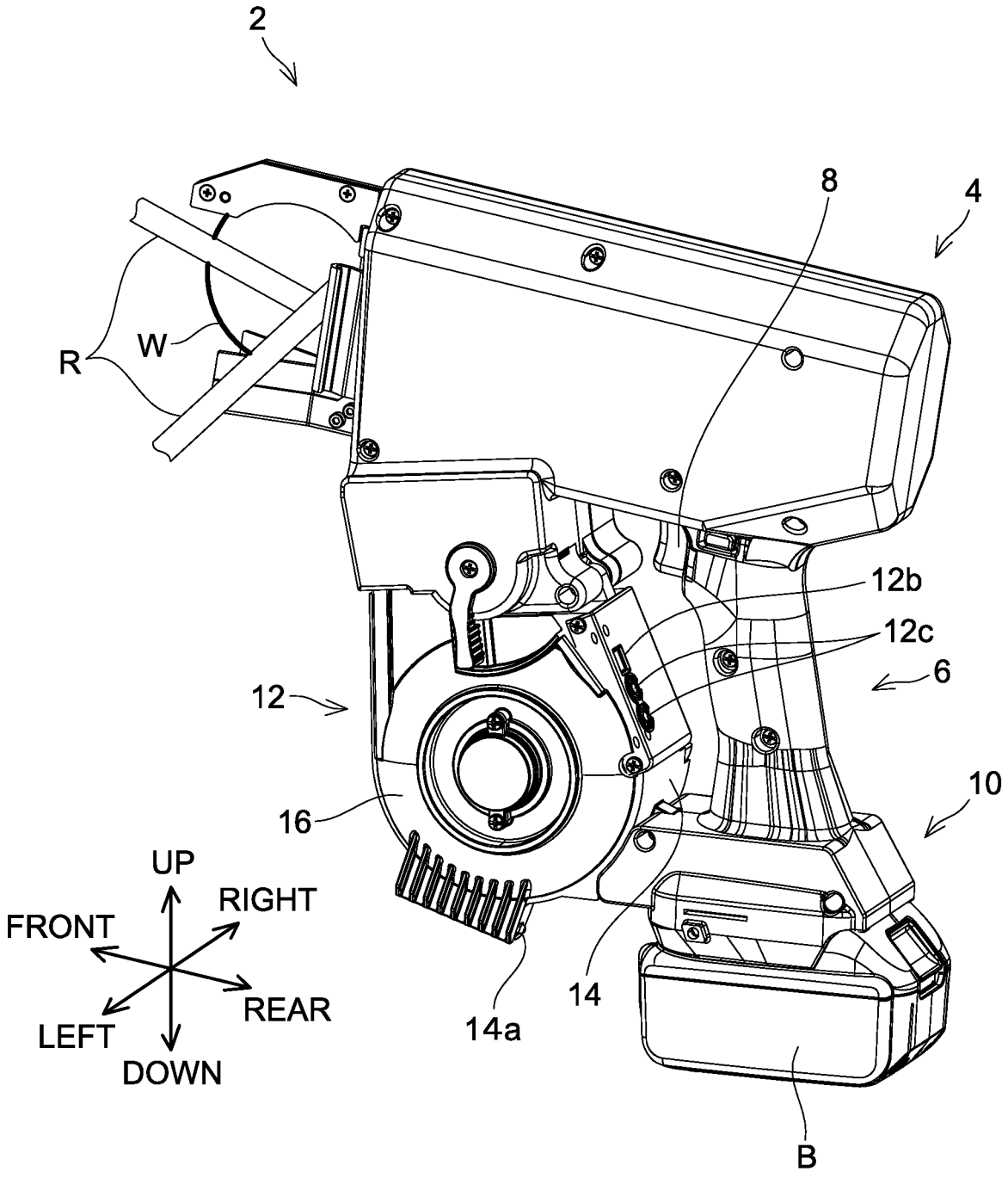
FIG. 1 is an oblique view of a rebar tying tool 2 according to working example 1 of the present teachings.

Representative, non-limiting concrete examples of the present invention are explained in detail below, with reference to the drawings. This detailed explanation is intended merely to illustrate to a person skilled in the art that details to implement preferred examples of the present invention are not intended to limit the scope of the present invention. In addition, additional features and the invention disclosed can be used separately from or together with other features and inventions to provide additional improved rebar tying tools and electric work machines.

In addition, the combinations of features and processes disclosed in the detailed explanation below are not essential to carry out the present invention in the broadest meaning and are recited only to explain representative concrete examples of the present invention in particular. Furthermore, in providing additional and useful embodiments of the present invention, the various features of the representative concrete examples below and the various features of the claims do not necessarily have to be combined as indicated in the concrete examples recited herein or as indicated in the sequence enumerated herein.

All features recited in the present specification and/or in the claims are intended, separately from the configuration of features recited in the working examples and/or the claims, to be disclosed individually and mutually independently as limitations relative to the specific matters disclosed in the disclosure and claims of the original patent application. Furthermore, description related to all numerical ranges, groups, and collections are intended to disclose intermediate configurations thereof as limitations relative to specific matters recited in the disclosure and the claims of the original patent application.

As was described above, rebar tying tools according to one or more of the embodiments of the present teachings may comprise, e.g.: a feed mechanism, which comprises a first motor and feeds a wire; a twisting mechanism, which comprises a second motor and twists the wire; a control unit, which controls the first motor and the second motor; and a motor-control-signal-output-destination-switching circuit. The control unit may comprise at least one general-purpose I/O port and a motor-control-signal output port. The motor-control-signal-output-destination-switching circuit may output motor-control signals from the control unit to one selected from among the first motor and the second motor. The motor-control-signal-output-destination-switching circuit may select, in accordance with an output-switching signal (or simply "switching signal"), one from among the first motor and the second motor.

As was described above, according to the above-mentioned configuration, the motor-control signals to the first motor and the motor-control signals to the second motor can be selectively output from the motor-control-signal output port that corresponds to one motor. By using such a configuration, both the first motor of the feed mechanism and the second motor of the twisting mechanism can be accurately controlled, without leading to a large increase in cost.

In one or more of the embodiments, the output-switching signal may be output from the at least one general-purpose I/O port of the control unit.

According to such a configuration, the switching of the motor-control-signal-output-destination-switching circuit can be performed in accordance with the timing of a process performed by the control unit.

In one or more of the embodiments, the motor-control-signal-output-destination-switching circuit may comprise a demultiplexer.

According to such a configuration, the motor-control-signal-output-destination-switching circuit can be implemented by (with) a simple configuration.

In one or more of the embodiments, the rebar tying tool may further comprise a first brake circuit, which outputs (is configured/adapted to generate and output) a short-circuit brake signal to the first motor. At the time when the motor-control-signal-output-destination-switching circuit switches from the state in which the first motor is selected to the state in which the second motor is selected, the first brake circuit may output the short-circuit brake signal to the first motor.

According to such a configuration, because short-circuit braking is applied to the first motor by the first brake circuit at the time when the control unit switches from the state in which it controls the first motor to the state in which it controls the second motor, the first motor can be stopped quickly.

In one or more of the embodiments, at the time when the motor-control-signal-output-destination-switching circuit switches from the state in which the first motor is selected to the state in which the second motor is selected, the rotation of the rotor of the second motor may start before the rotation of the rotor of the first motor stops.

According to such a configuration, the time required to tie (bind) rebars together can be made shorter than in an embodiment in which rotation of the rotor of the second motor starts after rotation of the rotor of the first motor has stopped.

In one or more of the embodiments, before the motor-control-signal-output-destination-switching circuit switches from the state in which the first motor is selected to the state in which the second motor is selected, the first brake circuit may output the short-circuit brake signal to the first motor.

At the time when the motor-control-signal-output-destination-switching circuit switches from the state in which the first motor is selected to the state in which the second motor is selected, if the rotor of the first motor continues to rotate due to inertia, then there is a risk that a regenerated electric current will be generated by the first motor, which might cause deterioration or failure of the power supply, such as a battery. However, according to the above-mentioned configuration of the present teachings, at the time when the motor-control-signal-output-destination-switching circuit switches from the state in which the first motor is selected to the state in which the second motor is selected, rotation of the rotor of the first motor due to inertia can be curtailed or even stopped more quickly than an embodiment in which the first brake circuit does not output the short-circuit brake signal to the first motor before the motor-control-signal-output-destination-switching circuit switches from the state in which the first motor is selected to the state in which the second motor is selected.

In one or more of the embodiments, before the first brake circuit outputs the short-circuit brake signal to the first motor, the control unit may output a short-circuit brake signal to the first motor. The short-circuit brake signal from the control unit may optionally differ from, or be the same as, the short-circuit brake signal from the first brake circuit.

In an embodiment in which the first brake circuit were to (hypothetically) output the short-circuit brake signal to the first motor before the control unit outputs the short-circuit brake signal to the first motor, there is a risk that electric current will flow from the first brake circuit into the control unit. However, according to the above-mentioned configuration, it is possible to curtail or even prevent the flow of electric current from the first brake circuit into the control unit.

In one or more of the embodiments, the rebar tying tool may further comprise a second brake circuit, which outputs a short-circuit brake signal to the second motor. At the time when the motor-control-signal-output-destination-switching circuit switches from the state in which the second motor is selected to the state in which the first motor is selected, the second brake circuit may output the short-circuit brake signal to the second motor.

According to such a configuration, at the time when the control unit switches from the state in which it controls the second motor to the state in which it controls the first motor, because short-circuit braking is applied to the second motor by the second brake circuit, the second motor can be stopped quickly.

In one or more of the embodiments, at the time when the motor-control-signal-output-destination-switching circuit switches from the state in which the second motor is selected to the state in which the first motor is selected, the rotation of the rotor of the first motor may start before the rotation of the rotor of the second motor stops.

According to such a configuration, the time required to tie rebars can be made shorter than in an embodiment in which rotation of the rotor of the first motor starts after rotation of the rotor of the second motor has stopped.

In one or more of the embodiments, before the motor-control-signal-output-destination-switching circuit switches from the state in which the second motor is selected to the state in which the first motor is selected, the second brake circuit may output a short-circuit brake signal to the second motor. The short-circuit brake signal from the second brake circuit may optionally differ from, or be the same as, the short-circuit brake signal from the first brake circuit and/or the short-circuit brake signal from the control unit that is supplied to the first motor.

At the time when the motor-control-signal-output-destination-switching circuit switches from the state in which the second motor is selected to the state in which the first motor is selected, if the rotor of the second motor continues to rotate due to inertia, then there is a risk that a regenerated electric current will be generated, which might cause deterioration or failure of the power supply, such as a battery. However, according to the above-mentioned configuration of the present teachings, at the time when the motor-control-signal-output-destination-switching circuit switches from the state in which the second motor is selected to the state in which the first motor is selected, rotation of the rotor of the second motor due to inertia can be curtailed or even stopped more quickly than in an embodiment in which the second brake circuit does not output the short-circuit brake signal to the second motor before the motor-control-signal-output-destination-switching circuit switches from the state in which the second motor is selected to the state in which the first motor is selected.

In one or more of the embodiments, before the second brake circuit outputs the short-circuit brake signal to the second motor, the control unit may output a short-circuit brake signal to the second motor. This short-circuit brake signal from the control unit may optionally differ from, or be the same as, the short-circuit brake signal from the first or second brake circuit and/or the short-circuit brake signal from the control unit that is supplied to the first motor.

In an embodiment in which the second brake circuit were to (hypothetically) output the short-circuit brake signal to the second motor before the control unit outputs the short-circuit brake signal to the second motor, there is a risk that electric current will flow from the second brake circuit into the control unit. However, according to the above-mentioned configuration of the present teachings, it is possible to curtail or even prevent the flow of electric current from the second brake circuit into the control unit.

In one or more of the embodiments, the first motor may be a (first) brushless motor.

According to the above-mentioned configuration, the life of the first motor can be lengthened (as compared, e.g., to a brushed motor), and the frequency of maintenance can be reduced.

In one or more of the embodiments, the second motor may be a (second) brushless motor.

According to the above-mentioned configuration, the life of the second motor can be lengthened (as compared, e.g., to a brushed motor), and the frequency of maintenance can be reduced.

In one or more of the embodiments, the rebar tying tool may further comprise a motor-rotation-signal-input-source-switching circuit (i.e. a circuit that switches the input source of motor-rotation signals). The first motor may be a first brushless motor. The second motor may be a second brushless motor. The first brushless motor may comprise a first Hall-effect sensor. The second brushless motor may comprise a second Hall-effect sensor. The control unit may further comprise a (one or sole) motor-rotation-signal input port. The motor-rotation-signal-input-source-switching circuit may input, into the motor-rotation-signal input port, one set of signals selected from first Hall-effect sensor signals from the first Hall-effect sensor and second Hall-effect sensor signals from the second Hall-effect sensor. The motor-rotation-signal-input-source-switching circuit may select, in accordance with an input-switching signal, the one set of signals that is input to the motor-rotation-signal input port.

In embodiments in which the first motor and the second motor are brushless motors, the control unit may be provided with a (one or single) motor-rotation-signal input port that is capable of high-speed signal processing, and by inputting Hall-effect sensor signals into the (one or sole) motor-rotation-signal input port, it becomes possible to control the brushless motors more accurately, in particular if the motor-rotation-signal input port is a high-speed signal processing port (i.e., a port that is capable of higher-speed processing than the general-purpose I/O port(s)). According to the above-mentioned configuration, either the first Hall-effect sensor signals of the first brushless motor or the second Hall-effect sensor signals of the second brushless motor can be selectively input to the motor-rotation-signal input port, which corresponds to one brushless motor. According to such a configuration, both the first motor and the second motor can be accurately controlled without leading to a significant increase in cost, i.e. because it is not necessary to provide two high-speed motor-rotation-signal input ports.

In one or more of the embodiments, the input-switching signal may be output from the at least one general-purpose I/O port of the control unit.

According to such a configuration, switching of the motor-rotation-signal-input-source-switching circuit can be performed in accordance with the timing of a process performed by the control unit.

In one or more of the embodiments, the motor-rotation-signal-input-source-switching circuit may comprise a multiplexer.

According to such a configuration, the motor-rotation-signal-input-source-switching circuit can be implemented by (with) a simple configuration.

In one or more of the embodiments, the first Hall-effect sensor signals may also be input to a general-purpose I/O port, e.g., a first parallel port, of the control unit. The second Hall-effect sensor signals may also be input to a general-purpose I/O port, e.g., a second parallel port, of the control unit. That is, the second Hall-effect sensor signals preferably may be input to a general-purpose I/O port that differs from the general-purpose I/O port that receives the first Hall-effect sensor signals.

According to such a configuration, it is possible for the control unit to also monitor the other set of signals (i.e. either the first Hall-effect sensor signals or the second Hall-effect sensor signals) that is not currently selected by the motor-rotation-signal-input-source-switching circuit and thus is not currently being input to the (one or single) motor-rotation-signal input port.

In one or more of the embodiments, after a prescribed time has elapsed since the point in time when the motor-rotation-signal-input-source-switching circuit switched from the state in which a first set of signals selected from the first Hall-effect sensor signals and the second Hall-effect sensor signals is selected to the state in which the other (second) set of signals is selected, the control unit may determine that an error has occurred in the event that a change is detected in the first set of signals after the prescribed time has elapsed.

For example, when the motor-rotation-signal-input-source-switching circuit switches from the state in which the first Hall-effect sensor signals are selected to the state in which the second Hall-effect sensor signals are selected, it is expected that the rotor of the first brushless motor will come to a stop after a prescribed time has elapsed because the control unit is no longer controlling (energizing) the first brushless motor. When the rotor of the first brushless motor is stopped, the first Hall-effect sensor signals should no longer change. Therefore, if a change were to occur (be detected) in the first Hall-effect sensor signals while the first brushless motor is supposed to be stopped, then it can be reasonably concluded that some type of abnormality in operation has occurred. According to the above-mentioned configuration, the occurrence of such an abnormality can be quickly detected.

In one or more of the embodiments, the input-switching signal and the output-switching signal may be the same signal.

According to such a configuration, the circuit configuration can be simplified because the motor-rotation-signal-input-source-switching circuit and the motor-control-signal-output-destination-switching circuit switch use (input, are controlled by) a common signal that is preferably output from the same general-purpose I/O port.

In one or more of the embodiments, an electric work machine may comprise: a first motor; a second motor; a control unit, which controls the first motor and the second motor; and a motor-control-signal-output-destination-switching circuit (i.e. a circuit that switches the output destination of the motor-control signal). The control unit may comprise at least one general-purpose I/O port and a motor-control-signal output port, which optionally may be configured/adapted to perform signal processing at a faster speed than the at least one general-purpose I/O port. The motor-control-signal-output-destination-switching circuit may output motor-control signals from the control unit to one selected from (either) the first motor and the second motor. The motor-control-signal-output-destination-switching circuit may select, in accordance with an output-switching signal, the selected one of (either) the first motor or the second motor.

According to such a configuration, the motor-control signals to the first motor and the motor-control signals to the second motor can be selectively output from the motor-control-signal output port, which corresponds to one motor. By using such a configuration, both the first motor and the second motor can be accurately controlled, without leading to a significant increase in cost, for the same reasons explained above.

In one or more of the embodiments, the rebar tying tool may comprise: the feed mechanism, which has the first brushless motor and feeds the wire; the twisting mechanism, which has the second brushless motor and twists the wire (e.g., ends of the wire or an intermediate portion of a looped wire); the control unit, which controls the first brushless motor and the second brushless motor; and the motor-rotation-signal-input-source-switching circuit. The first brushless motor may comprise the first Hall-effect sensor. The second brushless motor may comprise the second Hall-effect sensor. The control unit may comprise the at least one general-purpose I/O port and the motor-rotation-signal input port. The motor-rotation-signal-input-source-switching circuit may input, to the motor-rotation-signal input port, one set of signals selected from the first Hall-effect sensor signals from the first Hall-effect sensor and the second Hall-effect sensors signal from the second Hall-effect sensor. The motor-rotation-signal-input-source-switching circuit may select, in accordance with the input-switching signal, the one set of signals to be input to the motor-rotation-signal input port.

According to such a configuration, the first Hall-effect sensor signals of the first brushless motor or the second Hall-effect sensor signals of the second brushless motor can be selectively input to the motor-rotation-signal input port (e.g., a high-speed processing port) that corresponds to one brushless motor. By using such a configuration, both the first brushless motor of the feed mechanism and the second brushless motor of the twisting mechanism can be accurately controlled, without leading to a significant increase in cost, for the reasons explained above.

In one or more of the embodiments, the electric work machine may comprise: the first brushless motor; the second brushless motor; the control unit, which controls the first brushless motor and the second brushless motor; and the motor-rotation-signal-input-source-switching circuit. The first brushless motor may comprise the first Hall-effect sensor. The second brushless motor may comprise the second Hall-effect sensor. The control unit may comprise the at least one general-purpose I/O port and the motor-rotation-signal input port (e.g., a high-speed processing port). The motor-rotation-signal-input-source-switching circuit may input one set of signals selected from the first Hall-effect sensor signals from the first Hall-effect sensor and the second Hall-effect sensor signals from the second Hall-effect sensor to the motor-rotation-signal input port. The motor-rotation-signal-input-source-switching circuit may select, in accordance with the input-switching signal, the one set of signals to be input to the motor-rotation-signal input port.

According to such a configuration, one set of signals selected from the first Hall-effect sensor signals of the first brushless motor or the second Hall-effect sensor signals of the second brushless motor can be selectively input to the (one or sole) motor-rotation-signal input port that corresponds to one brushless motor. By using such a configuration, both the first brushless motor and the second brushless motor can be accurately controlled, without leading to a significant increase in cost, as was further explained above.

Working Example 1

As shown in FIG. 1, rebar tying tool 2 is configured/adapted to tie together a plurality of rebars (reinforcing bars) R using a wire W. For example, the rebar tying tool 2 ties small-diameter rebars R having a diameter of 16 mm or less and/or large-diameter rebars R having a diameter greater than 16 mm (e.g., a diameter of 25 mm or 32 mm) using the wire W. The diameter of the wire W is, for example, 0.5-2.0 mm. The wire W is preferably composed of an elastically deformable metal material, such as aluminum or steel. The metal material optionally may be coated with a synthetic polymer (plastic) material.

The rebar tying tool 2 comprises a main body 4, a grip (handle) 6, a battery-mount part 10, a battery (battery pack, battery cartridge) B, and a reel holder 12. The grip 6 is a member for being gripped by a user. The grip 6 is provided on a lower-side lower portion of the main body 4. The grip 6 is formed integrally with the main body 4. A trigger 8 is mounted on a front-side upper portion of the grip 6. A trigger switch 9 (refer to FIG. 2), which detects whether the trigger 8 is being pulled, is housed in the interior of the grip 6. The battery-mount part 10 is provided at a lower portion of the grip 6. The battery-mount part 10 is provided integrally with the grip 6. The battery B is detachably mounted on the battery-mount part 10. The battery B preferably comprises, for example, at least one lithium-ion battery cell. The reel holder 12 is disposed downward of the main body 4. The reel holder 12 is disposed forward of the grip 6. It is noted that, in the present working example, a longitudinal direction of a twisting mechanism 30, which is described below, is called the front-rear direction; a direction orthogonal to the front-rear direction is called the up-down direction; and a direction orthogonal to the front-rear direction and to the up-down direction is called the left-right direction.

The reel holder 12 comprises a holder housing 14 and a cover member 16. The holder housing 14 is mounted on a front-side lower portion of the main body 4 and a front portion of the battery-mount part 10. The cover member 16 is mounted on the holder housing 14 such that it is pivotable about a pivot shaft 14*a* of a lower portion of the holder housing 14. A housing space 12*a* (refer to FIG. 2) is demarcated by the holder housing 14 and the cover member 16. A reel 18, on which the wire W is wound, is disposed in the housing space 12*a*. That is, the reel holder 12 houses, in its interior, the reel 18.

A display part 12*b* and a manipulatable part (e.g., a button) 12*c* are provided on a rear surface of the reel holder 12. The manipulatable part 12*c* receives user manipulations concerning various settings such as the tying strength of the rebar tying tool 2 (i.e. how tightly the ends of the wire W are twisted together to cinch the wire W around the rebars R). The display part 12*b* is capable of displaying information concerning the current settings of the rebar tying tool 2.

Figure 2:
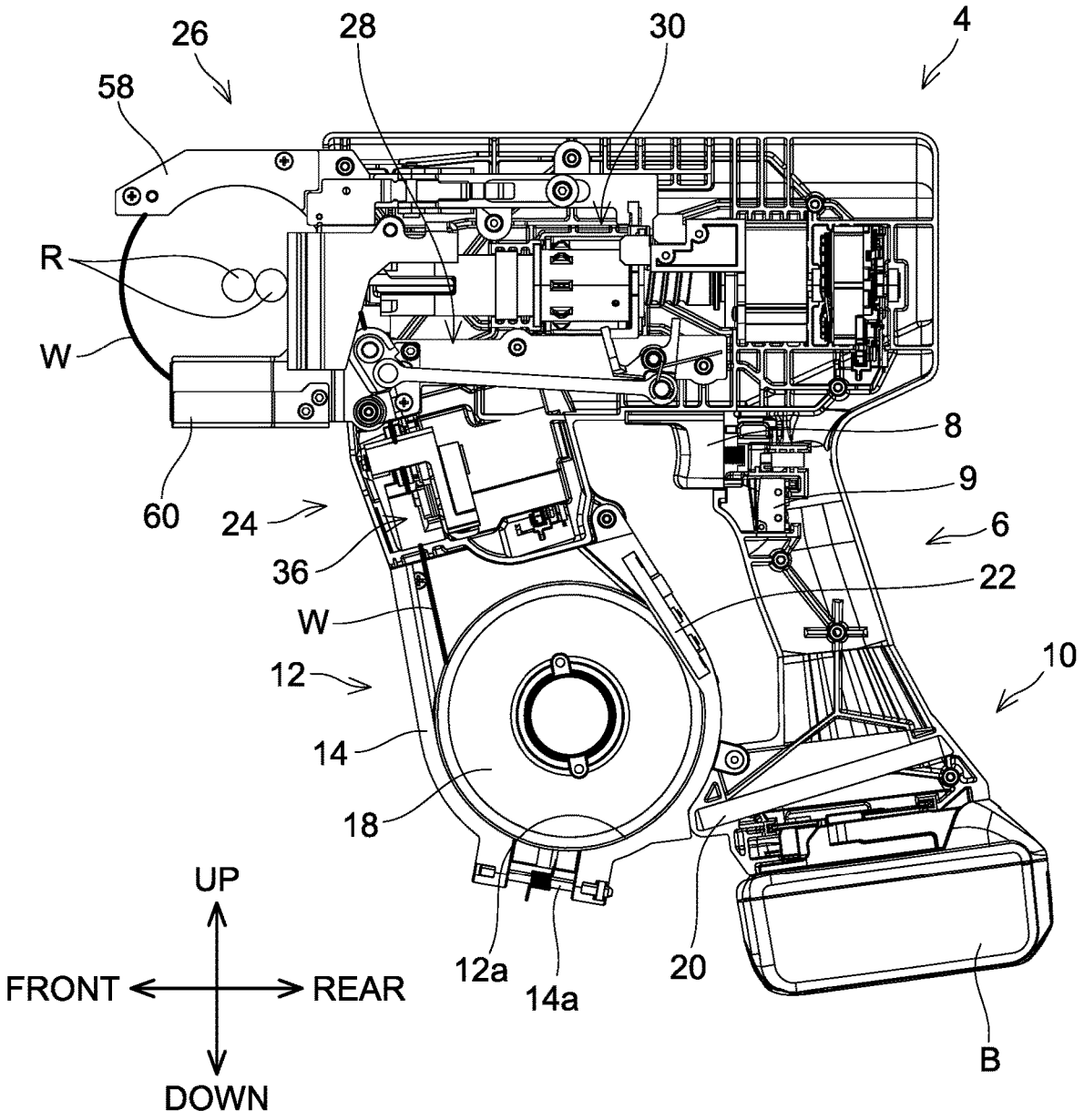
FIG. 2 is a side view that shows the internal configuration of the rebar tying tool 2 according to working example 1.

As shown in FIG. 2, the rebar tying tool 2 comprises a control board (e.g., a circuit board, such as a printed circuit board) 20 and a display board 22. The control board 20 is housed in the battery-mount part 10. The control board 20 controls the operation of the rebar tying tool 2. The display board 22 is housed in a rear portion of the reel holder 12. The display board 22 is electrically connected to the control board 20 by wiring, which is not shown. The display board 22 comprises, e.g., a setting-display LED 22*a* (refer to FIG. 20), which emits light toward the display part 12*b*, and a setting switch 22*b* (refer to FIG. 20), which detects manipulation (pressing) of the manipulatable part 12*c* by the user. For example, the manipulatable part 12*c* and the setting switch 22*b* (which may be, e.g., a push switch) may be configured for manually setting the tying strength to be applied to the wire W in the twisting operation.

The rebar tying tool 2 comprises a feed mechanism 24, a guide mechanism 26, a cutting mechanism 28, and the twisting mechanism 30. The feed mechanism 24 is housed in a front-lower portion of the main body 4. The feed mechanism 24 performs an advancing operation (a reeling-out or unreeling operation), which advances (reels out) the wire W to the guide mechanism 26, and a draw-back operation (a pull back or retraction (reeling in) operation), which draws back (reels in) the wire W from the guide mechanism 26. The guide mechanism 26 is disposed in a front portion of the main body 4. The guide mechanism 26 guides the wire W, which has been advanced from the feed mechanism 24, to form a circular-ring shape (loop) around two or more adjacent rebars R. That is, the guide mechanism 26 causes (e.g., bends) the wire W to encircle two or more adjacent rebars R in order to tie together the two or more adjacent rebars R. Preferably, the feed mechanism 24 advances an amount of wire W so that a single loop (winding) of wire W is wound around (encircles) the rebars. The cutting mechanism 28 is housed in a lower portion of the main body 4. The cutting mechanism 28 performs a cutting operation in which the wire W is cut (severed) after the single loop of the wire W has been wound (looped) around the rebars R. The twisting mechanism 30 is housed in the main body 4. The twisting mechanism 30 performs a twisting operation, in which end portions of the single loop of the wire W, which has been wound (looped) around the rebars R, are twisted.

Configuration of Feed Mechanism 24

Figure 3:
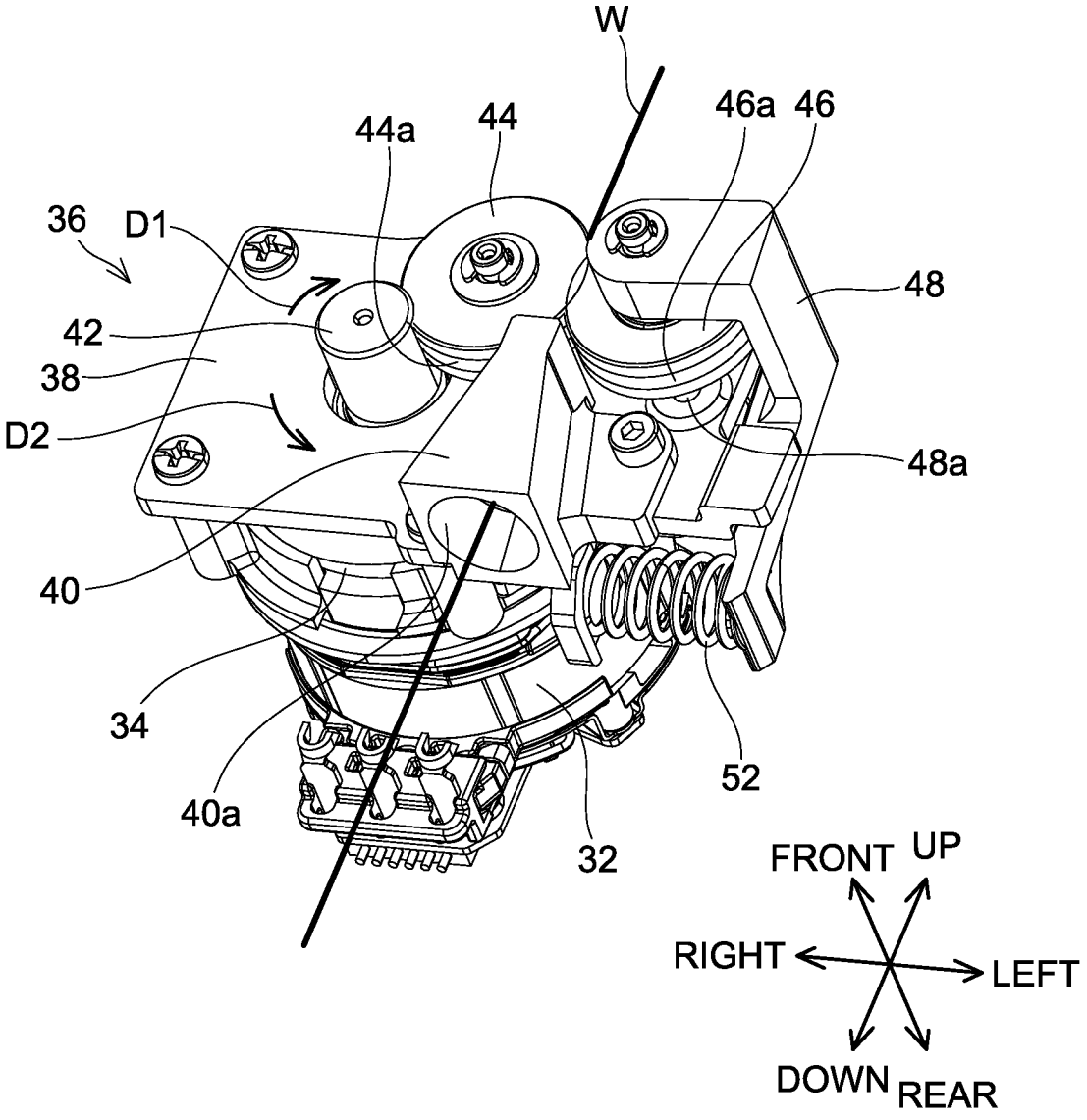
FIG. 3 is an oblique view of a feed mechanism 24 of the rebar tying tool 2 according to working example 1.

As shown in FIG. 3, the feed mechanism 24 comprises a feed motor (i.e. a motor that supplies motive power for moving (advancing and retracting) the wire W) 32, a speed-reducing part (gear transmission) 34, and a feed part 36. The feed motor 32 is electrically connected to the control board 20 by wiring, which is not shown. The feed motor 32 is driven by electric power supplied from the battery B. The drive (energization) of the feed motor 32 is controlled by the control board 20, as will be further explained below. The feed motor 32 is operably connected to a drive gear (spur gear) 42 of the feed part 36 via the speed-reducing part 34. The speed-reducing part 34 reduces the speed of the rotational output of the feed motor 32 (and increases the output torque) using, for example, a planetary-gear mechanism and transmits that reduced-speed rotational output to the drive gear 42.

Figure 18:
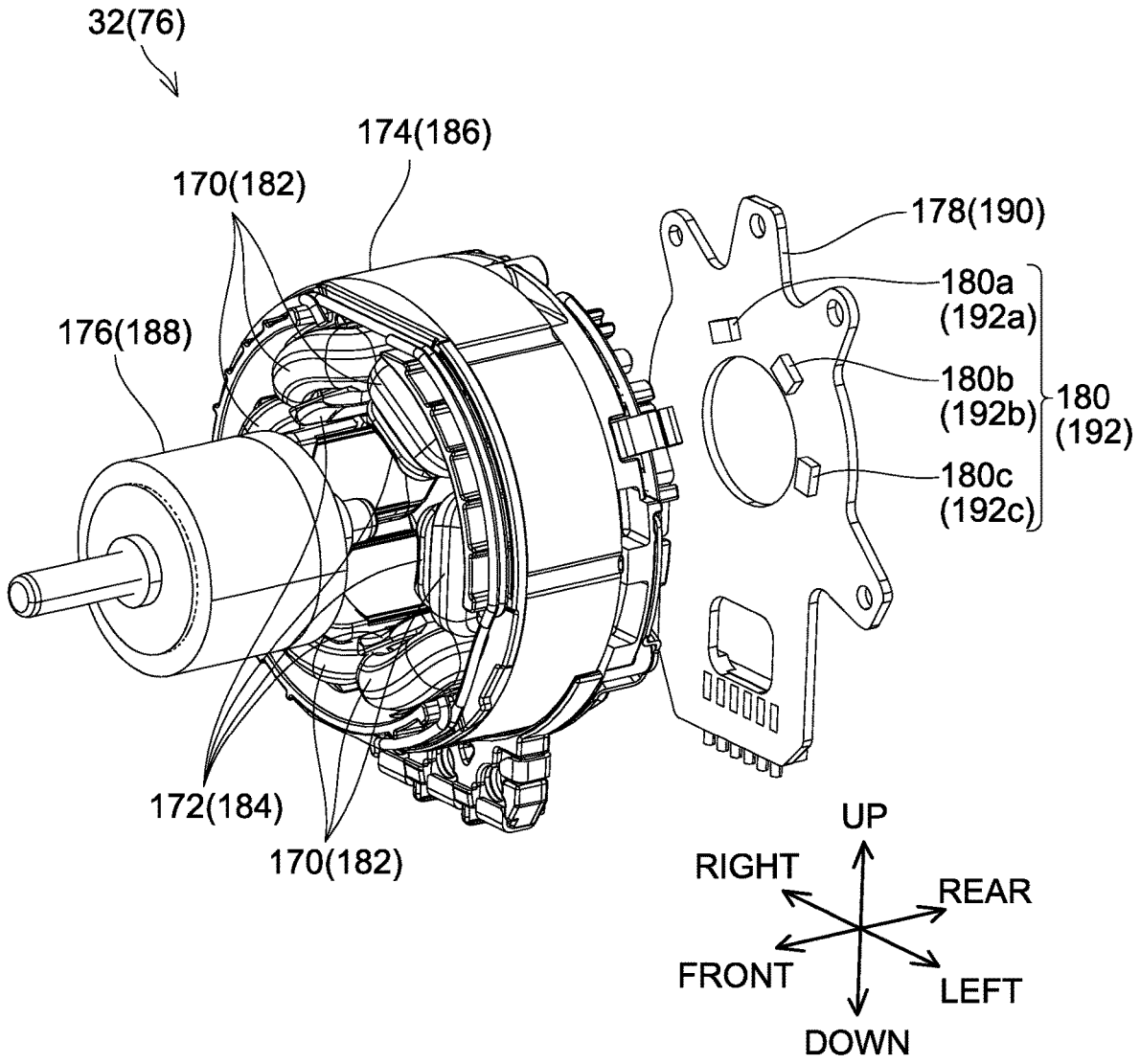
FIG. 18 is an exploded, oblique view of a feed motor 32 and a twisting motor 76 of the rebar tying tool 2 according to working example 1.
Figure 19:
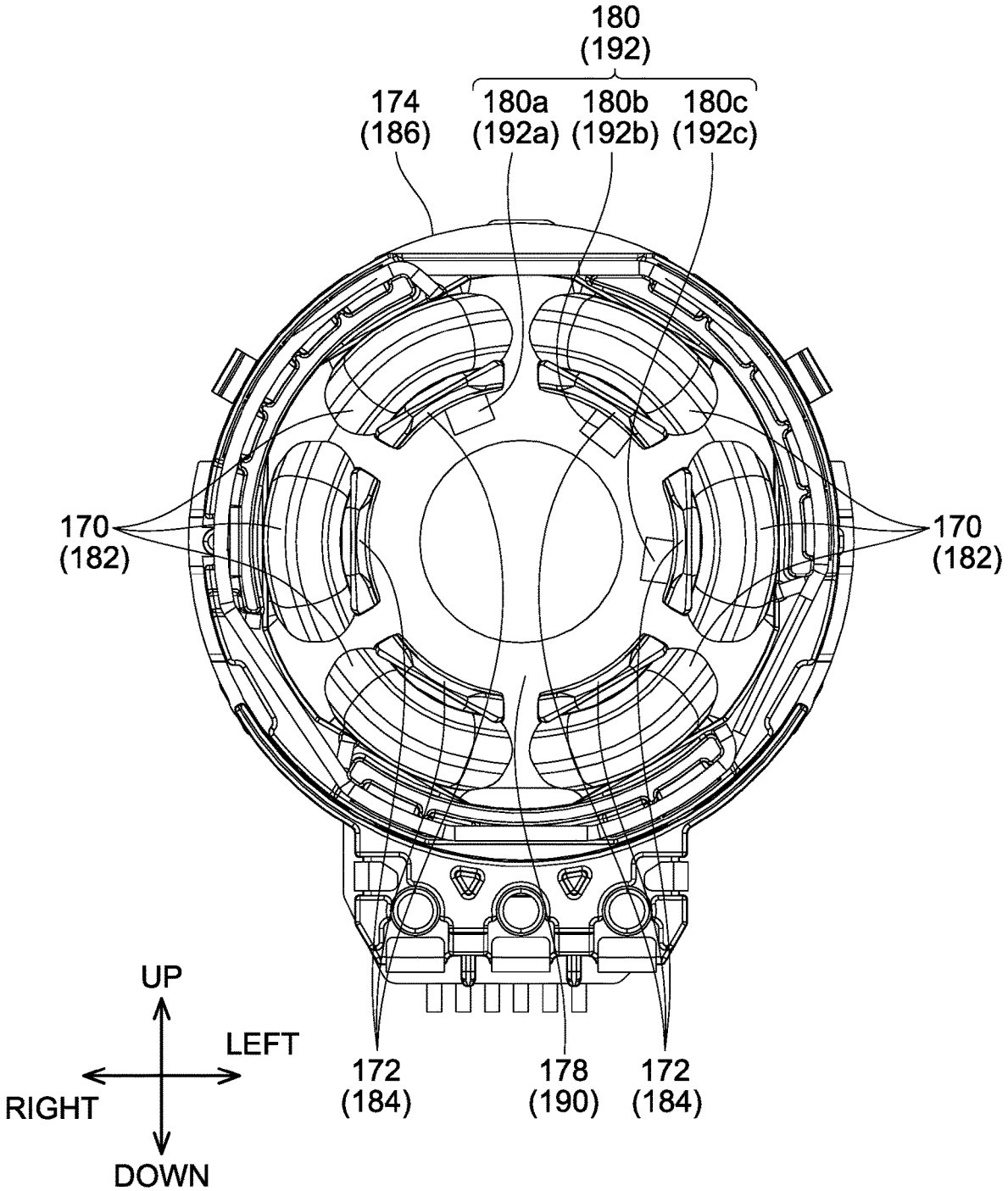
FIG. 19 is a front view of stators 174, 186 and sensor boards 178, 190 of the feed motor 32 and the twisting motor 76 of the rebar tying tool 2 according to working example 1.

In the present working example, the feed motor 32 is a brushless motor. As shown in FIG. 18, the feed motor 32 comprises: a stator 174, which comprises teeth 172 respectively having coils 170 wound therearound; a rotor 176, which is disposed in the interior of the stator 174; and a sensor board 178, which is fixed to the stator 174. The stator 174 is composed of a magnetic body, e.g., a plurality of laminated steel plates. The rotor 176 comprises permanent magnets, which are disposed (preferably embedded) such that their magnetic poles are arranged around a circumferential direction of the rotor 176. As shown in FIG. 19, a Hall-effect sensor 180 is provided on the sensor board 178. The Hall-effect sensor 180 comprises a first Hall-effect device 180*a*, a second Hall-effect device 180*b*, and a third Hall-effect device 180*c*. The first Hall-effect device 180*a*, the second Hall-effect device 180*b*, and the third Hall-effect device 180*c* each detect the magnetic force of the rotor 176, i.e. the magnetic fields of the permanent magnets embedded in the rotor 176. The Hall-effect sensor 180 is disposed at a location on the sensor board 178 such that its electrical angle for forward rotation of the feed motor 32 is a lead angle of 25° and such that its electrical angle for reverse rotation of the feed motor 32 is a lag angle of 25°. It is noted that, in the present working example, the control board 20 outputs (changes its output voltage level), for reverse rotation of the feed motor 32, at every 60° of change in electrical angle. Consequently, for forward rotation of the feed motor 32, control is performed at a lead angle of 25°; and for reverse rotation of the feed motor 32, control is performed at a lead angle of 60°−25°=35°.

As shown in FIG. 3, the feed part 36 comprises a base member 38, a guide member (e.g., a funnel) 40, the drive gear 42, a first gear 44, a second gear 46, a gear-support member (e.g., a pivotable arm or release lever) 48, and a biasing member (e.g., a coil spring) 52. The guide member 40 is fixed to the base member 38. The guide member 40 has a guide hole 40*a*. The guide hole 40*a* has a tapered shape whose lower-end portion is wide and whose upper-end portion is narrow. The wire W is inserted through the guide hole 40*a*.

The drive gear 42 is operably coupled to the speed-reducing part 34. More specifically, the first gear 44 is supported by the base member 38 in a rotatable manner. The first gear 44 meshes with the drive gear 42. Therefore, rotation of the drive gear 42 causes the first gear 44 to rotate. The first gear 44 has a groove 44*a* configured to receive a first circumferential half (semi-circle) of the wire W. The groove 44*a* is formed on an outer-circumferential surface of the first gear 44 in a direction along a rotational direction of the first gear 44. The second gear 46 meshes with the first gear 44. The second gear 46 is supported by the gear-support member 48 so that the second gear 46 is rotatable relative to the gear-support member 48. The second gear 46 has a groove 46*a* configured to receive a second circumferential half (semi-circle) of the wire W. The groove 46*a* is formed on an outer-circumferential surface of the second gear 46 in a direction around a rotational direction of the second gear 46. The gear-support member 48 is supported by the base member 38 so as to be pivotable about a pivot shaft 48*a*. The biasing member 52 urges the gear-support member 48 in the direction in which the second gear 46 approaches the first gear 44. Thereby, the second gear 46 is normally pressed toward (against) the first gear 44 by the biasing member 52. In this state, the wire W is elastically sandwiched (pressed, clamped) between the groove 44*a* of the first gear 44 and the groove 46*a* of the second gear 46. On the other hand, when the lower, rearward portion of the gear-support member 48 is depressed by the user against the biasing force of the biasing member 52, the gear-support member 48 pivots about the pivot shaft 48*a* and the second gear 46 separates (moves away) from the first gear 44. Thereby, when an empty reel 18 is to be replaced with a new reel 18 having wire W around it, the end of the wire W from the new reel 18 can be easily passed (threaded) between the groove 44*a* of the first gear 44 and the groove 46*a* of the second gear 46 owing to the fact that the first gear 44 is temporarily spaced apart from the second gear 46.

When the feed motor 32 rotates the first gear 44 while the wire W is sandwiched (pressed, clamped) between the groove 44*a* of the first gear 44 and the groove 46*a* of the second gear 46, the wire W is moved either forward (wire advancing movement) or rearward (wire retracting (pull back) movement). In the present working example, when the rotor 176 of the feed motor 32 rotates in a reverse rotational direction, the drive gear 42 rotates in direction D1, which is shown in FIG. 3, and thereby the wire W is advanced toward the guide mechanism 26. On the other hand, when the rotor 176 of the feed motor 32 rotates in a forward direction (i.e. the rotational direction opposite of the reverse rotational direction), the drive gear 42 rotates in direction D2, which is shown in FIG. 3, and thereby the wire W is drawn back (retracted) from the guide mechanism 26.

Configuration of Guide Mechanism 26

Figure 4:
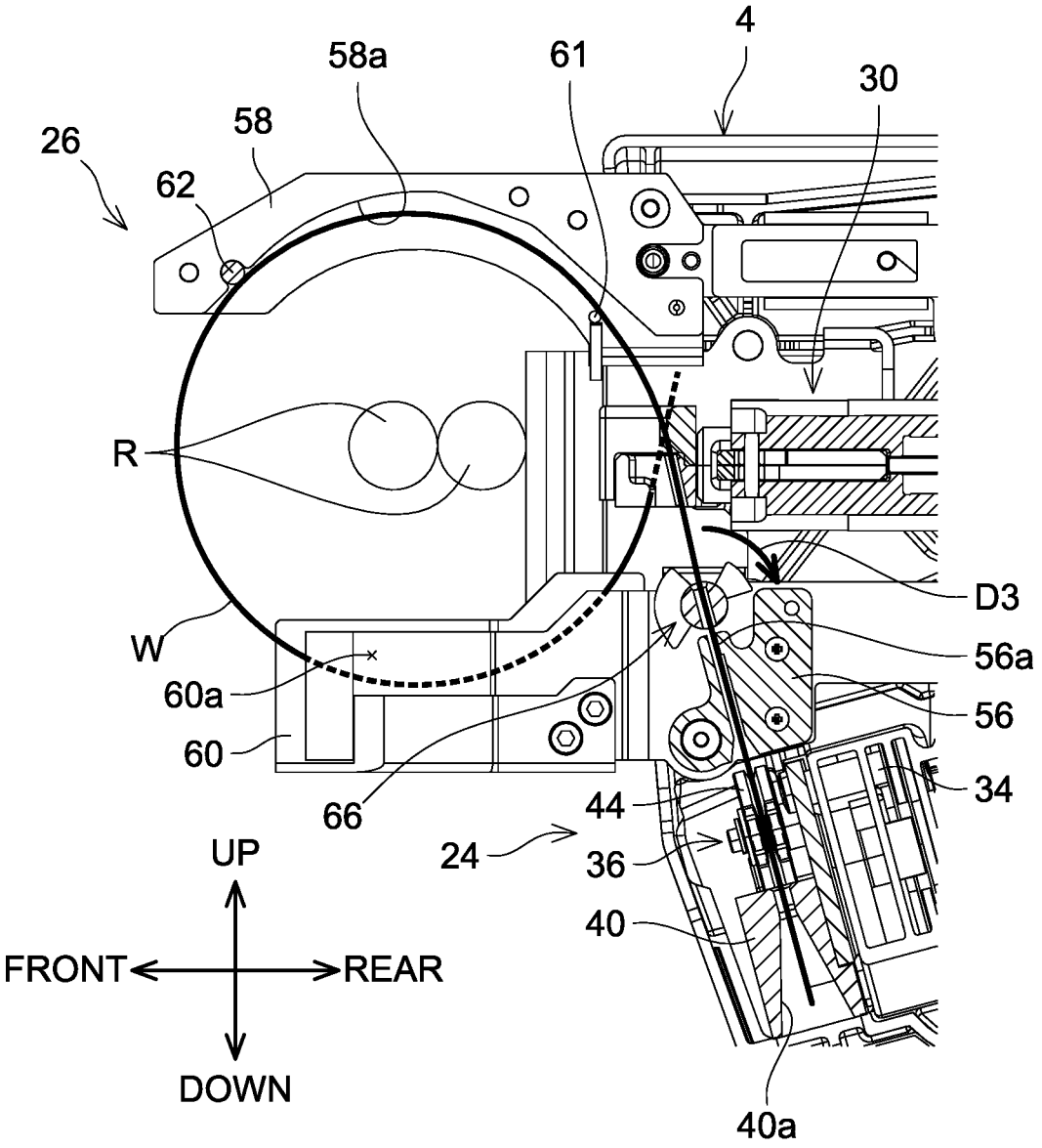
FIG. 4 is a cross-sectional view of the vicinity of a guide mechanism 26 of the rebar tying tool 2 according to working example 1.

As shown in FIG. 4, the guide mechanism 26 comprises a wire guide (wire guide pipe or tube) 56, an upper-side guide arm 58, and a lower-side guide arm 60. When the wire W is advanced from the feed mechanism 24, the wire W passes through the hollow interior of the wire guide 56. A projection part 56*a* is formed in the interior of the wire guide 56.

The upper-side guide arm 58 is provided on a front-upper portion of the main body 4. The upper-side guide arm 58 has (defines) an upper-side guide passageway 58*a*. After passing through the interior of the wire guide 56, the wire W passes through the upper-side guide passageway 58*a*. A first guide pin 61 and a second guide pin 62 are disposed in the upper-side guide passageway 58*a*. As the wire W passes through the upper-side guide passageway 58*a*, the wire W sequentially contacts the projection part 56*a* of the wire guide 56, then the first guide pin 61, and then the second guide pin 62. As a result of these successive contacts, a downward-facing curl is imparted to the wire W, i.e. the wire W is bent or curved (curled) into a circular shape or a loop shape, as can be seen, e.g., in FIGS. 1 and 4.

The lower-side guide arm 60 is provided on a front-lower portion of the main body 4. The lower-side guide arm 60 has (defines) a lower-side guide passageway 60*a*. After passing through the upper-side guide passageway 58*a*, the curled wire W then passes through the lower-side guide passageway 60*a*. In the view shown in FIG. 4, a portion of the wire W is hidden (covered) by the lower-side guide arm 60 and the twisting mechanism 30 and therefore this portion would not visible outside of the main body 4. This hidden (covered) portion of the wire W is depicted by a broken line.

Configuration of Cutting Mechanism 28

Figure 5:
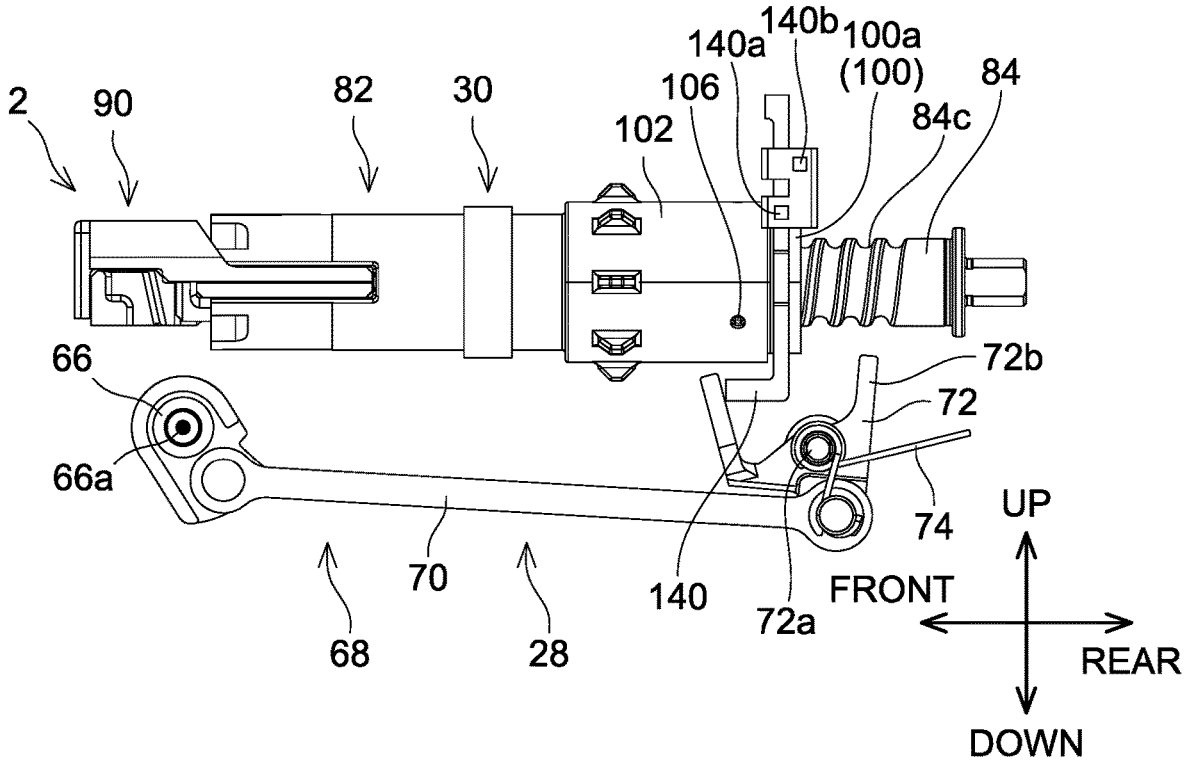
FIG. 5 is a side view of a holding part 82 and a cutting mechanism 28, in the state in which a manipulated member 72 is at an initial position, of the rebar tying tool 2 according to working example 1.

As shown in FIG. 5, the cutting mechanism (wire severing mechanism) 28 comprises a cutting member (severing member) 66 and a link part (link) 68. The cutting member 66 is configured/adapted to cut (sever) the wire W. As shown in FIG. 4, the cutting member 66 is disposed along the passageway through which the wire W advanced from the feed mechanism 24 to the guide mechanism 26 passes. The wire W passes through the hollow interior of the cutting member 66. The cutting member 66 is supported such that it is pivotable about a pivot shaft 66*a* (refer to FIG. 5) relative to the main body 4. When the cutting member 66 rotates in direction D3 as shown in FIG. 4, the wire W is cut (severed) by the cutting member 66.

Figure 6:
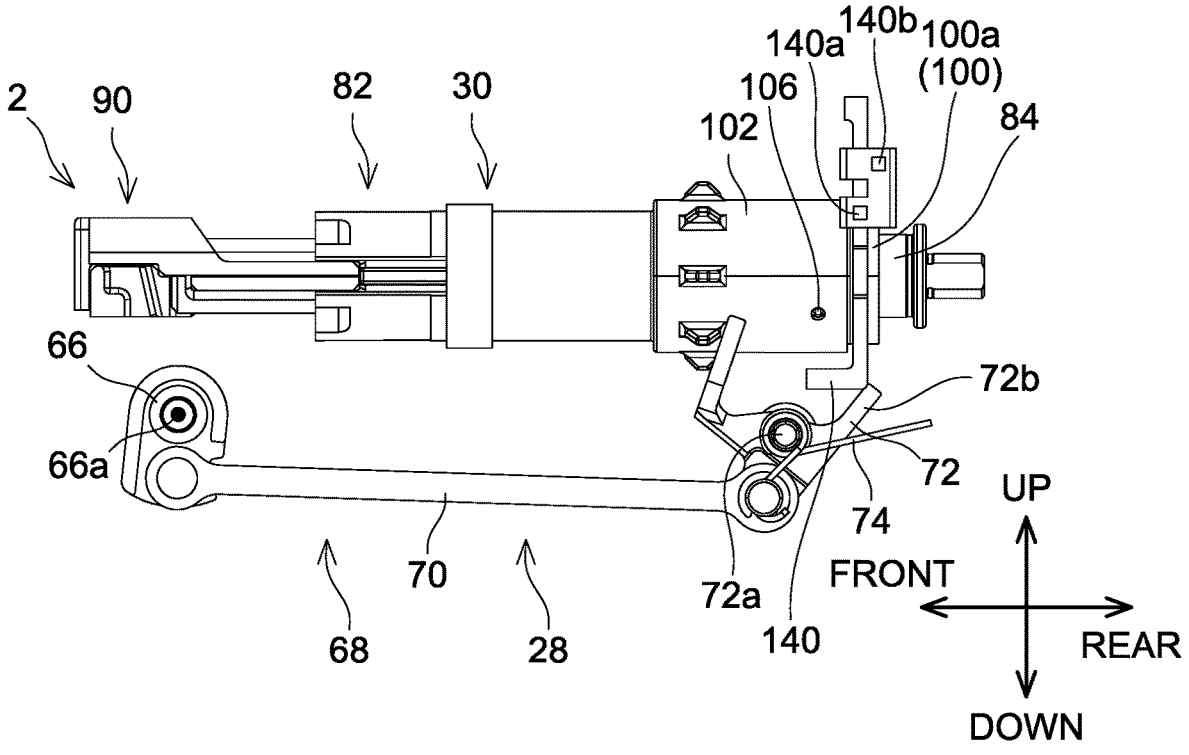
FIG. 6 is a side view of the holding part 82 and the cutting mechanism 28, in the state in which the manipulated member 72 is at a cutting position, of the rebar tying tool 2 according to working example 1.

As shown in FIG. 5, the link part 68 comprises a coupling member (e.g., a rod) 70, a manipulated member (e.g., a lever) 72, and a biasing member (e.g., a torsion spring) 74. The coupling member 70 is coupled to (and interposed between) the cutting member 66 and the manipulated member 72. The manipulated member 72 is supported such that it is pivotable about a pivot shaft 72*a* relative to the main body 4. The manipulated member 72 is normally urged to an initial position by the biasing member 74. When a counter-force larger than the biasing force produced by the biasing member 74 is applied to the manipulated member 72, the manipulated member 72 pivots about the pivot shaft 72*a*. Thereby, the coupling member 70 moves forward, and the cutting member 66 pivots about the pivot shaft 66*a*. When the manipulated member 72 pivots about the pivot shaft 72*a* from the initial position to a prescribed position, which is shown in FIG. 6, the wire W is cut (severed) by the pivoting of the cutting member 66. Hereinbelow, the position of the manipulated member 72 in the state (position) shown in FIG. 6 is called the cutting position.

Configuration of Twisting Mechanism 30

Figure 7:
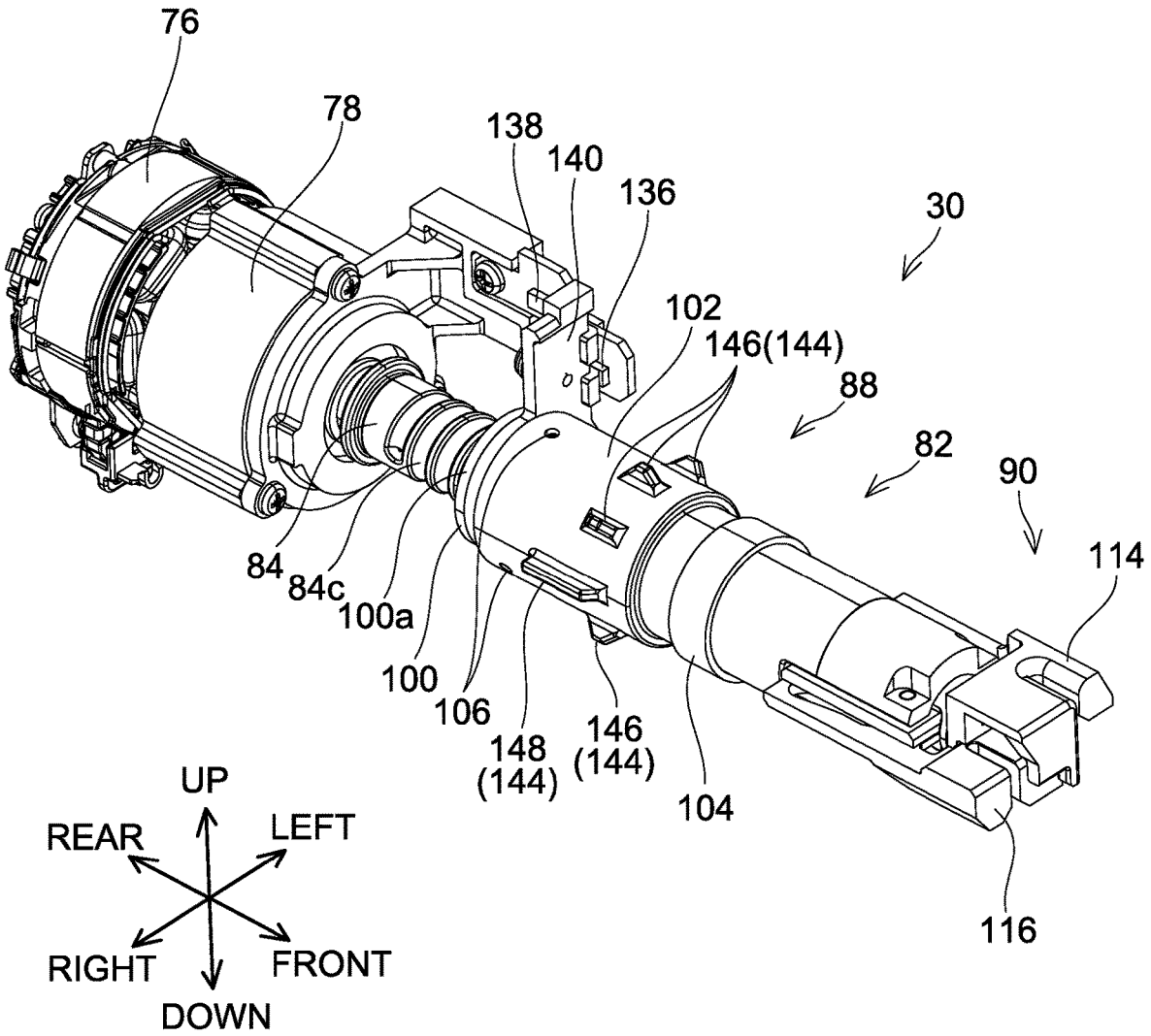
FIG. 7 is an oblique view of a twisting mechanism 30 of the rebar tying tool 2 according to working example 1.

As shown in FIG. 7, the twisting mechanism 30 comprises a twisting motor (i.e. a motor that supplies motive power for twisting together the two ends of a wire W that has been wound around the rebars R and then severed) 76, a speed-reducing part (gear transmission) 78, and a holding part (wire holding or clamping mechanism) 82. The twisting motor 76 is electrically connected to the control board 20 by wiring, which is not shown. The twisting motor 76 is driven by electric power supplied from the battery B. The drive (energization) of the twisting motor 76 is controlled by the control board 20. The twisting motor 76 is connected to a screw shaft 84 of the holding part 82 via the speed-reducing part 78. The speed-reducing part 78 reduces the speed of the rotational output (while increasing the output torque) of the twisting motor 76 using, for example, a planetary-gear mechanism and transmits that speed-reduced (torque-increased) rotational output to the screw shaft 84.

In the present working example, the twisting motor 76 is a brushless motor and has the same configuration as that of the feed motor 32. As shown in FIG. 18, the twisting motor 76 comprises: a stator 186, which comprises teeth 184 respectively having coils 182 wound therearound; a rotor 188, which is disposed in the interior of the stator 186; and a sensor board 190, which is fixed to the stator 186. The stator 186 is composed of a magnetic body, e.g., a plurality of laminated steel plates. The rotor 188 comprises permanent magnets, which are disposed (preferably embedded) such that their magnetic poles are arranged around a circumferential direction of the rotor 188. As shown in FIG. 19, a Hall-effect sensor 192 is provided on the sensor board 190. The Hall-effect sensor 192 comprises a first Hall-effect device 192*a*, a second Hall-effect device 192*b*, and a third Hall-effect device 192*c*. The first Hall-effect device 192*a*, the second Hall-effect device 192*b*, and the third Hall-effect device 192*c* each detect the magnetic force of the rotor 188, i.e. the magnetic fields of the embedded permanent magnets of the rotor 188. The Hall-effect sensor 192 is disposed at a location on the sensor board 190 such that its electrical angle for forward rotation of the twisting motor 76 is a lead angle of 25° and such that its electrical angle for reverse rotation of the twisting motor 76 is a lag angle of 25°. It is noted that, in the present working example, the control board 20 outputs (changes its output voltage level), for reverse rotation of the twisting motor 76, at every 60° of change in electrical angle. Consequently, for forward rotation of the rotor 188 of the twisting motor 76, control is performed at a lead angle of 25°; and for reverse rotation of the rotor 188 of the twisting motor 76, control is performed at a lead angle of 60°−25°=35°.

As was mentioned above, the twisting motor 76 and the feed motor 32 have the same configuration in the present working example. Consequently, parts in common are used in the stator 174 and the stator 186, parts in common are used in the rotor 176 and the rotor 188, and parts in common are used in the sensor board 178 and the sensor board 190.

As shown in FIG. 7, the holding part 82 comprises the screw shaft 84, a clamp guide 86 (refer to FIG. 8 and FIG. 9), a biasing member 92 (refer to FIG. 8 and FIG. 9), a sleeve 88, and a sandwiching member 90. The sandwiching member 90 may also be referred to as a wire-ends clamping mechanism or a wire-ends holding mechanism.

The screw shaft 84 is operably coupled to the speed-reducing part 78. While the rotor 188 of the twisting motor 76 rotates in its forward rotational direction, the screw shaft 84 rotates in the direction of a left-hand screw when the screw shaft 84 is viewed from the rear. While the rotor 188 of the twisting motor 76 rotates in its reverse rotational direction (i.e. opposite of the forward rotation direction), the screw shaft 84 rotates in the direction of a right-hand screw when the screw shaft 84 is viewed from the rear.

Figure 8:
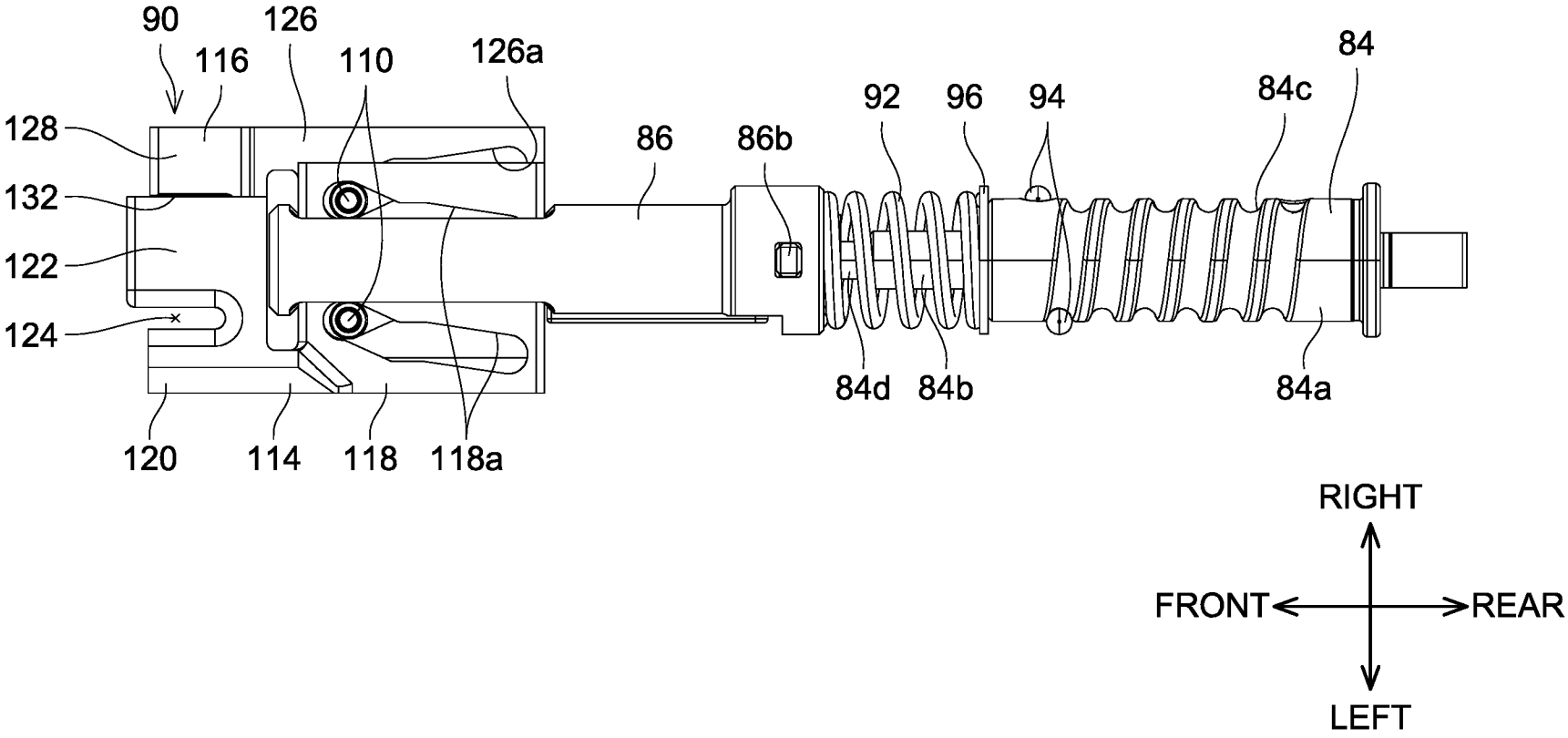
FIG. 8 is a top view of a screw shaft 84, a clamp guide 86, a sandwiching member 90, and a biasing member 92 of the rebar tying tool 2 according to working example 1.

As shown in FIG. 8, the screw shaft 84 comprises a large-diameter part 84*a* and a small-diameter part 84*b*. The large-diameter part 84*a* is located at a rear portion of the screw shaft 84, and the small-diameter part 84*b* is located at a front portion of the screw shaft 84. A ball groove (helical raceway) 84*c*, which has a helical shape, is formed on an outer-circumferential surface of the large-diameter part 84*a*. Balls 94 mate with (in) the ball groove 84*c*. A washer 96, which has a circular-ring shape, is disposed at a step formed between the large-diameter part 84*a* and the small-diameter part 84*b*. An engaging groove 84*d* is formed on a front portion of the small-diameter part 84*b*.

Figure 9:
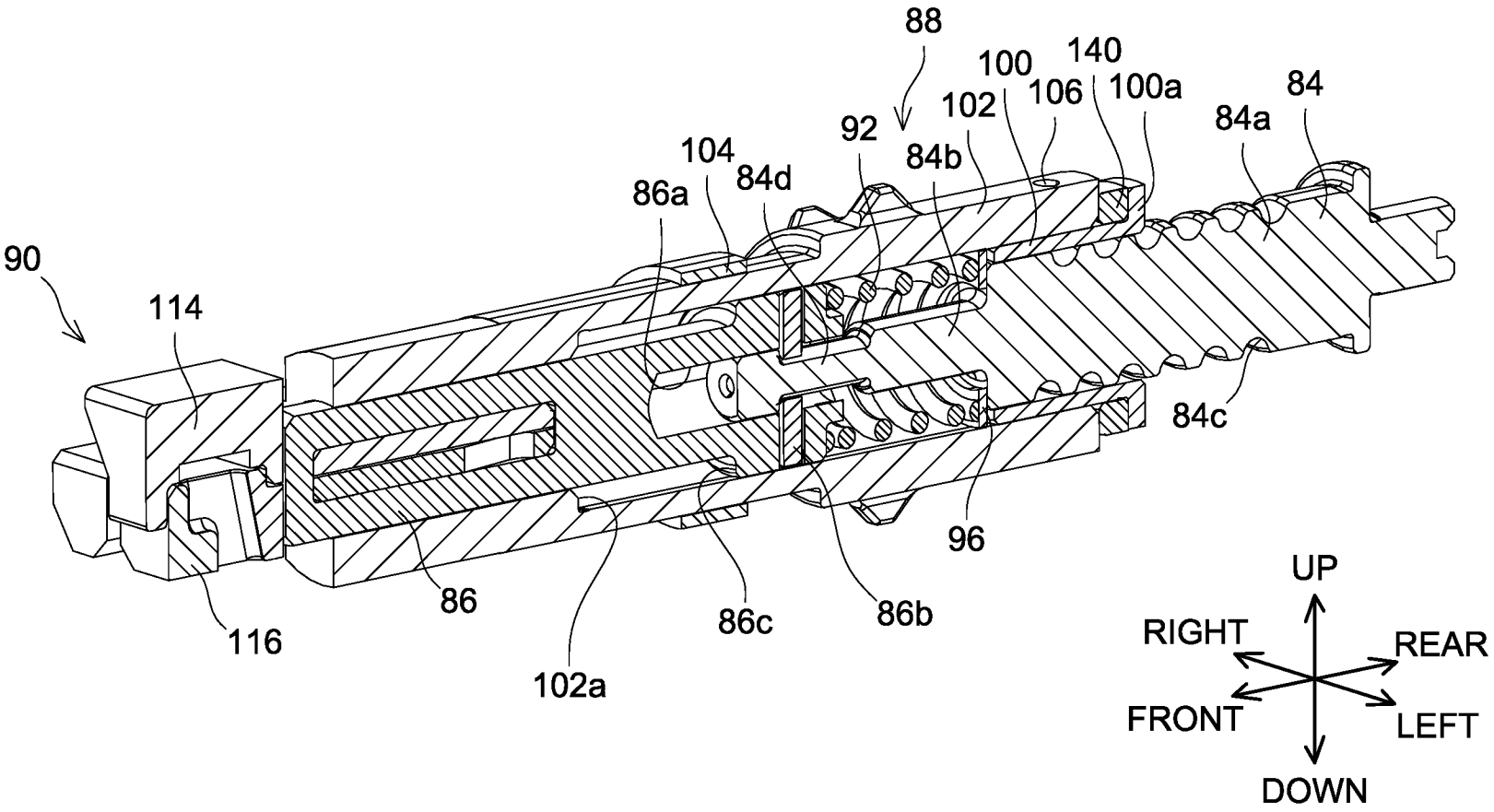
FIG. 9 is a cross-sectional oblique view of the holding part 82, in the state in which an outer sleeve 102 of the rebar tying tool 2 is at an advanced position relative to the clamp guide 86, according to working example 1.

As shown in FIG. 9, a front portion of the small-diameter part 84*b* has entered (extends into) a recess (blind hole) 86*a* defined in the clamp guide 86. An engaging pin 86*b* of the clamp guide 86 has entered (extends into) the engaging groove 84*d* of the small-diameter part 84*b* of the screw shaft 84 and is capable of engaging with a front-side surface and a rear-side surface of the engaging groove 84*d*. A step part 86*c* is formed (defined) on an outer-circumferential surface of the clamp guide 86. The diameter of the outer-circumferential surface of the clamp guide 86 that is located rearward of the step part 86*c* is larger than that of the outer-circumferential surface of the clamp guide 86 that is located forward of the step part 86*c*.

In addition, the small-diameter part 84*b* is inserted through the biasing member 92. The biasing member 92 is disposed between the washer 96 and the clamp guide 86. The biasing member 92 biases the clamp guide 86 in the direction away from the washer 96.

The screw shaft 84 and the clamp guide 86 are inserted into the sleeve 88. The sleeve 88 comprises an inner sleeve 100 and an outer sleeve 102. The large-diameter part 84*a* of the screw shaft 84 is inserted through the inner sleeve 100. Ball holes (not shown) are formed in the inner sleeve 100. The balls 94 respectively mate with (in) the ball holes. The inner sleeve 100 is coupled to the screw shaft 84 via the balls 94, which are mated in and disposed between the ball groove 84*c* and the ball holes; that is, the inner sleeve 100 is operably coupled to the screw shaft 84 via a so-called "ball screw". When the screw shaft 84 rotates relative to the inner sleeve 100 in the region within which the ball groove 84*c* is formed, the inner sleeve 100 is moved in the front-rear direction relative to the screw shaft 84.

The screw shaft 84, the clamp guide 86, and the inner sleeve 100 are inserted into the outer sleeve 102. The outer sleeve 102 has a circular-tube shape extending in the front-rear direction. A step part 102*a* is formed on an inner-circumferential surface of the outer sleeve 102. The diameter of the inner-circumferential surface of the outer sleeve 102 that is forward of the step part 102*a* is smaller than the diameter of the inner-circumferential surface of the outer sleeve 102 that is rearward of the step part 102*a*. The outer sleeve 102 is fixed to the inner sleeve 100 by a set screw 106. The outer sleeve 102 operates (i.e., moves or rotates) together with the inner sleeve 100. When the screw shaft 84 rotates relative to the inner sleeve 100 in the region within which the ball groove 84*c* is formed, the outer sleeve 102 is moved, together with the inner sleeve 100, in the front-rear direction relative to the screw shaft 84. In addition, when the screw shaft 84 rotates relative to the inner sleeve 100, the outer sleeve 102 moves between an advanced (forward) position and a retracted (rearward) position relative to the clamp guide 86. Hereinbelow, the movement of the outer sleeve 102 toward the advanced position relative to the clamp guide 86 (i.e., forward movement) is referred to as the advance of the outer sleeve 102, and the movement of the outer sleeve 102 toward a retracted position relative to the clamp guide 86 (i.e., rearward movement) is referred to as the retraction of the outer sleeve 102.

The holding part 82 further comprises a support member 104. The support member 104 covers an outer-circumferential surface of the outer sleeve 102. The support member 104 is rotatable relative to the outer sleeve 102. The support member 104 is movable in the front-rear direction relative to the outer sleeve 102. The outer sleeve 102 is supported by the main body 4 via the support member 104.

The sandwiching member 90 is supported by a front portion of the clamp guide 86. The sandwiching member 90 is supported, in a manner such that it is movable relative to the outer sleeve 102, by two guide pins 110 (refer to FIG. 8) of the outer sleeve 102. The sandwiching member 90 is configured/adapted to selectively sandwich, clamp or hold the wire W. More particularly, the sandwiching member 90 selectively clamps or holds the two ends (end portions) of a segment of the wire W after a single strand of the wire W has been looped (wound) around two or more rebars R and then severed by the cutting member 66. The sandwiching member 90 opens and closes in conjunction with the rotation of the screw shaft 84. That is, rotation of the screw shaft 84 causes the sandwiching member 90 to close (clamp the wire ends) or open (release the wire ends).

Figure 10:
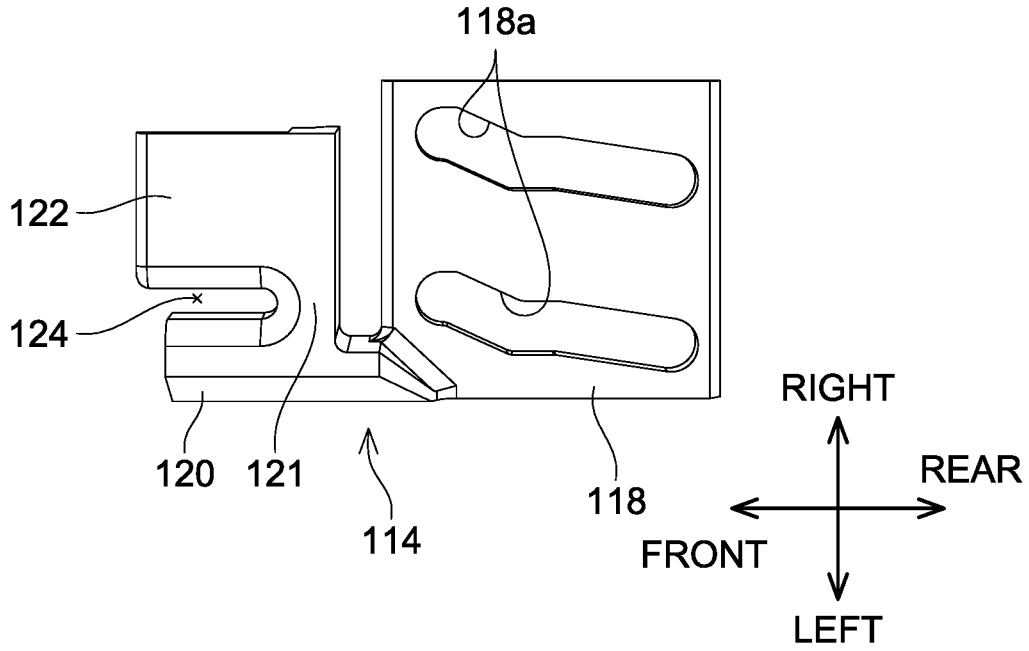
FIG. 10 is a top view of an upper-side sandwiching member 114 of the rebar tying tool 2 according to working example 1.

The sandwiching member 90 comprises an upper-side sandwiching member 114 and a lower-side sandwiching member 116. The upper-side sandwiching member 114 opposes the lower-side sandwiching member 116 in the up-down direction. As shown in FIG. 10, the upper-side sandwiching member 114 comprises an upper-side base part 118, a first upper-side protruding part 120, an upper-side coupling part 121, and a second upper-side protruding part 122. The upper-side base part 118 is a portion that is supported by the clamp guide 86 and the guide pins 110. The upper-side base part 118 has two upper-side guide holes 118*a*. The two upper-side guide holes 118*a* have the same shape as one another. The two upper-side guide holes 118*a* extend in the front-rear direction and are tilted toward the right side from the rear to the front when the upper-side base part 118 is viewed from above.

The first upper-side protruding part 120 extends forward from a left-front end portion of the upper-side base part 118. The upper-side coupling part 121 extends in the right direction from a center-right end portion of the first upper-side protruding part 120. The second upper-side protruding part 122 extends forward from the upper-side coupling part 121. The first upper-side protruding part 120 and the second upper-side protruding part 122 are spaced apart in the left-right direction. A first wire passageway 124 is formed between the first upper-side protruding part 120 and the second upper-side protruding part 122. After the wire W has been advanced from the feed mechanism 24 but before it has reached the upper-side guide passageway 58*a* of the guide mechanism 26, the wire W passes through the first wire passageway 124.

Figure 12:
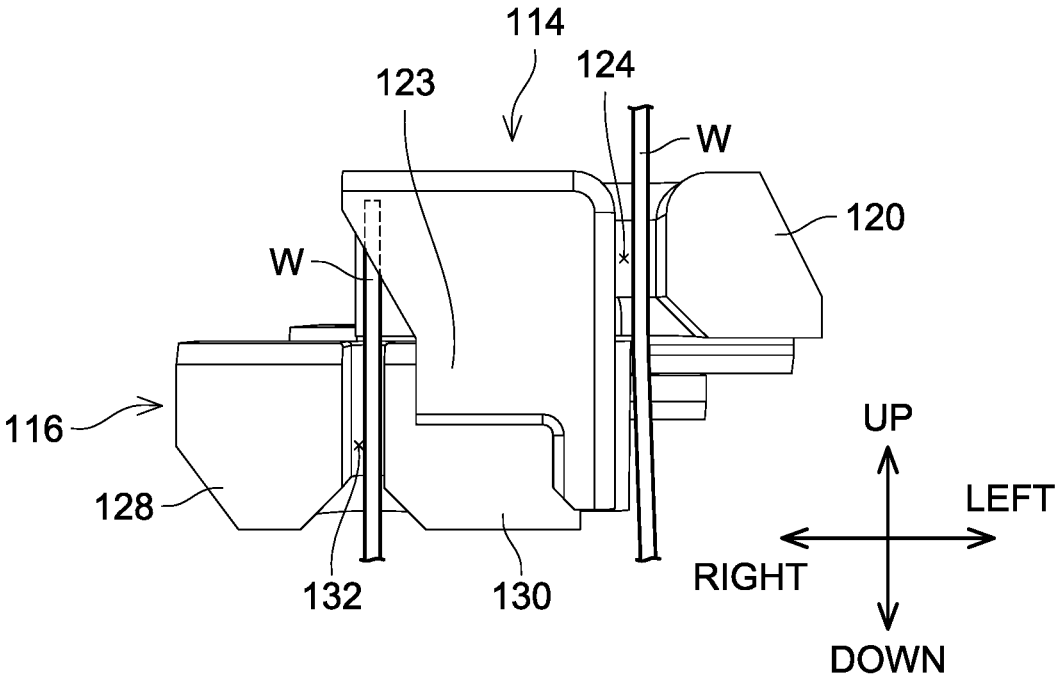
FIG. 12 is a front view of the sandwiching member 90 of the rebar tying tool 2 according to working example 1.

The sandwiching member 90 further comprises a first retaining part 123, which is shown in FIG. 12. The first retaining part 123 is formed integrally with the upper-side sandwiching member 114. The first retaining part 123 extends downward from a front-end portion of the second upper-side protruding part 122. The first retaining part 123 partially overlaps the lower-side sandwiching member 116 in the front-rear direction. The first retaining part 123 impedes (blocks) the wire W, which is held by the sandwiching member 90, from coming off the sandwiching member 90.

Figure 11:
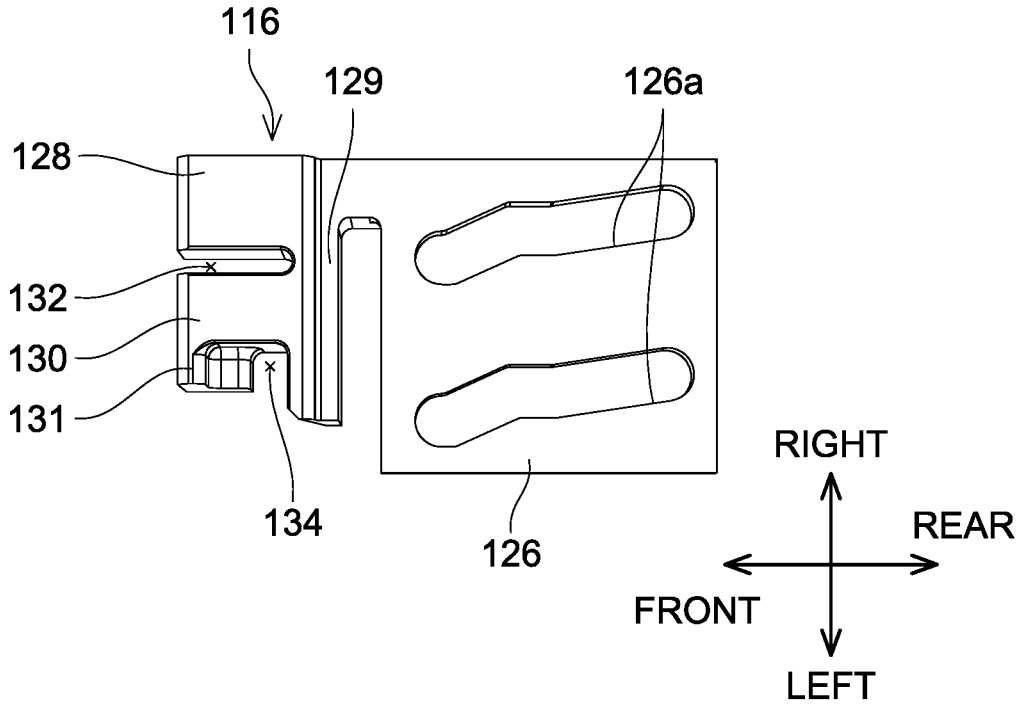
FIG. 11 is a top view of a lower-side sandwiching member 116 of the rebar tying tool 2 according to working example 1.

As shown in FIG. 11, the lower-side sandwiching member 116 comprises a lower-side base part 126, a first lower-side protruding part 128, a lower-side coupling part 129, and a second lower-side protruding part 130. The lower-side base part 126 is a portion that is supported by the clamp guide 86 and the guide pins 110. The lower-side base part 126 has two lower-side guide holes 126*a*. The shape of the lower-side guide holes 126*a* when the lower-side base part 126 is viewed from above and the shape of the upper-side guide holes 118*a* when the upper-side base part 118 is viewed from above have a plane symmetry relationship with respect to a plane orthogonal to the left-right direction. That is, the two lower-side guide holes 126*a* extend in the front-rear direction and are tilted toward the left side from the rear to the front when the lower-side base part 126 is viewed from above.

The first lower-side protruding part 128 extends forward from a right-front end portion of the lower-side base part 126. The lower-side coupling part 129 extends leftward from a center-left end portion of the first lower-side protruding part 128. The second lower-side protruding part 130 extends forward from a center-front end portion of the lower-side coupling part 129. The first lower-side protruding part 128 and the second lower-side protruding part 130 are spaced apart from one another in the left-right direction. A second wire passageway 132 is formed (defined) between the first lower-side protruding part 128 and the second lower-side protruding part 130. After passing through the lower-side guide passageway 60*a* of the guide mechanism 26, the wire W passes through the second wire passageway 132.

The sandwiching member 90 further comprises a second retaining part 131. The second retaining part 131 is formed integrally with the lower-side sandwiching member 116. The second retaining part 131 extends leftward from the left-front end portion of the second lower-side protruding part 130. The second retaining part 131 impedes (blocks) the wire W, which is sandwiched by the sandwiching member 90, from coming off the sandwiching member 90. The second retaining part 131 and the lower-side coupling part 129 are spaced apart from one another in the front-rear direction. An auxiliary passageway 134 is formed between the second retaining part 131 and the lower-side coupling part 129.

As shown in FIG. 8, in the state in which the upper-side sandwiching member 114 and the lower-side sandwiching member 116 overlap one another in the up-down direction, the guide pins 110 of the outer sleeve 102 are inserted through the upper-side guide holes 118*a* and the lower-side guide holes 126*a*. When the outer sleeve 102 moves in the front-rear direction relative to the clamp guide 86, the guide pins 110 move in the front-rear direction within the upper-side guide holes 118*a* and within the lower-side guide holes 126*a*. When the guide pins 110 are disposed in front portions of the upper-side guide holes 118*a* and the lower-side guide holes 126*a*, the first wire passageway 124 and the second wire passageway 132 are open, as shown in FIG. 12. The state of the sandwiching member 90 at this time is called the fully open state.

Figure 13:
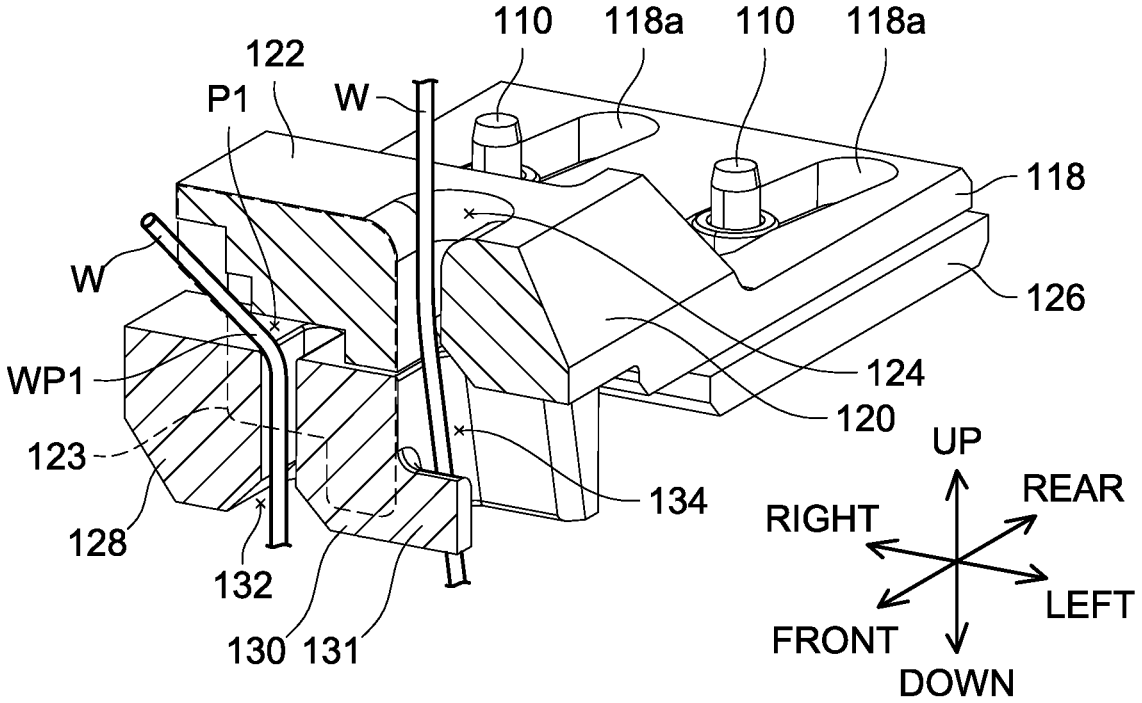
FIG. 13 is a cross-sectional oblique view of the sandwiching member 90 and guide pins 110, in the state in which the guide pins 110 are at intermediate positions of upper-side guide holes 118*a* and lower-side guide holes 126*a*, of the rebar tying tool 2 according to working example 1.

When the outer sleeve 102 retracts relative to the clamp guide 86, the guide pins 110 move rearward within the upper-side guide holes 118*a* and within the lower-side guide holes 126*a*. When the upper-side sandwiching member 114 moves in the right direction relative to the clamp guide 86, the lower-side sandwiching member 116 moves in the left direction relative to the clamp guide 86 (i.e., in the direction opposite the direction in which the upper-side sandwiching member 114 moves). The distance that the upper-side sandwiching member 114 moves in the right direction is the same as the distance that the lower-side sandwiching member 116 moves in the left direction. The upper-side sandwiching member 114 and the lower-side sandwiching member 116 move in directions that approach one another when the sandwiching member 90 is viewed from the up-down direction. As shown in FIG. 13, when the guide pins 110 move to an intermediate position within the upper-side guide holes 118*a* and within the lower-side guide holes 126*a*, the second wire passageway 132 is closed up by the second upper-side protruding part 122. On the other hand, the first wire passageway 124 is open owing to the auxiliary passageway 134 formed in the second lower-side protruding part 130. The state of the sandwiching member 90 at this time is called the semi-open state or half-open state. When the wire W is disposed in the second wire passageway 132, the wire W is sandwiched (clamped, held) and thereby fixed between the second upper-side protruding part 122 and the first lower-side protruding part 128 at first sandwiching location P1, which also may be referred to as first sandwiching region P1 or first clamping region P1. Hereinbelow, the portion of the wire W that is sandwiched at first sandwiching location P1 is called first sandwiched location WP1, which also may be referred to as first sandwiched segment WP1 or first clamped segment WP1. In the semi-open state, the first retaining part 123 closes up first sandwiching location P1 from the front. It is noted that, in FIG. 13, the location of the first retaining part 123 in the front-rear direction is shown by a broken line. The first retaining part 123 is disposed between the rebars R (not shown in FIG. 13) and first sandwiching location P1.

Figure 14:
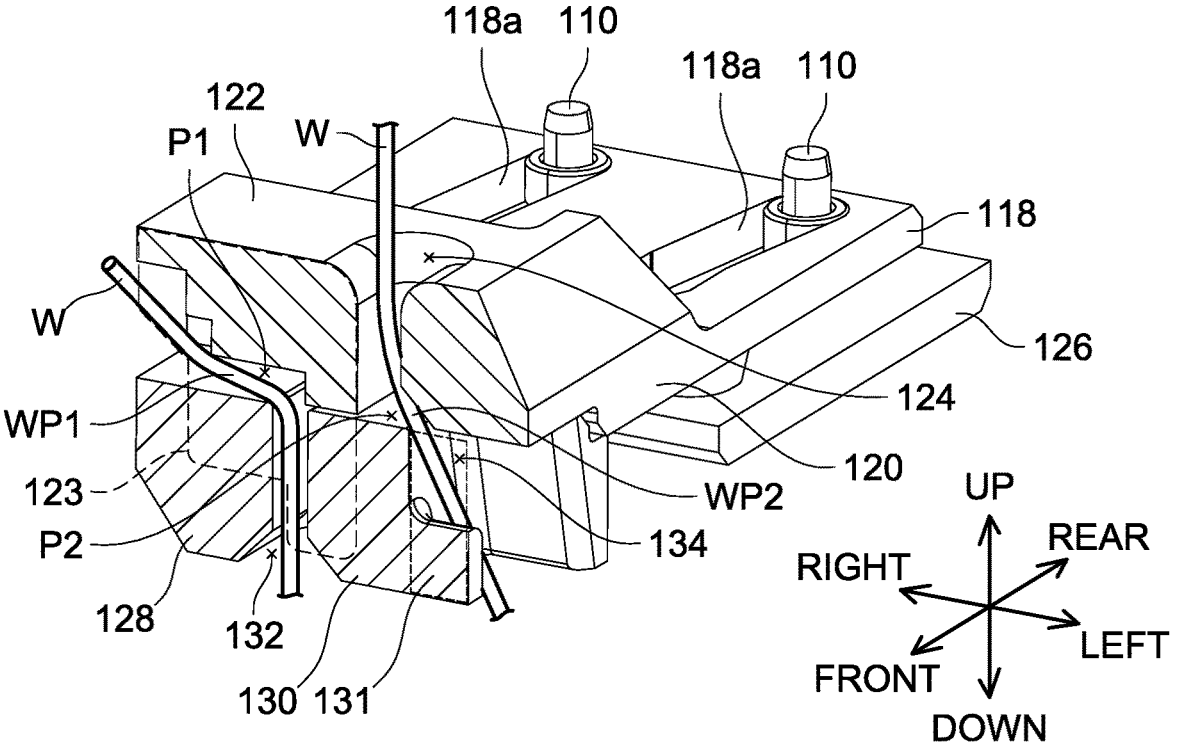
FIG. 14 is a cross-sectional oblique view of the sandwiching member 90 and the guide pins 110, in the state in which the guide pins 110 are at rear portions of the upper-side guide holes 118*a* and the lower-side guide holes 126*a*, of the rebar tying tool 2 according to working example 1.

As shown in FIG. 14, when the guide pins 110 move to rear portions of the upper-side guide holes 118*a* and the lower-side guide holes 126*a*, the first wire passageway 124 is closed up by the second lower-side protruding part 130. The second wire passageway 132 remains closed up, as is, by the second upper-side protruding part 122. The state of the sandwiching member 90 at this time is called the fully closed state. When the wire W is disposed in the first wire passageway 124, the wire W is sandwiched by and thereby fixed (clamped, held) between the first upper-side protruding part 120 and the second lower-side protruding part 130 at second sandwiching location (second sandwiching region or second clamping region) P2, with first sandwiched location WP1 of the wire W remaining gripped (held) by first sandwiching location P1 of the sandwiching member 90. Hereinbelow, the portion of the wire W that is sandwiched by second sandwiching location P2 is called second sandwiched location WP2, which also may be referred to as second sandwiched segment WP2 or second clamped segment WP2. In the fully closed state, the first retaining part 123 closes up first sandwiching location P1 from the front, and the second retaining part 131 is disposed directly below and forward of second sandwiching location P2. It is noted that, in FIG. 14, a front-end portion of the second retaining part 131 is shown by a broken line, whose pitch is shorter than that of the broken line that indicates the first retaining part 123. In this state, the second retaining part 131 is disposed (located) between the rebars R (not shown in FIG. 14) and second sandwiching location P2.

As shown in FIG. 7, the holding part 82 further comprises a push plate 140. The push plate 140 is sandwiched (interposed) between a rib 100*a*, which is formed on a rear-end portion of the inner sleeve 100, and a rear-end portion of the outer sleeve 102. When the screw shaft 84 is caused to rotate in response to energization (driving) of the twisting motor 76, the push plate 140, together with the inner sleeve 100 and the outer sleeve 102, is moved in the front-rear direction relative to the screw shaft 84.

As shown in FIG. 5 and FIG. 6, the push plate 140 is configured/adapted to manipulate (press) the manipulated member (lever) 72 of the cutting mechanism 28. As shown in FIG. 5, the push plate 140 is normally spaced apart from a protruding piece 72*b* of the manipulated member 72. At this time, the manipulated member 72 is located at the (its) initial position. When the push plate 140 retracts relative to the screw shaft 84 in response to the rotation of the screw shaft 84, the push plate 140 makes contact with the protruding piece 72*b* and thereby pushes (pivots) the manipulated member 72 rearward. When the manipulated member 72 pivots about the pivot shaft 72*a*, the coupling member 70 moves forward and causes the cutting member 66 to pivot about the pivot shaft 66*a*. Thus, movement of the push plate 140 results in manipulation (pivoting) of the cutting member 66 via the manipulated member 72. As shown in FIG. 6, when the manipulated member 72 pivots to the cutting position, the wire W, which extends through the interior of the cutting member 66, is cut (severed) by the cutting member 66. Subsequently, the push plate 140 is advanced (moved forward) relative to the screw shaft 84 in response to the rotation of the screw shaft 84, and the manipulated member 72, which is biased by the biasing member 74, thereby pivots to the (its) initial position about the pivot shaft 72*a*. As a result, the coupling member 70 and the cutting member 66 also return to the state (initial state or initial position) shown in FIG. 5.

An initial-state detection magnet 140*a* and a grip-detection magnet 140*b* are provided on the push plate 140. As shown in FIG. 7, the twisting mechanism 30 comprises an initial-state detection sensor 136, which detects the magnetic force from (the magnetic field of) the initial-state detection magnet 140*a*, and a grip-detection sensor 138, which detects the magnetic force from (i.e., the magnetic field of) the grip-detection magnet 140*b*. The positions of the initial-state detection sensor 136 and the grip-detection sensor 138 are fixed relative to the main body 4. The initial-state detection sensor 136 is disposed such that it opposes the initial-state detection magnet 140*a* when the twisting mechanism 30 is in the initial state. Consequently, the initial-state detection sensor 136 can detect whether the twisting mechanism 30 is in the initial state. In the twisting mechanism 30, the grip-detection sensor 138 is disposed (located) so as to oppose the grip-detection magnet 140*b* when the sandwiching member 90 is in the semi-open state, that is, when the sandwiching member 90 is holding (clamping) a front end portion (segment) of the wire W. Consequently, the grip-detection sensor 138 can detect whether the sandwiching member 90 is in a state in which the front end portion of the wire W is held in the twisting mechanism 30.

As shown in FIG. 7, fins 144 are formed on the outer-circumferential surface of a rear portion of the outer sleeve 102. The fins 144 each extend in the front-rear direction. The fins 144 permit or prohibit the rotation of the outer sleeve 102 as will be explained below. In the present working example, there are eight of the fins respectively disposed at 45° intervals on (around) the outer-circumferential surface of the outer sleeve 102. In addition, in the present working example, the fins 144 include seven short fins 146 and one long fin 148. The length of the long fin 148 in the front-rear direction is greater than the length of the short fins 146 in the front-rear direction. In the front-rear direction, the position of the front-end portion of the long fin 148 is the same as the positions of the front-end portions of the short fins 146. On the other hand, in the front-rear direction, the rear-end portion of the long fin 148 is rearward of the rear-end portions of the short fins 146.

Figure 15:
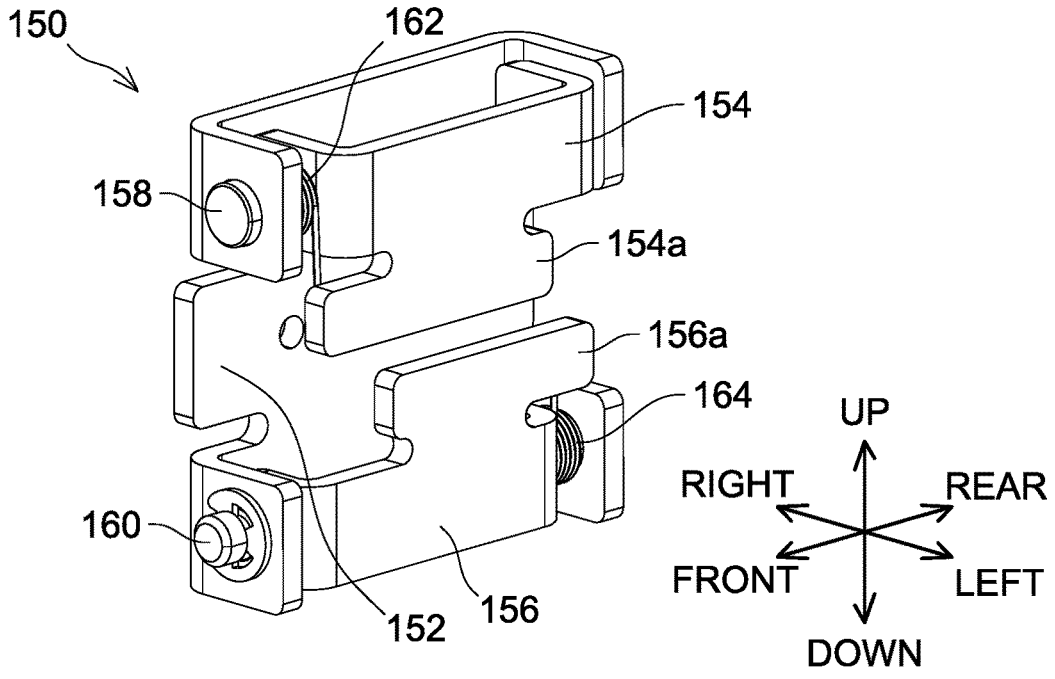
FIG. 15 is an oblique view of a rotation-restricting part 150 of the rebar tying tool 2 according to working example 1.
Figure 17:
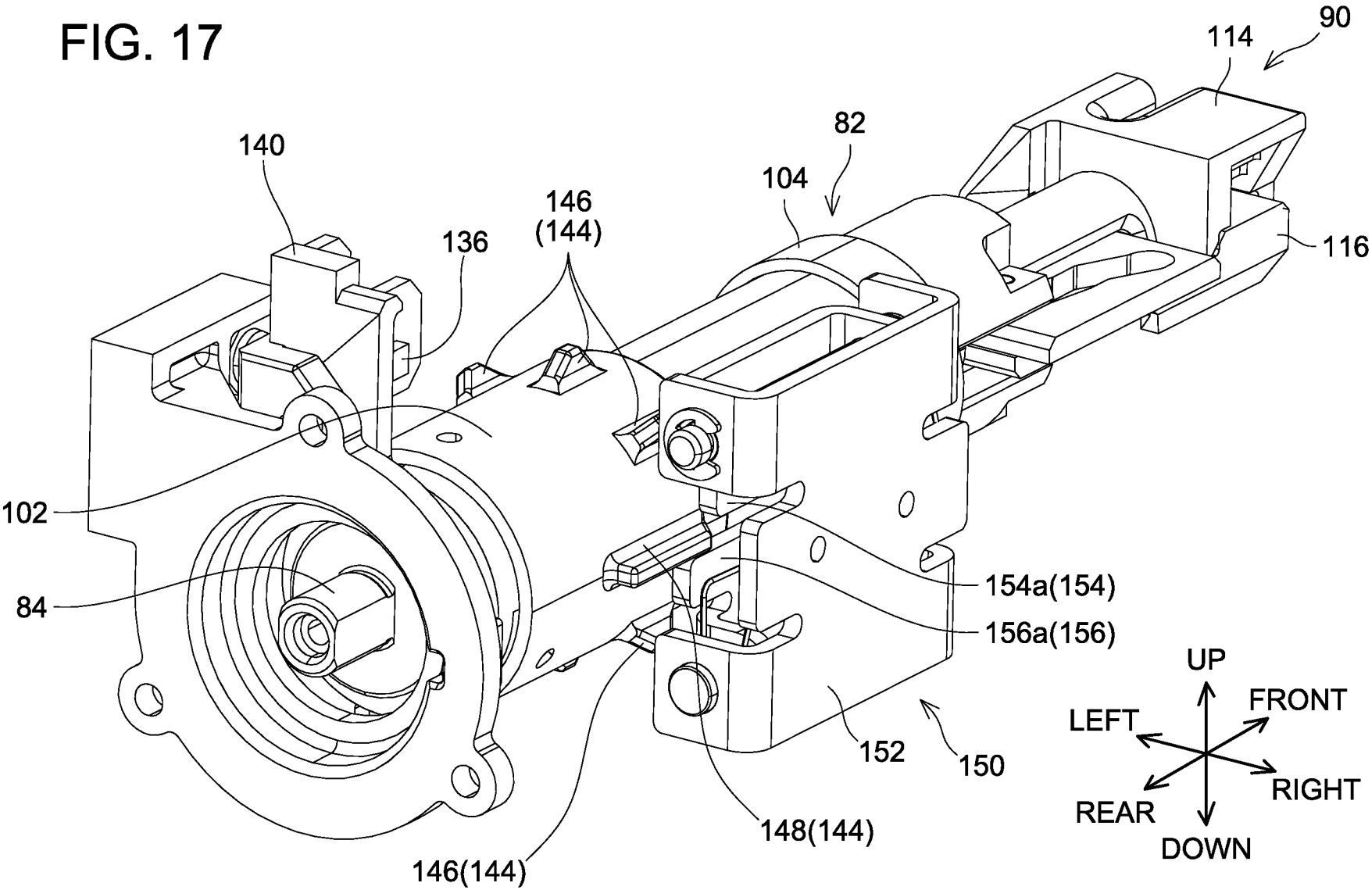
FIG. 17 is a side view of the holding part 82 and the rotation-restricting part 150, in the state in which a base member 152 and biasing members 162, 164 have been detached, of the rebar tying tool 2 according to working example 1.

The rebar tying tool 2 further comprises a rotation-restricting part (rotation blocking part) 150, which is shown in FIG. 15. As shown in FIG. 17, the rotation-restricting part 150 is disposed at a location proximate to the outer sleeve 102. The rotation-restricting part 150 permits or prohibits (blocks), in conjunction with the fins 144, the rotation of the outer sleeve 102. As shown in FIG. 15, the rotation-restricting part 150 comprises a base member 152, an upper-side stopper 154, a lower-side stopper 156, pivot shafts 158, 160, and biasing members 162, 164. The base member 152 is fixed relative to the main body 4. The upper-side stopper 154 is supported, in a pivotable manner, by the base member 152 via the pivot shaft 158. The upper-side stopper 154 comprises a restricting piece (blocking piece) 154*a*. The restricting piece 154*a* is located at a lower portion of the upper-side stopper 154. The biasing member 162 biases the restricting piece 154*a* in the direction that it opens outward (i.e., in the direction that the restricting piece 154*a* moves away from the base member 152, more specifically the leftward direction in FIG. 15).

In response to rotation of the screw shaft 84 in the direction of a right-hand screw when the screw shaft 84 is viewed from the rear, the short fins 146 and the long fin 148 push in (push rightward) the restricting piece 154*a*. Consequently, the upper-side stopper 154 does not prohibit the rotation of the outer sleeve 102. On the other hand, in response to rotation of the screw shaft 84 in the direction of a left-hand screw when the screw shaft 84 is viewed from the rear, the short fins 146 and the long fin 148 make contact with the restricting piece 154*a* in the rotational direction of the outer sleeve 102. Consequently, the upper-side stopper 154 prohibits the rotation of the outer sleeve 102. Rotation of the screw shaft 84 in the direction of a right-hand screw when the screw shaft 84 is viewed from the rear corresponds to the situation in which the twisting mechanism 30 terminates (ends) the twisting together of the end portions of the wire W that is wound around the rebars R and then returns to the initial state. In addition, rotation of the screw shaft 84 in the direction of a left-hand screw when the screw shaft 84 is viewed from the rear corresponds to the situation in which the twisting mechanism 30 sandwiches (clamps, holds) the ends of the wire W and twists together the end portions of the wire W that is wound around the rebars R.

The lower-side stopper 156 is supported, in a pivotable manner, by the base member 152 via the pivot shaft 160. The lower-side stopper 156 comprises a restricting piece (blocking piece) 156*a*. The restricting piece 156*a* is located at an upper portion of the lower-side stopper 156. The restricting piece 156*a* opposes the restricting piece 154*a* with a gap therebetween as shown in FIG. 15. A rear-end portion of the restricting piece 156*a* is disposed rearward of a rear-end portion of the restricting piece 154*a*. A front-end portion of the restricting piece 156*a* is disposed rearward of a front-end portion of the restricting piece 154*a*. The biasing member 164 biases the restricting piece 156*a* in the direction that it opens outward (i.e., in the direction that the restricting piece 156*a* moves away from the base member 152, more specifically in the leftward direction in FIG. 15).

In response to rotation of the screw shaft 84 in the direction of a right-hand screw when the screw shaft 84 is viewed from the rear, the short fins 146 and the long fin 148 make contact with the restricting piece 156*a* in the rotational direction of the outer sleeve 102. Consequently, the lower-side stopper 156 prohibits (blocks) the rotation of the outer sleeve 102. On the other hand, in response to rotation the screw shaft 84 in the direction of a left-hand screw when the screw shaft 84 is viewed from the rear, the short fins 146 and the long fin 148 push in (push rightward) the restricting piece 156*a*. Consequently, the lower-side stopper 156 does not prohibit the rotation of the outer sleeve 102.

It is noted that, with regard to the mechanical configuration of the rebar tying tool 2, various modifications may be effected in the above-mentioned configuration. For example, in the rebar tying tool 2, the reel holder 12 may be disposed in a rear portion of the main body 4, and the feed mechanism 24 may be disposed between the reel holder 12 and the guide mechanism 26 of the main body 4. In such a modified embodiment, the reel 18, the feed motor 32, and the twisting motor 76 are all disposed upward of the grip 6. Alternatively, the control board 20, the display board 22, or the like may be housed in the interior of the main body 4. In such a modified embodiment, the control board 20, the display board 22, or the like may be disposed upward of the grip 6.

In addition or in the alternative to the above-mentioned modifications, instead of holding (clamping) the opposite ends of a single loop (winding) of the wire W and then twisting together the two end portions of the wire W in order to tie (bind) the rebars R together with a single loop (strand) of wire, in some aspects of the present teachings, the twisting mechanism 30 may be modified to twist the wire in another manner. For example, the twisting mechanism according to the present teachings may be adapted/configured in accordance with the above-mentioned US 2019/0193879 A1, in which the rebar tying tool feeds sufficient wire so that the wire is looped (wound) two or more times around the rebars. The two rotatable hooks of the twisting mechanism of US 2019/0193879 A1 clasp two or more parallel strand portions of an intermediate portion of the looped wire and are then rotated to thereby form a twist in the intermediate portion of the looped wire. This twisting operation of US 2019/0193879 A1 has the effect of simultaneously cinching the looped wire around the rebars and forming a tied portion that holds the looped wire around the rebars. Thus, in some applications of the present teachings, such a twisting mechanism according to, e.g., US 2019/0193879 A1 may be incorporated into embodiments according to the present teachings. Furthermore, the twisting mechanism of US 2019/0193879 A1 serves as another corresponding structure of a twisting mechanism according to the present teachings and the entire content of US 2019/0193879 A1 is incorporated herein by reference.

Operation of Rebar Tying Tool 2

Next, an operation in which the rebar tying tool 2 ties together two or more of the rebars R using the wire W will be explained, with reference to FIG. 4, FIG. 9, FIG. 16, and FIG. 17. When the rebar tying tool 2 ties together the rebars R using the wire W, an advancing process (wire advancing process), a tip-holding process (wire tip holding (clamping) process), a draw-back process (wire draw back (retraction) process), a rear-end holding process (a wire rear-end holding (clamping) process), a cutting process (wire severing process), a pulling process (wire-ends pulling process), and a twisting process (wire-ends twisting together process) are performed in this order. Here, in the initial state before the rebar tying tool 2 ties the rebars R using the wire W, as shown in FIG. 9, only a front portion of the screw shaft 84 is disposed in the interior of the inner sleeve 100. In addition, the long fin 148 is sandwiched (interleaved) between the restricting piece 154*a* of the upper-side stopper 154 and the restricting piece 156*a* of the lower-side stopper 156. In addition, the outer sleeve 102 is located at the advanced position relative to the clamp guide 86. The two guide pins 110 are located at front portions of the two upper-side guide holes 118*a* and at front portions of the two lower-side guide holes 126*a*, and the sandwiching member 90 is in the fully open state. As shown in FIG. 5, the push plate 140 is spaced apart from the protruding piece 72*b* of the manipulated member 72, and the manipulated member 72 is at the (its) initial position.

Advancing Process

When the rotor 176 of the feed motor 32 rotates from the (its) initial state in its reverse rotational direction, the feed mechanism 24 advances a prescribed length of the wire W from the reel 18 so that a single loop (winding) of the wire W encircles the two or more rebars R. This wire advancement (wire unreeling) causes a tip (front-end) portion of the wire W to pass through, in order, the interior of the cutting member 66, the first wire passageway 124, the upper-side guide passageway 58*a*, the lower-side guide passageway 60*a*, and the second wire passageway 132. Thereby, as shown in FIGS. 1, 2 and 4, the wire W is wound (looped or wrapped) around the rebars R in a circular-ring (loop) shape.

Tip-Holding Process

At this time, the twisting motor 76 is energized to rotate the rotor 188 in its forward rotational direction such that the screw shaft 84 is thereby rotated in the direction of a left-hand screw. As a result, the long fin 148 makes contact with the restricting piece 154*a* of the upper-side stopper 154 in the rotational (circumferential) direction of the outer sleeve 102, and rotation of the outer sleeve 102 in the direction of a left-hand screw is prohibited (blocked). Consequently, the outer sleeve 102 retracts, together with the inner sleeve 100, relative to the clamp guide 86 owing to the rotation of the screw shaft 84. In conjunction with this retraction of the outer sleeve 102, the two guide pins 110 move within the two upper-side guide holes 118*a* and within the two lower-side guide holes 126*a* from the front portion thereof to an intermediate position thereof. This movement of the guide pins 110 causes the sandwiching member 90 to change from the (its) fully open state to the (its) semi-open state, whereby a tip-vicinity (front-end) portion (i.e., first sandwiched location (segment) WP1) of the wire W is sandwiched (clamped, held) and thereby fixed at (within) first sandwiching location (region) P1 between the second upper-side protruding part 122 and the first lower-side protruding part 128. Thereby, the tip-vicinity portion of the wire W is held by the sandwiching member 90. In this state, the first retaining part 123 closes up, from the front, first sandwiching location P1 of the sandwiching member 90.

Draw-Back Process

From this state (at this time), energization (driving) of the twisting motor 76 is stopped. Then, the feed motor 32 is energized to rotate the rotor 176 in its forward rotational direction, so that the feed part 36 pulls back (tensions, cinches) the wire W that is wound around the rebars R. Because the tip-vicinity (front-end) portion of the wire W is held (clamped) by the sandwiching member 90, this wire draw back (retraction) process causes the diameter of the loop of wire W that is wound around the rebars R to decrease, i.e. the loop of wire W is cinched (tightened) around the rebars R so that the wire W tightly binds the rebars R together. Excess wire W that has been retracted is re-wound around the reel 18 for use in a subsequent rebar tying operation.

Rear-End Holding Process

From this state (at this time), the twisting motor 76 is energized once again to rotate the rotor 188 in its forward rotational direction, which causes the outer sleeve 102, together with the inner sleeve 100, to further retract relative to the clamp guide 86. In conjunction with the retraction of the outer sleeve 102, the two guide pins 110 move, within the two upper-side guide holes 118*a* and within the two lower-side guide holes 126*a*, from the intermediate position to the rear portion. This movement of the guide pins 110 causes the sandwiching member 90 to change from the (its) semi-open state to the (its) fully closed state, and a rear-end-vicinity portion (i.e., second sandwiched location (segment) WP2) of the wire W is sandwiched (clamped, held) and thereby fixed at (within) second sandwiching location (region) P2 between the first upper-side protruding part 120 and the second lower-side protruding part 130. Thereby, the rear-end-vicinity portion of the wire W is held (clamped) by the sandwiching member 90. In this state, the first retaining part 123 closes up, from the front, first sandwiching location P1 of the sandwiching member 90, and the second retaining part 131 is disposed directly below second sandwiching location P2 of the sandwiching member 90. In addition, the first retaining part 123 and the second retaining part 131 are now disposed (located) between the rebars R and the wire W.

Cutting Process

From this state (at this time), the rotor 188 of the twisting motor 76 is rotated further in its forward rotational direction, thereby causing the outer sleeve 102 to further retract relative to the clamp guide 86. As shown in FIG. 6, this further retraction causes the push plate 140 to retract together with the outer sleeve 102, make contact with the protruding piece 72*b* of the manipulated member 72, and push the protruding piece 72*b* rearward. As a result, the manipulated member 72 pivots about the pivot shaft 72*a* to the cutting position, which causes the cutting member 66 to pivot about the pivot shaft 66*a* to a prescribed position. As a result of this pivoting movement, the wire W, which extends through the interior of the cutting member 66, is cut (severed). As this time, the loop of wire W that is wound around the rebars R is held by the sandwiching member 90 at two points, namely at the vicinity of the tip (front-end) portion of the wire W and at the vicinity of the rear-end portion of the wire W. In other words, the two ends of the wire W are held or clamped by the sandwiching member 90 in the state that the wire W is tightly cinched around the rebars R.

Pulling Process

Figure 16:
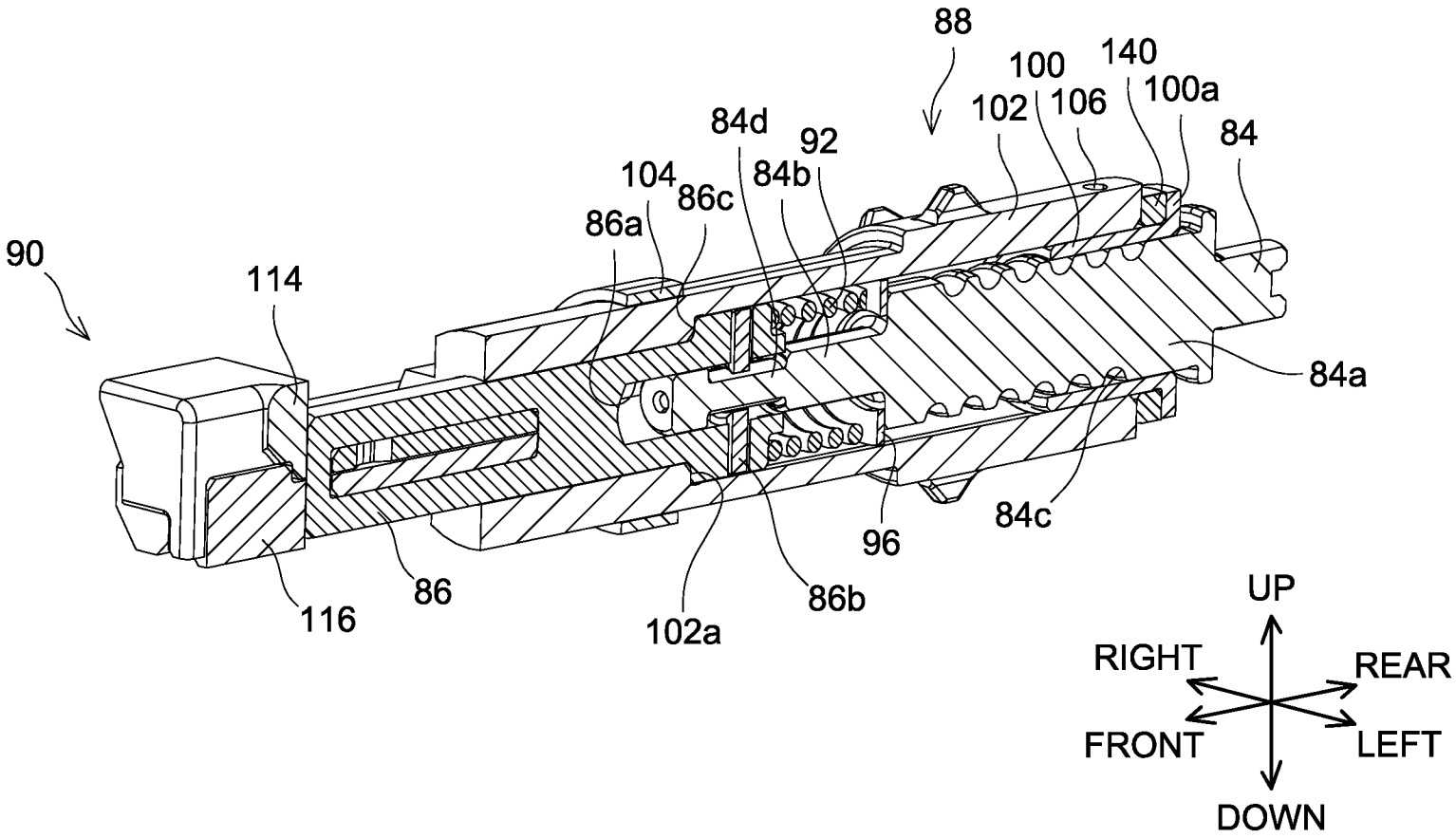
FIG. 16 is a cross-sectional oblique view of the holding part 82, in the state in which a step part 102*a* of the outer sleeve 102 and a step part 86*c* of the clamp guide 86 are in contact with one another, of the rebar tying tool 2 according to working example 1.

From this state (at this time), the rotor 188 of the twisting motor 76 is rotated further in its forward rotational direction, which causes the outer sleeve 102 to further retract relative to the clamp guide 86, as shown in FIG. 16. As a result thereof, the step part 102*a* of the outer sleeve 102 makes contact with the step part 86*c* of the clamp guide 86. Consequently, the outer sleeve 102 cannot further retract relative to the clamp guide 86 but does retract together with the clamp guide 86 in an integral manner. Thereby, the sandwiching member 90 retracts (i.e., the sandwiching member 90 moves in the direction away from the rebars R), and the two ends of the wire W are pulled in the direction away from the rebars R. While the pulling process is being performed, the first retaining part 123 closes up, from the front, first sandwiching location P1, and the second retaining part 131 is disposed directly below and forward of second sandwiching location P2. Consequently, in response to the tension imparted to the wire W owing to the pulling of the two ends of the wire W, the two ends of the wire W move forward relative to the sandwiching member 90, whereby tip-vicinity portion WP1 of the wire W makes contact with the first retaining part 123, and rear-end-vicinity portion WP2 of the wire W makes contact with the second retaining part 131. Thereby, the two ends of the wire W are pulled in the direction away from the rebars R without coming off the sandwiching member 90. In other words, the two end portions of the wire W are pulled (straightened), e.g., so that the two end portions extend substantially perpendicular to the extension direction of at least one of the rebars R.

Twisting Process

From this state, the rotor 188 of the twisting motor 76 is rotated further in its forward rotational direction, thereby causing the outer sleeve 102 to retract together with the clamp guide 86. As a result, as shown in FIG. 17, the long fin 148 no longer makes contact with the restricting piece 154*a* of the upper-side stopper 154 in the rotational direction of the outer sleeve 102. Thereby, rotation of the outer sleeve 102 in the direction of a left-hand screw is permitted. In this state, the biasing member 92 is compressed, and a biasing force that biases the clamp guide 86 in the direction away from the washer 96 is imparted from the biasing member 92 to the clamp guide 86. Consequently, a frictional force acts between the balls 94, which are mated in the ball holes of the inner sleeve 100, and the ball groove 84*c* of the screw shaft 84. Therefore, when the clamp guide 86 rotates, the outer sleeve 102 rotates, in an integral manner with the screw shaft 84, in the direction of a left-hand screw without retracting relative to the screw shaft 84. Thereby, the clamp guide 86 and the sandwiching member 90 rotate in the direction of a left-hand screw, and the two end portions of the wire W, which are held by the sandwiching member 90, are twisted together. While the twisting process is being performed, the same as the situation in which the pulling process is performed, the first retaining part 123 closes up, from the front, first sandwiching location P1, and the second retaining part 131 is disposed directly below and forward of second sandwiching location P2. Consequently, when the end portions of the wire W move forward relative to the sandwiching member 90 owing to the tension imparted to the end portions of the wire W in response to the twisting of the wire W, tip-vicinity portion WP1 of the wire W makes contact with the first retaining part 123, and rear-end-vicinity portion WP2 of the wire W makes contact with the second retaining part 131. Thereby, the two end portions of the wire W are twisted together without coming off the sandwiching member 90.

Initial-State Returning Process

Subsequently, the rotor 188 of twisting motor 76 is rotated in its reverse rotational direction, thereby causing the screw shaft 84 to rotate in the direction of a right-hand screw. As a result, the outer sleeve 102 rotates in the direction of a right-hand screw, the short fins 146 and the long fin 148 make contact with the restricting piece 156*a* of the lower-side stopper 156, and rotation of the outer sleeve 102 in the direction of a right-hand screw is prohibited (blocked). The biasing force that biases the clamp guide 86 in the direction away from the washer 96 is imparted from the biasing member 92 to the clamp guide 86, and the outer sleeve 102 advances together with the clamp guide 86 in an integral manner. When the engaging pin 86*b* makes contact with the front-end portion of the engaging groove 84*d*, the outer sleeve 102 advances relative to the clamp guide 86. When the two guide pins 110 move, within the two upper-side guide holes 118*a* and within the two lower-side guide holes 126*a*, from the rear portion to the front portion, the sandwiching member 90 changes to the fully open state. Thereby, the two end portions of the wire W held by the sandwiching member 90 separate from the sandwiching member 90. When one of the short fins 146 makes contact with the restricting piece 156*a*, the outer sleeve 102 advances relative to the clamp guide 86; and when the short fins 146 move forward of the front-end portion of the restricting piece 156*a*, the outer sleeve 102 once again rotates in the direction of a right-hand screw. When the long fin 148 makes contact with the restricting piece 156*a*, rotation of the outer sleeve 102 is prohibited. Thereby, the twisting mechanism 30 returns to the (its) initial state.

Circuit Configuration of Control Board 20

As shown in FIG. 20, a regulated power supply circuit 200, an MCU 202 (i.e. microcontroller unit), a motor-control-signal-output-destination-switching circuit 204 (i.e. a circuit configured/adapted to switch the output destination of motor-control signals), a motor-rotation-signal-input-source-switching circuit 206 (i.e. a circuit configured/adapted to switch the input source of motor-rotation signals), gate-driver circuits 208, 210, inverter circuits 212, 214, a current-detection circuit 216, brake circuits 218, 220, etc. are provided on the control board 20.

The regulated power supply circuit 200 adjusts the electric power supplied from the battery B such that a prescribed voltage is supplied to the MCU 202, the brake circuits 218, 220, etc.

Figure 21:
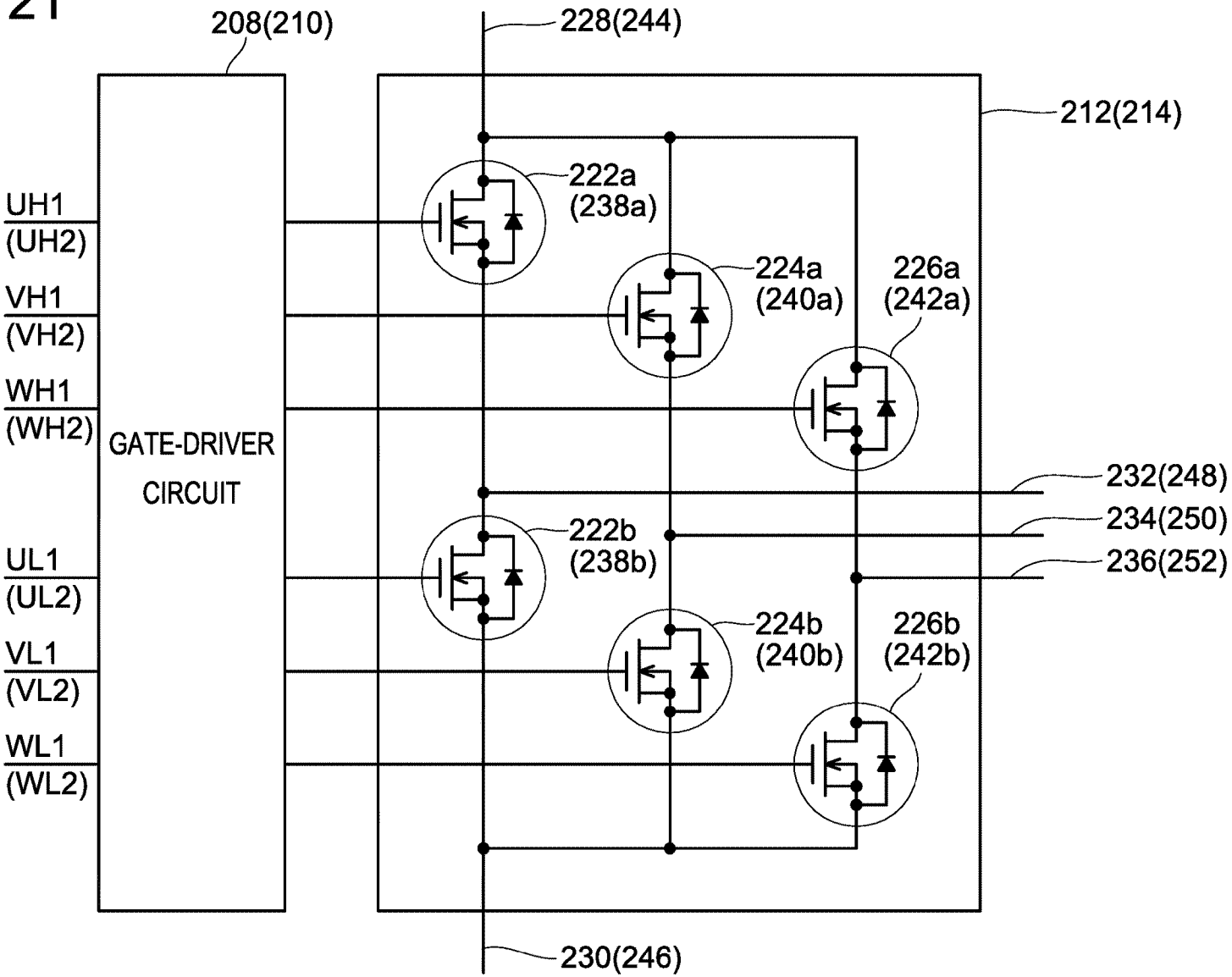
FIG. 21 is a diagram that shows an example of the circuit configuration of inverter circuits 212, 214 of the rebar tying tool 2 according to working example 1.

As shown in FIG. 21, the inverter circuit 212 comprises six switching devices 222*a*, 222*b*, 224*a*, 224*b*, 226*a*, 226*b*. Each of the switching devices 222*a*, 222*b*, 224*a*, 224*b*, 226*a*, 226*b* is a field-effect transistor (FET) and, preferably, is a MOSFET having an insulated gate (isolated gate), e.g., a so-called power MOSFET. The switching device 222*a* connects a positive-electrode-side, electric-potential line 228 and a motor-power line 232. The switching device 222*b* connects a negative-electrode-side, electric-potential line 230 and the motor-power line 232. The switching device 224*a* connects the positive-electrode-side, electric-potential line 228 and a motor-power line 234. The switching device 224*b* connects the negative-electrode-side, electric-potential line 230 and the motor-power line 234. The switching device 226*a* connects the positive-electrode-side, electric-potential line 228 and a motor-power line 236. The switching device 226*b* connects the negative-electrode-side, electric-potential line 230 and the motor-power line 236. The positive-electrode-side, electric-potential line 228 is connected to the positive-electrode-side, power-supply, electric potential of the battery B. The negative-electrode-side, electric-potential line 230 is connected to the current-detection circuit 216. The motor-power lines 232, 234, 236 are connected to respective coils 170 (refer to FIG. 18 and FIG. 19) of the feed motor 32.

Likewise, the inverter circuit 214 comprises six switching devices 238*a*, 238*b*, 240*a*, 240*b*, 242*a*, 242*b*. Each of the switching devices 238*a*, 238*b*, 240*a*, 240*b*, 242*a*, 242*b* is a field-effect transistor (FET) and, preferably, is a MOSFET having an insulated gate (isolated gate), e.g., a so-called power MOSFET. The switching device 238*a* connects a positive-electrode-side, electric-potential line 244 and a motor-power line 248. The switching device 238*b* connects a negative-electrode-side, electric-potential line 246 and the motor-power line 248. The switching device 240*a* connects the positive-electrode-side, electric-potential line 244 and a motor-power line 250. The switching device 240*b* connects the negative-electrode-side, electric-potential line 246 and the motor-power line 250. The switching device 242*a* connects the positive-electrode-side, electric-potential line 244 and a motor-power line 252. The switching device 242*b* connects the negative-electrode-side, electric-potential line 246 and the motor-power line 252. The positive-electrode-side, electric-potential line 244 is connected to the positive-electrode-side, power-supply, electric potential of the battery B. The negative-electrode-side, electric-potential line 246 is connected to the current-detection circuit 216. The motor-power lines 248, 250, 252 are connected to respective coils 182 (refer to FIG. 18 and FIG. 19) of the twisting motor 76.

The gate-driver circuit 208 controls the operation of the feed motor 32 by switching each of the six switching devices 222*a*, 224*a*, 226*a*, 222*b*, 224*b*, 226*b* of the inverter circuit 212, in accordance with motor-control signals UH1, VH1, WH1, UL1, VL1, WL1, between the conducting state and the nonconducting state, in order to control the supply of energizing currents to the coils 170 of the feed motor 32. It is noted that, when the rotor 176 of the feed motor 32 is rotating and the gate-driver circuit 208 sets all the switching devices 222*a*, 224*a*, 226*a*, 222*b*, 224*b*, 226*b* to the nonconducting state, even though the supply of electric power to the feed motor 32 is cut off, the rotor 176 of the feed motor 32 will continue to rotate due to inertia for a period of time until the rotor 176 of the feed motor 32 eventually stops. On the other hand, when the rotor 176 of the feed motor 32 is rotating and the gate-driver circuit 208 sets three of the switching devices 222*a*, 224*a*, 226*a* to the nonconducting state while also setting the other three switching devices 222*b*, 224*b*, 226*b* to the conducting state, so-called short-circuit braking is applied to the feed motor 32, thereby causing the rotor 176 of the feed motor 32 to stop rotating much more quickly. It is noted that, hereinbelow, the situation in which UL1, VL1, WL1 of motor-control signals UH1, VH1, WH1, UL1, VL1, WL1 are all at the H potential (in this situation, three of the switching devices 222*b*, 224*b*, 226*b* will be in the conducting state) is also referred to as a short-circuit brake signal.

Likewise, the gate-driver circuit 210 controls the operation of the twisting motor 76 by switching each of the six switching devices 238*a*, 240*a*, 242*a*, 238*b*, 240*b*, 242*b* of the inverter circuit 214, in accordance with motor-control signals UH2, VH2, WH2, UL2, VL2, WL2, between the conducting state and the nonconducting state, in order to control the supply of energizing currents to the coils 182 of the twisting motor 76. It is noted that, when the rotor 188 of the twisting motor 76 is rotating and the gate-driver circuit 210 sets all the switching devices 238*a*, 240*a*, 242*a*, 238*b*, 240*b*, 242*b* to the nonconducting state, even though the supply of electric power to the twisting motor 76 is cut off, the rotor 188 of the twisting motor 76 will continue to rotate due to inertia for a period of time until the rotor 188 of the twisting motor 76 eventually stops. On the other hand, when the rotor 188 of the twisting motor 76 is rotating and the gate-driver circuit 210 sets three of the switching devices 238*a*, 240*a*, 242*a* to the nonconducting state while also setting the other three switching devices 238*b*, 240*b*, 242*b* to the conducting state, so-called short-circuit braking is applied to the twisting motor 76, thereby causing the rotor 188 of the twisting motor 76 to stop rotating much more quickly. It is noted that, hereinbelow, the situation in which UL2, VL2, WL2 of motor-control signals UH2, VH2, WH2, UL2, VL2, WL2 are all at the H potential (in this situation, three of the switching devices 238*b*, 240*b*, 242*b* will be in the conducting state) is also referred to as a short-circuit brake signal.

As shown in FIG. 20, the current-detection circuit 216 is disposed between the inverter circuit 212 and the inverter circuit 214 on one side and the negative-electrode-side, power-supply, electric potential of the battery B on the other side. The current-detection circuit 216 detects the magnitude of the electric current that flows through the inverter circuit 212 and the inverter circuit 214. The current-detection circuit 216 outputs, to the MCU 202, the value of the detected electric current.

The MCU 202 comprises a motor-control-signal output port 202*a*, a motor-rotation-signal input port 202*b*, and general-purpose I/O ports 202*c*. The motor-control-signal output port 202*a* is provided for outputting motor-control signals UH, VH, WH, UL, VL, WL to the brushless motors (i.e., the motor-control-signal output port 202*a* has six pins for respectively outputting the six motor-control signals UH, VH, WH, UL, VL, WL) and is capable of (is configured/adapted to perform) signal processing at a speed higher than that of the general-purpose I/O ports 202*c*. The motor-rotation-signal input port 202*b* is provided for inputting Hall-effect sensor signals Hu, Hv, Hw from a selected one of the brushless motors 32, 76 (i.e., the motor-rotation-signal input port 202*b* has three pins for respectively inputting the three motor-rotation signals Hu, Hv, Hw, as will be further discussed below) and is capable of (is configured/adapted to perform) signal processing at a speed higher than that of the general-purpose I/O ports 202*c*. The setting-display LED 22*a* and the setting switch 22*b* of the display board 22, the trigger switch 9, the initial-state detection sensor 136, the grip-detection sensor 138, and the current-detection circuit 216 are respectively connected to two or more of the general-purpose I/O ports 202*c* of the MCU 202. The manipulatable part (e.g., button) 12*c*, the setting switch 22*b* and the MCU 202 are preferably configured/adapted to enable the user to manually set (input) a desired tying strength for twisting together the ends of the wire W by depressing the manipulatable part (e.g., a button) 12*c*. The user-selected tying strength may be displayed by the setting-display LED 22*a*.

The motor-control-signal output port 202*a* (i.e. the six pins thereof) of the MCU 202 is electrically connected to the motor-control-signal-output-destination-switching circuit 204. The motor-control-signal-output-destination-switching circuit 204 switches the output destinations of the motor-control signals UH, VH, WH, UL, VL, WL, which are output from the motor-control-signal output port 202*a*, between the gate-driver circuit 208 and the gate-driver circuit 210 in accordance with switching signal SW output from one of the general-purpose I/O ports 202*c* of the MCU 202.

Figure 22:
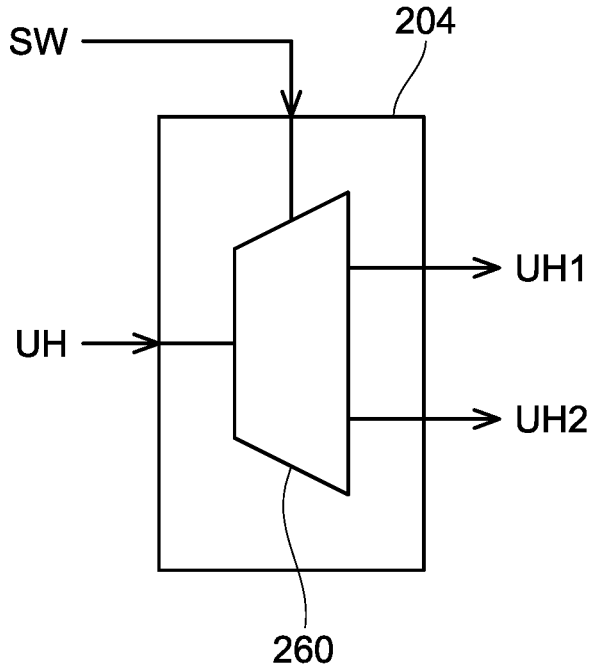
FIG. 22 is a diagram that shows an example of the circuit configuration of a motor-control-signal-output-destination-switching circuit 204 of the rebar tying tool 2 according to working example 1.

As shown in FIG. 22, the motor-control-signal-output-destination-switching circuit 204 may be configured such that it comprises a demultiplexer 260. When switching signal SW output from the MCU 202 is at the H potential, the demultiplexer 260 outputs motor-control signal UH, which had been output from the MCU 202, to the gate-driver circuit 208 as motor-control signal UM. On the other hand, when switching signal SW output from the MCU 202 is at the L potential, the demultiplexer 260 outputs motor-control signal UH, which had been output from the MCU 202, to the gate-driver circuit 210 as motor-control signal UH2. It is noted that, to facilitate understanding here, only structural elements corresponding to motor-control signal UH were explained, and otherwise the motor-control-signal-output-destination-switching circuit 204 comprises the same structural elements as those corresponding to other motor-control signals VH, WH, UL, VL, WL.

Figure 23:
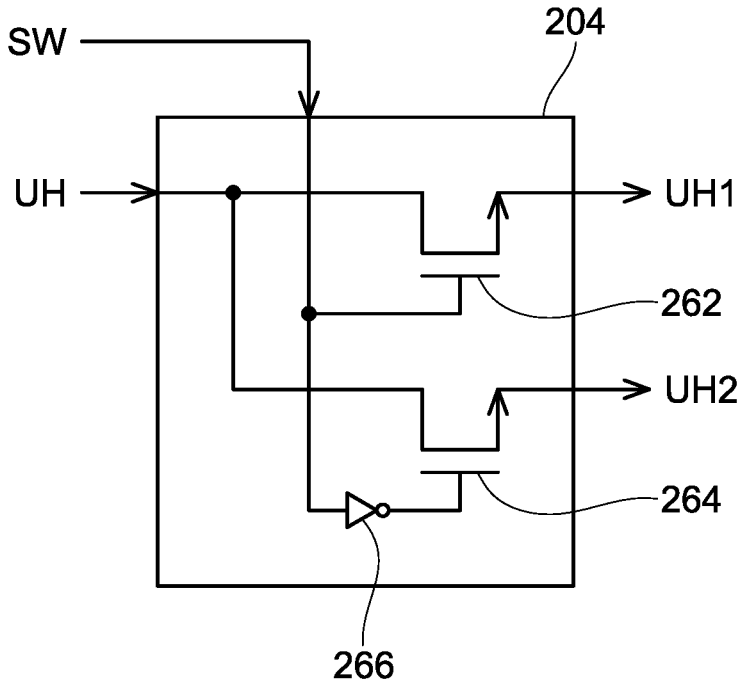
FIG. 23 is a diagram that shows another example of the circuit configuration of the motor-control-signal-output-destination-switching circuit 204 of the rebar tying tool 2 according to working example 1.

Alternatively, as shown in FIG. 23, the motor-control-signal-output-destination-switching circuit 204 may be configured such that it comprises FETs 262, 264 and a NOT gate (inverter) 266 instead of the demultiplexer 260. In such a modified embodiment, when switching signal SW output from the MCU 202 is at the H potential, the FET 262 turns ON and the FET 264 turns OFF. As a result thereof, the motor-control-signal-output-destination-switching circuit 204 outputs motor-control signal UH, which had been output from the MCU 202, to the gate-driver circuit 208 as motor-control signal UM. On the other hand, when switching signal SW output from the MCU 202 is at the L potential, the FET 262 turns OFF and the FET 264 turns ON. As a result thereof, the motor-control-signal-output-destination-switching circuit 204 outputs motor-control signal UH, which had been output from the MCU 202, to the gate-driver circuit 210 as motor-control signal UH2. It is noted that, to facilitate understanding here, only structural elements corresponding to motor-control signal UH were explained, and otherwise the motor-control-signal-output-destination-switching circuit 204 comprises the same structural elements as those corresponding to other motor-control signals VH, WH, UL, VL, WL.

Figure 24:
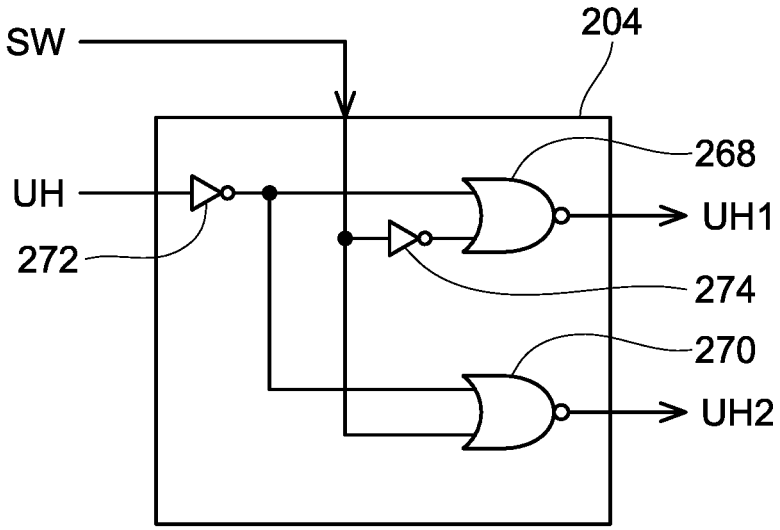
FIG. 24 is a diagram that shows yet another example of the circuit configuration of the motor-control-signal-output-destination-switching circuit 204 of the rebar tying tool 2 according to working example 1.

In the alternative to the preceding two embodiments, as shown in FIG. 24, the motor-control-signal-output-destination-switching circuit 204 may instead be configured such that it comprises NOR gates 268, 270 and NOT gates (inverters) 272, 274. In such a modified embodiment, when switching signal SW output from the MCU 202 is at the H potential, the NOR gate 268 outputs motor-control signal UH output from the MCU 202, and the NOR gate 270 outputs L potential. As a result thereof, the motor-control-signal-output-destination-switching circuit 204 outputs motor-control signal UH, which had been output from the MCU 202, to the gate-driver circuit 208 as motor-control signal UH1. On the other hand, when switching signal SW output from the MCU 202 is at the L potential, the NOR gate 268 outputs L potential, and the NOR gate 270 outputs motor-control signal UH, which is output from the MCU 202. As a result thereof, the motor-control-signal-output-destination-switching circuit 204 outputs motor-control signal UH, which had been output from the MCU 202, to the gate-driver circuit 210 as motor-control signal UH2. It is noted that, to facilitate understanding here, only structural elements corresponding to motor-control signal UH were explained, and otherwise the motor-control-signal-output-destination-switching circuit 204 comprises the same structural elements as those corresponding to other motor-control signals VH, WH, UL, VL, WL.

Figure 25:
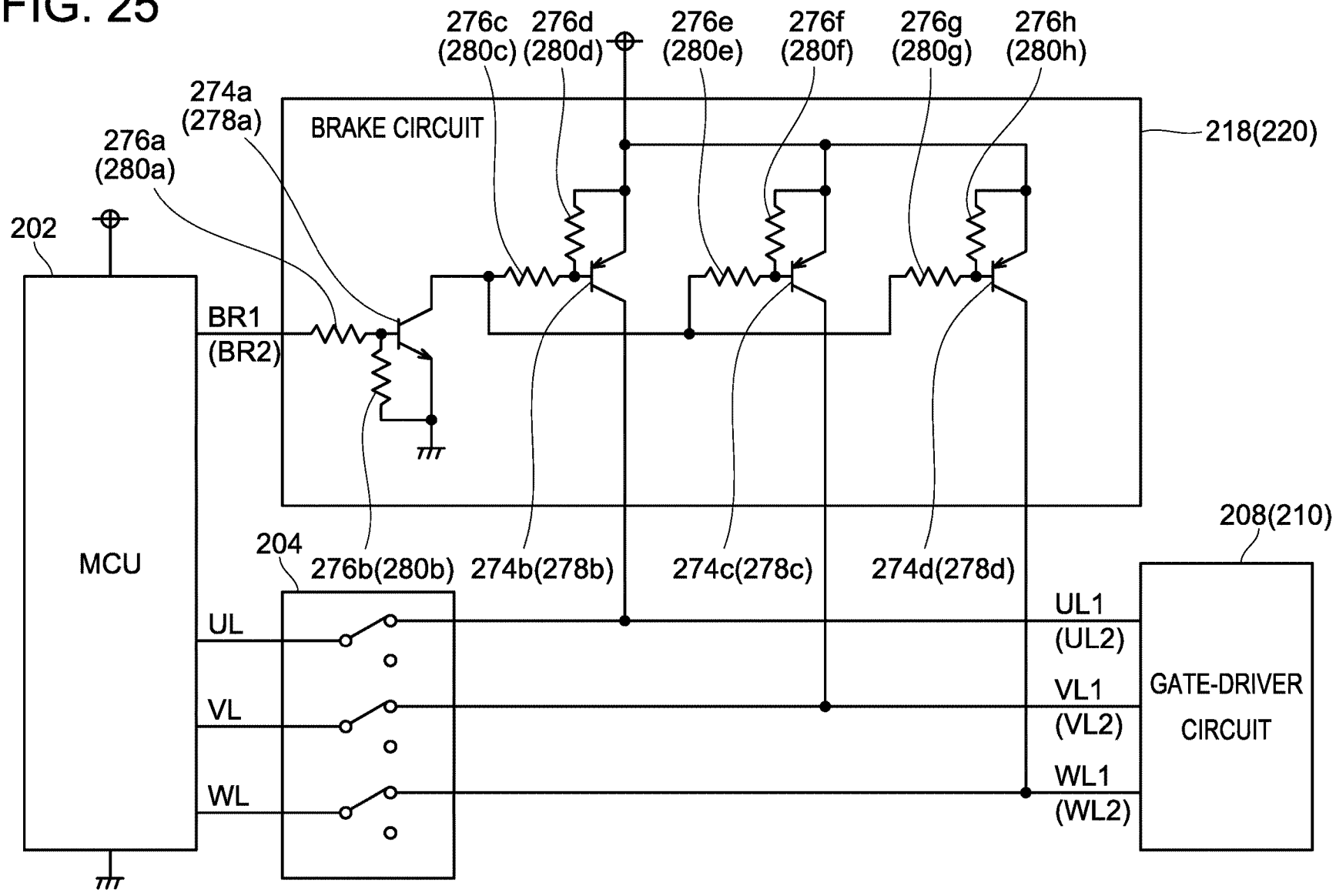
FIG. 25 is a diagram that shows an example of the circuit configuration of brake circuits 218, 220 of the rebar tying tool 2 according to working example 1.

As shown in FIG. 25, the brake circuit 218 is connected to signal lines of motor-control signals UL1, VL1, WL1 output from the motor-control-signal-output-destination-switching circuit 204 to the gate-driver circuit 208. The brake circuit 218 applies short-circuit braking to the feed motor 32 in response to the output of brake signal BR1 from one of the general-purpose I/O ports 202*c* of the MCU 202. The brake circuit 218 comprises transistors 274*a*, 274*b*, 274*c*, 274*d* and resistors 276*a*, 276*b*, 276*c*, 276*d*, 276*e*, 276*f*, 276*g*, 276*h*. When brake signal BR1 output from the MCU 202 at the L potential, the transistor 274*a* turns OFF, which causes all the transistors 274*b*, 274*c*, 274*d* to turn OFF. Therefore, motor-control signals UL1, VL1, WL1 output from the motor-control-signal-output-destination-switching circuit 204 are input, as is, to the gate-driver circuit 208. On the other hand, when brake signal BR1 output from the MCU 202 at the H potential, the transistor 274*a* turns ON, which causes all the transistors 274*b*, 274*c*, 274*d* to turn ON. Therefore, all the motor-control signals UL1, VL1, WL1 input to the gate-driver circuit 208 are at the H potential. In other words, a short-circuit brake signal is input to the gate-driver circuit 208, and thereby short-circuit braking is applied to the feed motor 32.

As shown in FIG. 25, the brake circuit 220 may be constructed in the same way as the brake circuit 218. That is, as shown in parentheses in FIG. 25, the brake circuit 220 is connected to signal lines of motor-control signals UL2, VL2, WL2 output from the motor-control-signal-output-destination-switching circuit 204 to the gate-driver circuit 210. The brake circuit 220 applies short-circuit braking to the twisting motor 76 in response to the output of brake signal BR2 from the above-mentioned one of the general-purpose I/O ports 202*c* of the MCU 202. The brake circuit 220 comprises the same structural elements as the brake circuit 218. That is, the brake circuit 220 comprises transistors 278*a*, 278*b*, 278*c*, 278*d* and resistors 280*a*, 280*b*, 280*c*, 280*d*, 280*e*, 280*f*, 280*g*, 280*h*. When brake signal BR2 output from the MCU 202 is at the L potential, the transistor 278*a* turns OFF, which causes all the transistors 278*b*, 278*c*, 278*d* to turn OFF. Therefore, motor-control signals UL2, VL2, WL2 output from the motor-control-signal-output-destination-switching circuit 204 are input, as is, to the gate-driver circuit 210. On the other hand, when brake signal BR2 output from the MCU 202 is at the H potential, the transistor 278*a* turns ON, which causes all the transistors 278*b*, 278*c*, 278*d* to turn ON. Therefore, all motor-control signals UL2, VL2, WL2 input from the gate-driver circuit 210 change to the H potential. In other words, a short-circuit brake signal is input to the gate-driver circuit 210, and thereby short-circuit braking is applied to the twisting motor 76.

As shown in FIG. 20, the Hall-effect sensor 180 of the feed motor 32 and the Hall-effect sensor 192 of the twisting motor 76 are both electrically connected to the motor-rotation-signal-input-source-switching circuit 206. The motor-rotation-signal-input-source-switching circuit 206 is connected to the motor-rotation-signal input port 202*b* (i.e., the three pins thereof) of the MCU 202. In response to the output of switching signal SW from the MCU 202, the motor-rotation-signal-input-source-switching circuit 206 selects either Hall-effect sensor signals Hu1, Hv1, Hw1 from the feed motor 32 or Hall-effect sensor signals Hu2, Hv2, Hw2 from the twisting motor 76 to be input to the motor-rotation-signal input port 202*b* of the MCU 202.

Figure 26:
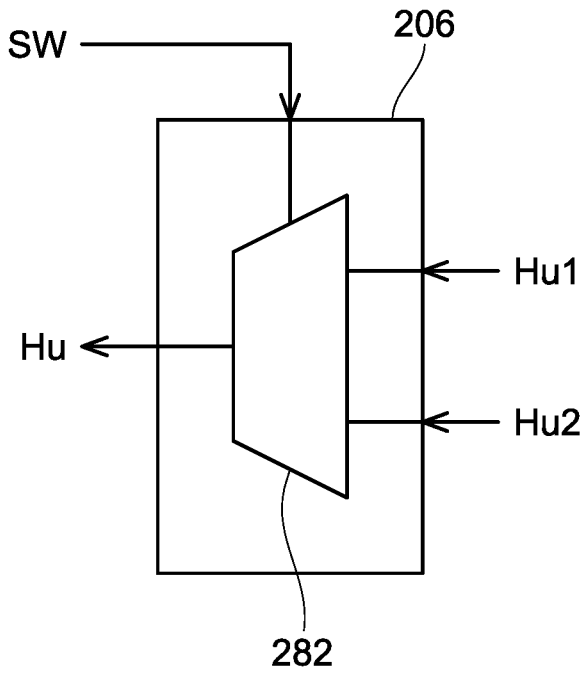
FIG. 26 is a diagram that shows an example of the circuit configuration of a motor-rotation-signal-input-source-switching circuit 206 of the rebar tying tool 2 according to working example 1.

As shown in FIG. 26, the motor-rotation-signal-input-source-switching circuit 206 may be configured such that it comprises a multiplexer 282. When switching signal SW output from the MCU 202 is at the H potential, the multiplexer 282 outputs Hall-effect sensor signal Hu1 from the feed motor 32 to the MCU 202 as Hall-effect sensor signal Hu. On the other hand, when switching signal SW output from the MCU 202 is at the L potential, the multiplexer 282 outputs Hall-effect sensor signal Hu2 from the twisting motor 76 to the MCU 202 as Hall-effect sensor signal Hu. It is noted that, to facilitate understanding here, only those structural elements corresponding to Hall-effect sensor signal Hu were explained, and otherwise the motor-rotation-signal-input-source-switching circuit 206 comprises the same structural elements as those corresponding to the other Hall-effect sensor signals Hv, Hw.

Figure 27:
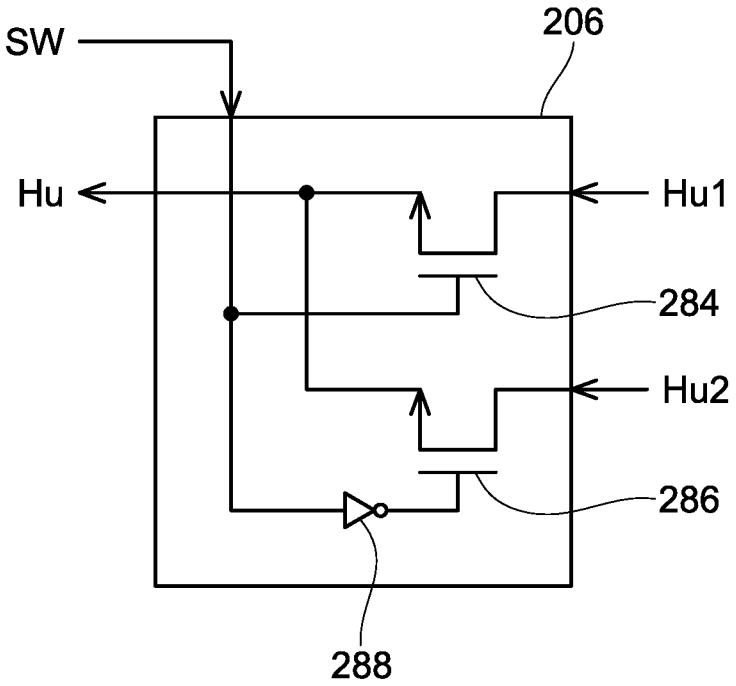
FIG. 27 is a diagram that shows another example of the circuit configuration of the motor-rotation-signal-input-source-switching circuit 206 of the rebar tying tool 2 according to working example 1.

Alternatively, as shown in FIG. 27, the motor-rotation-signal-input-source-switching circuit 206 may be configured such that it comprises FETs 284, 286 and a NOT gate (inverter) 288 instead of the multiplexer 282. In such a modified embodiment, when switching signal SW output from MCU 202 is at the H potential, the FET 284 turns ON, and the FET 286 turns OFF. As a result thereof, the motor-rotation-signal-input-source-switching circuit 206 outputs Hall-effect sensor signal Hu1 from the feed motor 32 to the MCU 202 as Hall-effect sensor signal Hu. On the other hand, when switching signal SW output from the MCU 202 is at the L potential, the FET 284 turns OFF, and the FET 286 turns ON. As a result thereof, the motor-rotation-signal-input-source-switching circuit 206 outputs Hall-effect sensor signal Hu2 from the twisting motor 76 to the MCU 202 as Hall-effect sensor signal Hu. It is noted that, to facilitate understanding here, only those structural elements corresponding to Hall-effect sensor signal Hu were explained, and otherwise the motor-rotation-signal-input-source-switching circuit 206 comprises the same structural elements as those corresponding to the other Hall-effect sensor signals Hv, Hw.

Figure 28:
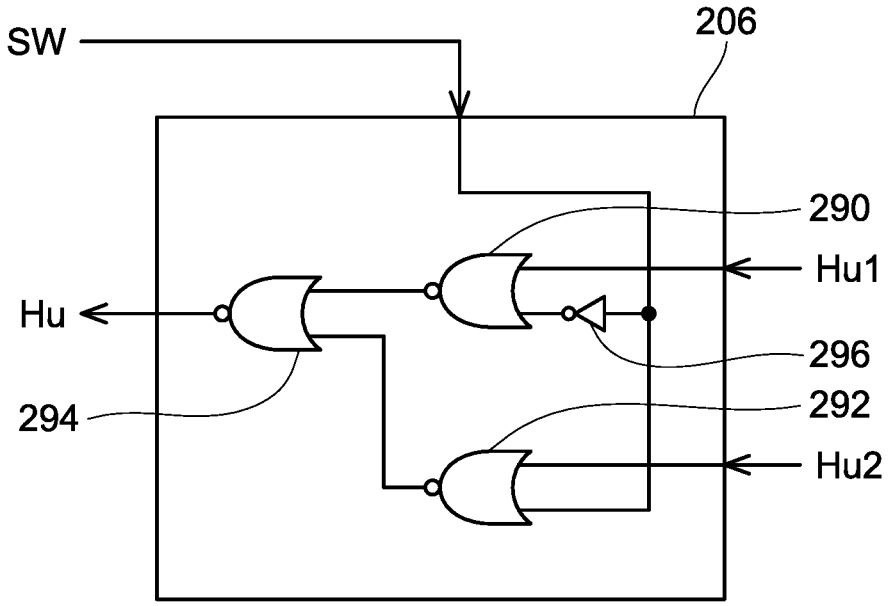
FIG. 28 is a diagram that shows yet another example of the circuit configuration of the motor-rotation-signal-input-source-switching circuit 206 of the rebar tying tool 2 according to working example 1.

In another modified embodiment, as shown in FIG. 28, the motor-rotation-signal-input-source-switching circuit 206 may instead be configured such that it comprises NOR gates 290, 292, 294 and a NOT gate (inverter) 296. In such a modified embodiment, when switching signal SW output from the MCU 202 is at the H potential, the NOR gate 290 inverts Hall-effect sensor signal Hu1 from the feed motor 32 and outputs the inverted signal. Therefore, the NOR gate 292 outputs the L potential, and the NOR gate 294 outputs Hall-effect sensor signal Hu1 from the feed motor 32. Thus, the motor-rotation-signal-input-source-switching circuit 206 outputs Hall-effect sensor signal Hu1 from the feed motor 32 to the MCU 202 as Hall-effect sensor signal Hu. On the other hand, when switching signal SW output from the MCU 202 is at the L potential, the NOR gate 290 outputs the L potential, the NOR gate 292 inverts Hall-effect sensor signal Hu2 from the twisting motor 76 and outputs the inverted signal. Therefore the NOR gate 294 outputs Hall-effect sensor signal Hu2 from the twisting motor 76. Consequently, the motor-rotation-signal-input-source-switching circuit 206 outputs Hall-effect sensor signal Hu2 from the twisting motor 76 to the MCU 202 as Hall-effect sensor signal Hu. It is noted that, to facilitate understanding here, only those structural elements corresponding to Hall-effect sensor signal Hu were explained, and otherwise the motor-rotation-signal-input-source-switching circuit 206 comprises the same structural elements as those corresponding to the other Hall-effect sensor signals Hv, Hw.

It is noted that, as shown in FIG. 20, the Hall-effect sensor 180 of the feed motor 32 and the Hall-effect sensor 192 of the twisting motor 76 are also both electrically connected to one of the general-purpose I/O ports 202*c* of the MCU 202. This circuit configuration enables the MCU 202 to monitor Hall-effect sensor signals Hu1, Hv1, Hw1 from the feed motor 32 and Hall-effect sensor signals Hu2, Hv2, Hw2 from the twisting motor 76, which are input to that general-purpose I/O port 202*c*, to check for abnormalities in operation, as will be further explained below.

Lead-Angle Control of Feed Motor 32 and Twisting Motor 76

When the MCU 202 is controlling the operation of the feed motor 32 and the twisting motor 76, the MCU 202 outputs motor-control signals UH, VH, WH, UL, VL, WL from the motor-control-signal output port 202*a* based (dependent) on Hall-effect sensor signals Hu, Hv, Hw input to the motor-rotation-signal input port 202*b*. Lead-angle control performed by the MCU 202 when controlling the operation of the feed motor 32 and the twisting motor 76 will be explained below.

Figure 29:
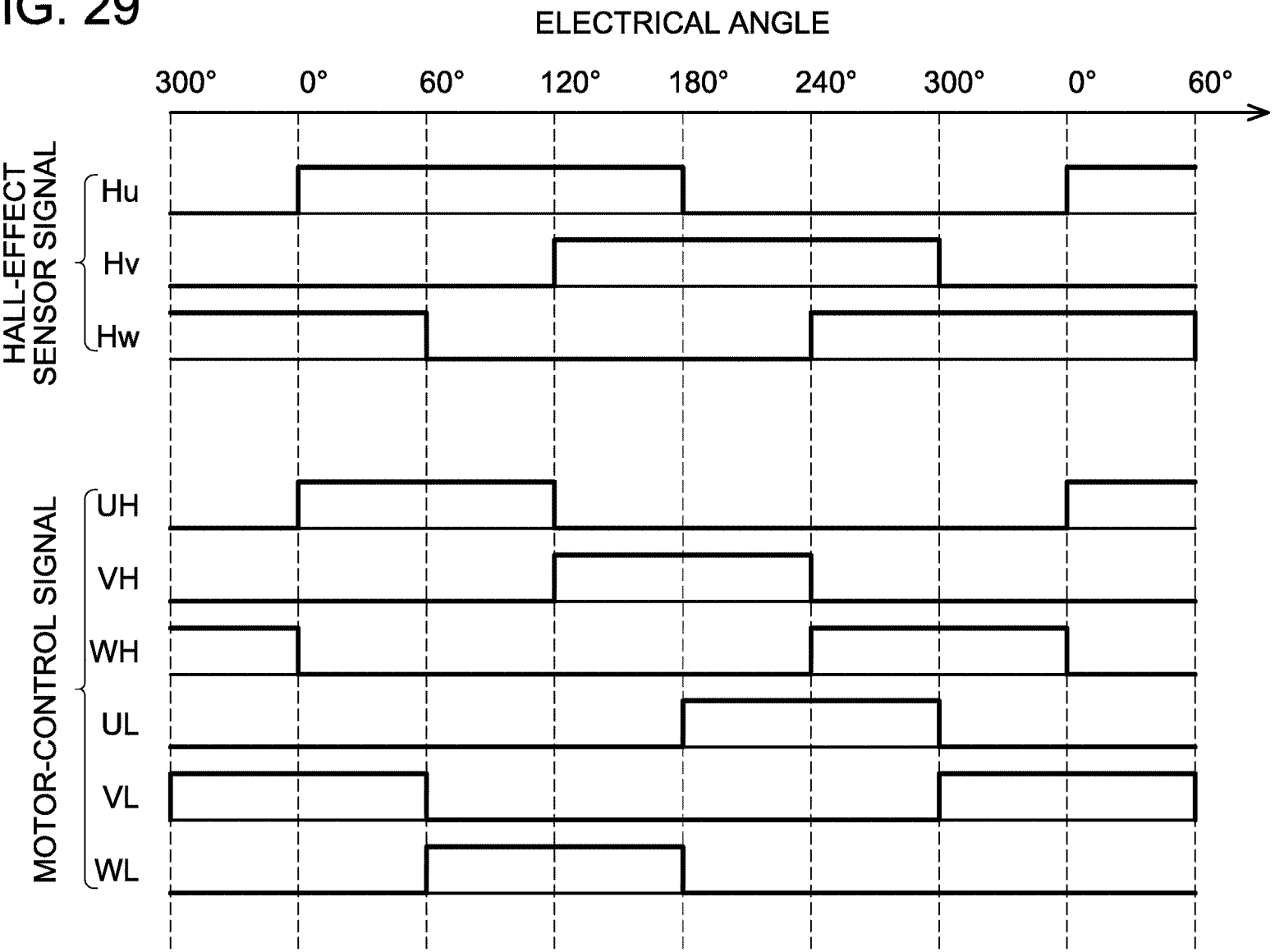
FIG. 29 is a timing chart of Hall-effect sensor signals Hu, Hv, Hw and motor-control signals UH, VH, WH, UL, VL, WL when the feed motor 32 and the twisting motor 76 of the rebar tying tool 2 according to a reference example are rotating forward.
Figure 30:
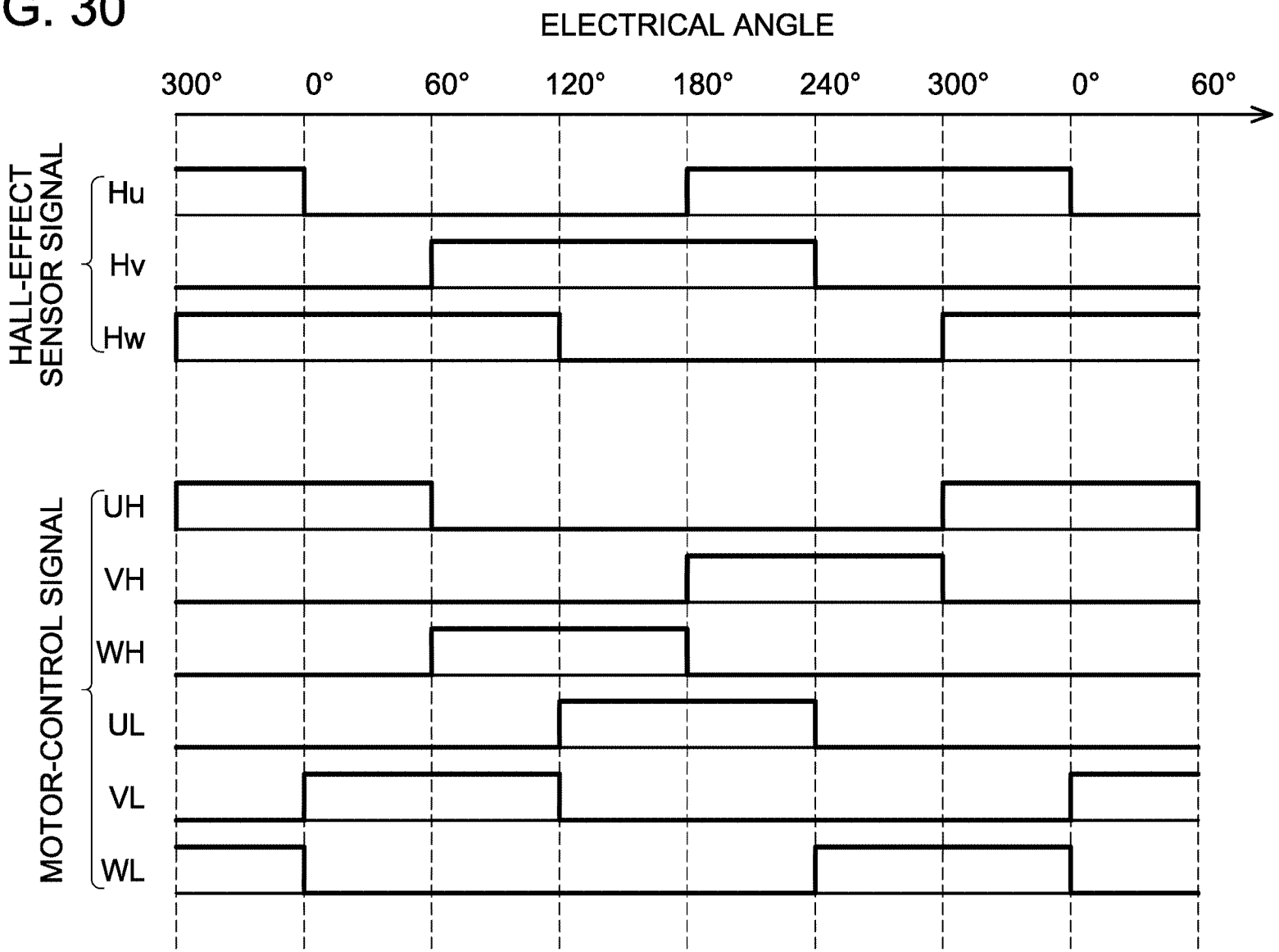
FIG. 30 is a timing chart of Hall-effect sensor signals Hu, Hv, Hw and motor-control signals UH, VH, WH, UL, VL, WL when the feed motor 32 and the twisting motor 76 of the rebar tying tool 2 according to the reference example are rotating in reverse.

FIG. 29 shows, as a reference example, a timing chart of Hall-effect sensor signals Hu, Hv, Hw and motor-control signals UH, VH, WH, UL, VL, WL while a rotor of a brushless motor is rotating in its forward rotational direction and lead-angle control is not being performed. FIG. 30 shows, as a reference example, a timing chart of Hall-effect sensor signals Hu, Hv, Hw and motor-control signals UH, VH, WH, UL, VL, WL while a rotor the brushless motor is rotating in its reverse rotational direction and lead-angle control is not being performed.

Figure 31:
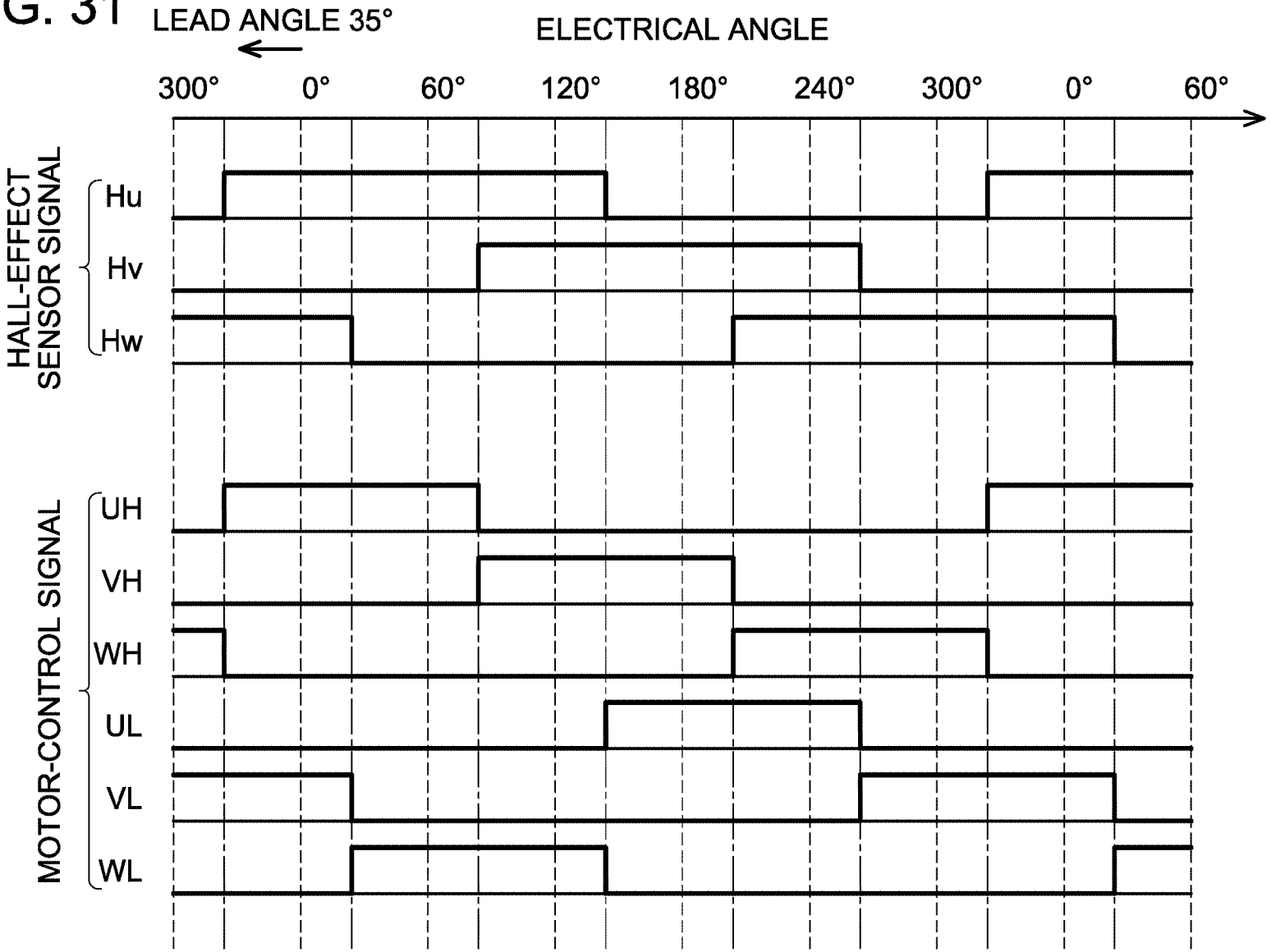
FIG. 31 is a timing chart of Hall-effect sensor signals Hu, Hv, Hw and motor-control signals UH, VH, WH, UL, VL, WL when the feed motor 32 and the twisting motor 76 of the rebar tying tool 2 according to working example 1 are rotating forward.

FIG. 31 shows a timing chart of Hall-effect sensor signals Hu, Hv, Hw and motor-control signals UH, VH, WH, UL, VL, WL while the rotor of one of the brushless motors according to the rebar tying tool 2 of the present working example is rotating in its forward rotational direction. In the rebar tying tool 2 of the present working example, while the rotor 176 of the feed motor 32 or the rotor 188 of the twisting motor 76 is rotating in its forward rotational direction, the respective Hall-effect sensors 180, 192 output Hall-effect sensor signals Hu1, Hv1, Hw1, Hu2, Hv2, Hw2 in the state in which their electrical angles lead by 25°, and the MCU 202 outputs motor-control signals UH, VH, WH, UL, VL, WL based on (in accordance with) Hall-effect sensor signals Hu, Hv, Hw in the state in which their electrical angles lead by 25°. Consequently, while the rotor 176 of the feed motor 32 or the rotor 188 of the twisting motor 76 rotates forward, 25°-lead-angle control is performed.

Figure 32:
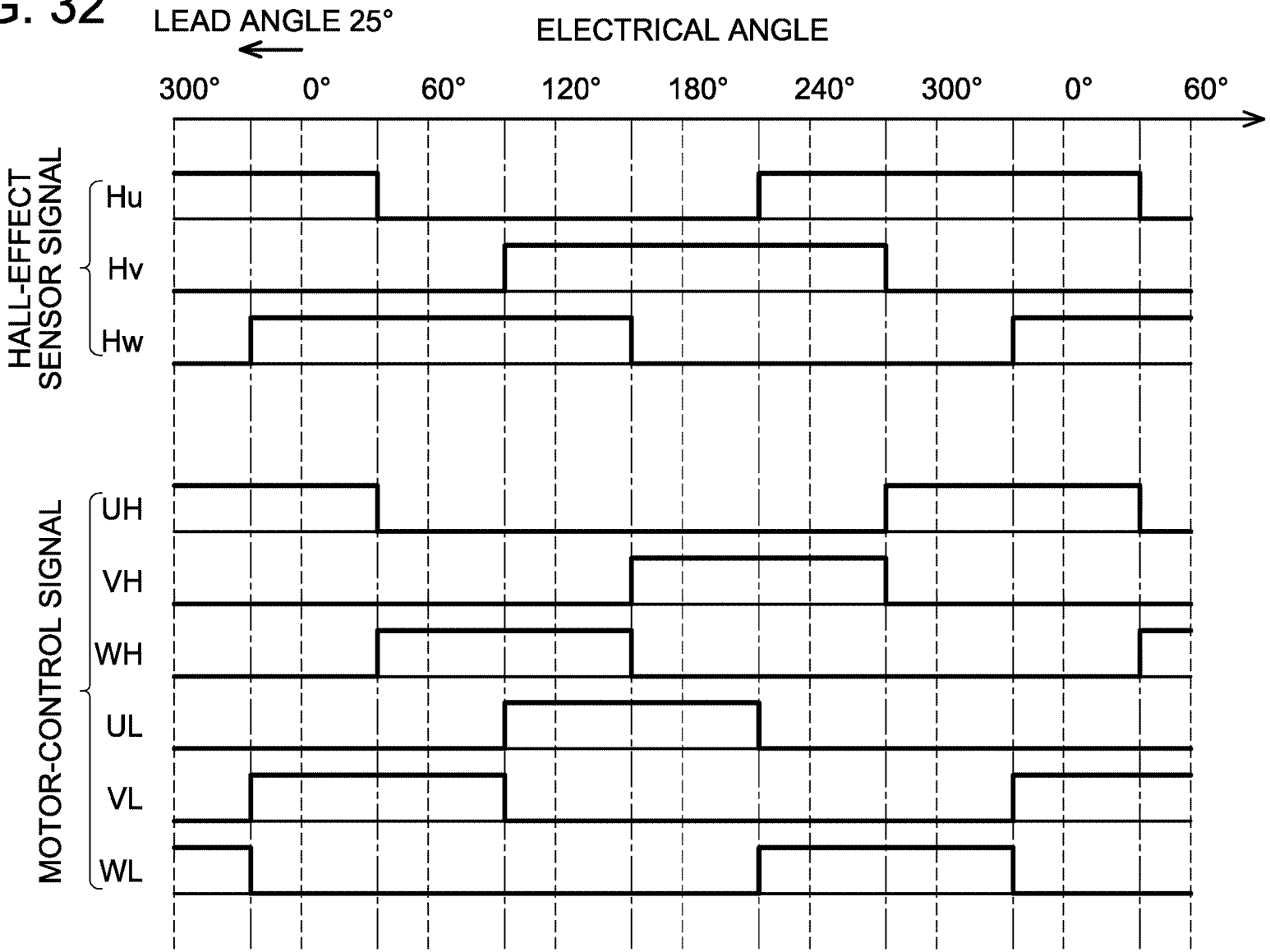
FIG. 32 is a timing chart of Hall-effect sensor signals Hu, Hv, Hw and motor-control signals UH, VH, WH, UL, VL, WL when the feed motor 32 and the twisting motor 76 of the rebar tying tool 2 according to working example 1 are rotating in reverse.

FIG. 32 shows a timing chart of Hall-effect sensor signals Hu, Hv, Hw and motor-control signals UH, VH, WH, UL, VL, WL while the rotor of one of the brushless motors according to the rebar tying tool 2 of the present working example is rotating in its reverse rotational direction. In the rebar tying tool 2 of the present working example, while the rotor 176 of the feed motor 32 or the rotor 188 of the twisting motor 76 is rotating in its reverse rotational direction, the respective Hall-effect sensors 180, 192 output Hall-effect sensor signals Hu1, Hv1, Hw1, Hu2, Hv2, Hw2 in the state in which their electrical angles lag by 25°, but the MCU 202 outputs an output pattern (sequence) of motor-control signals UH, VH, WH, UL, VL, WL that leads by one step (corresponding to an electrical angle of) 60°. Consequently, the MCU 202 outputs motor-control signals UH, VH, WH, UL, VL, WL with a lead angle of 60°−25°=35°. That is, 35°-lead-angle control is performed for reverse rotation of the rotor 176 of the feed motor 32 and the rotor 188 of the twisting motor 76.

As mentioned above, in the rebar tying tool 2 of the present working example, the lead angle (e.g., 35°) when the rotor 176 of the feed motor 32 or the rotor 188 of the twisting motor 76 is rotating in its reverse rotational direction is set to be larger than the lead angle (e.g., 25°) that is set when the rotor 176 of the feed motor 32 or the rotor 188 of the twisting motor 76 is rotating in its forward rotational direction. The advantages of this configuration are explained below.

Figure 33:
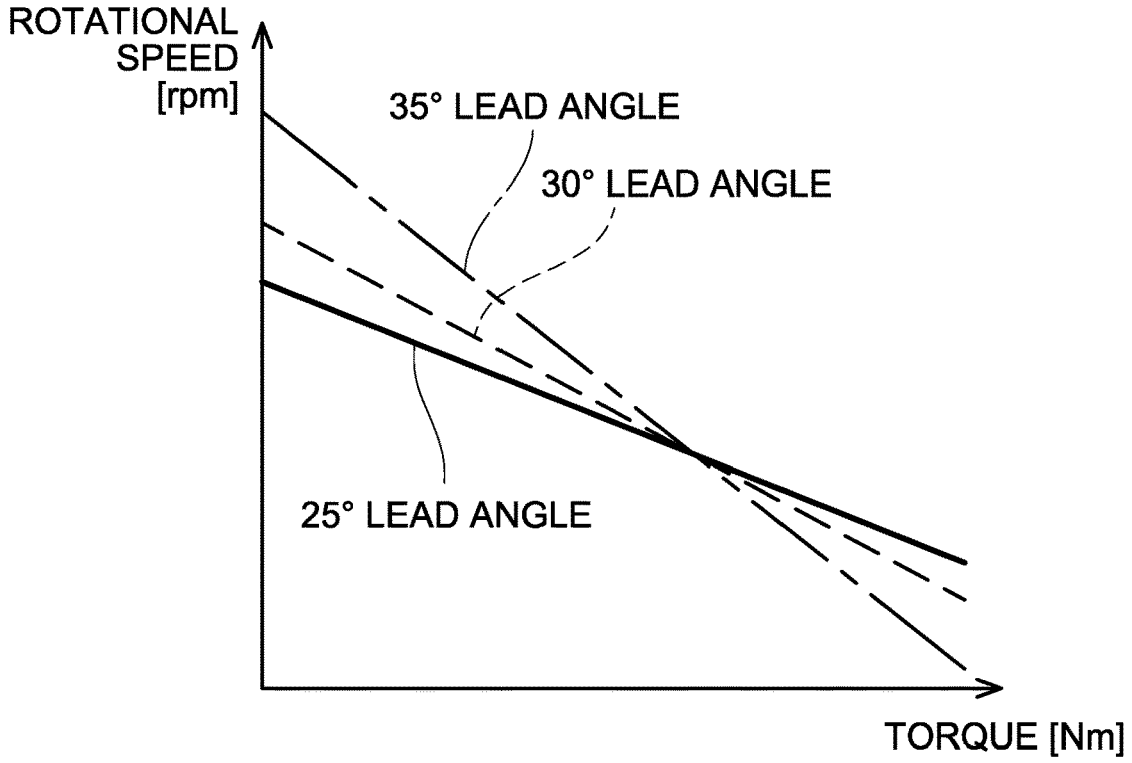
FIG. 33 is a graph that shows the relationship between torque and rotational speed for differing lead angles during lead-angle control in a typical brushless motor.

FIG. 33 shows the relationship between torque and rotational speed of a typical brushless motor for three different lead angles (25°, 30°, 35°) during lead-angle control. As shown in FIG. 33, the larger the torque, the lower the rotational speed. In addition, as shown in FIG. 33, in the range where the torque is relatively small, the larger the lead angle during lead-angle control, the higher the rotational speed. On the other hand, in the range where the torque is relatively large, the larger the lead angle during lead-angle control, the lower the rotational speed.

Figure 34:
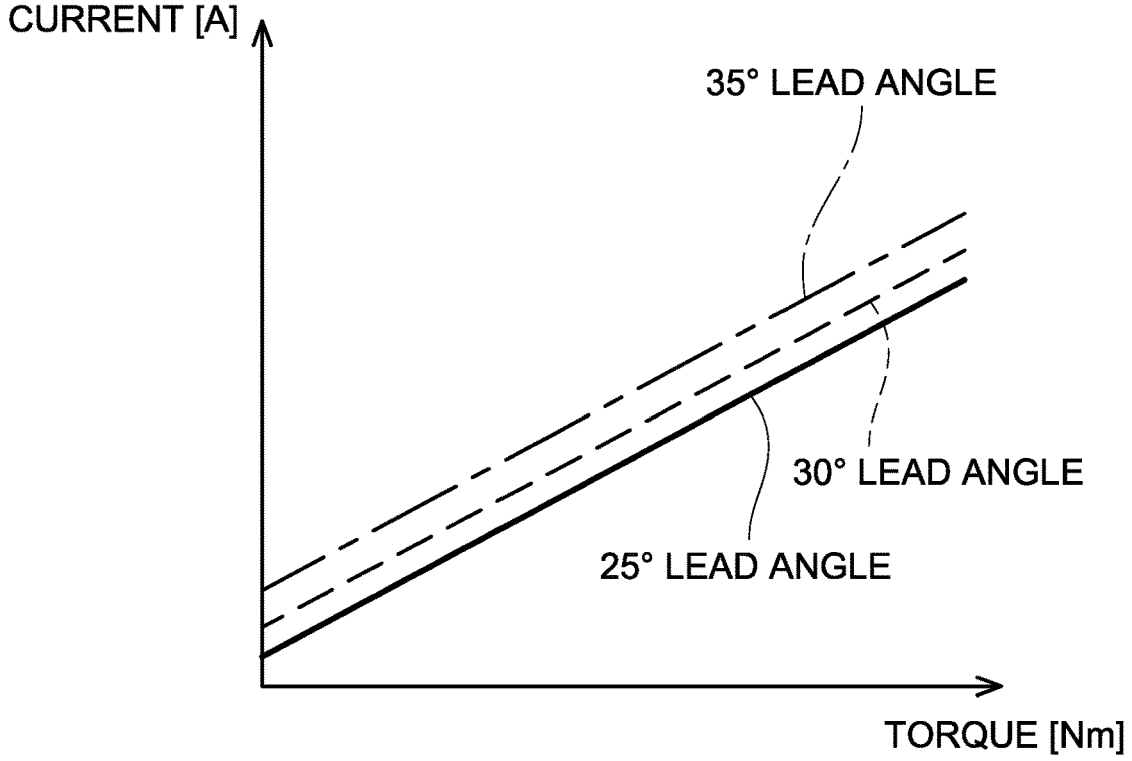
FIG. 34 is a graph that shows the relationship between torque and electric current for differing lead angles during lead-angle control in a typical brushless motor.

FIG. 34 shows the relationship between the torque and the electric current of a typical brushless motor for the same three lead angles (25°, 30°, 35°) during lead-angle control. As shown in FIG. 34, torque increases as the electric current increases for all three lead angles shown in FIG. 34. However, as shown in FIG. 34, the larger the lead angle during lead-angle control, the larger the electric current that is required to achieve any particular motor output torque.

In the rebar tying tool 2 of the present working example, when the rotor 176 of the feed motor 32 is caused to rotate in its reverse rotational direction (i.e., while the wire W is being advanced to be looped around two or more rebars R), the torque that acts on the feed motor 32 is not very large. That is, at this time, the feed motor 32 is operating in the range of the speed-torque relationships shown in FIG. 33 that is leftward of the intersection of the three lines. Therefore, by setting the lead angle during lead-angle control for the wire advancing operation to be larger (i.e., by increasing the lead angle at this time), the rotational speed can be increased (as compared to using a smaller lead angle at this time, as shown in FIG. 33), and thereby the time required to perform the wire advancing process can be shortened owing to the faster rotational speed. It is noted that, by setting the lead angle during lead-angle control is set to be larger at this time, the electric current also becomes larger to achieve the required output torque, in view of the current-torque relationships shown in FIG. 34. However, because the electric current of the feed motor 32 in the wire advancing process is relatively small from the start, the generation of extra heat by the feed motor 32 and the inverter circuit 212 does not present a problem.

Conversely, when the feed motor 32 is caused to rotate in its forward rotational direction (i.e., while the wire W is being drawn back to cinch the looped wire W around the rebars R), a large torque acts on the feed motor 32. That is, at this time, the feed motor 32 is operating in the range of the speed-torque relationships shown in FIG. 33 that is rightward of the intersection of the three lines. Therefore, by setting the lead angle during lead-angle control for the wire draw-back process to be smaller, the rotational speed can be increased (as compared to using a larger lead angle at this time, as shown in FIG. 33), and thereby the time required by the wire draw-back process can be shortened. In addition, by setting the lead angle during lead-angle control to be smaller at this time, the electric current that flows to the feed motor 32 can be made smaller (decreased as compared to using a larger lead angle), and thereby generation of heat by the feed motor 32 and the inverter circuit 212 can be reduced as compared to using a larger lead angle in the wire draw-back operation.

In the present working example, with regard to the feed motor 32, the lead angle during lead-angle control when the rotor 176 is rotating in the forward rotational direction is set, e.g., to 25°, and the lead angle during lead-angle control when the rotor 176 is rotating in the reverse rotational direction is set, e.g., to 35°. Thereby, it is possible to achieve a shortening of the time required by the wire advancing process while also achieving a shortening of the time required by the wire draw-back process as well as a reduction in the electric current in the wire-draw back process. It is noted that the lead angles during lead-angle control when the rotor 176 is rotating forward and when the rotor 176 is rotating in reverse are not limited to the above-mentioned numerical values; for example, the lead angle during lead-angle control when the rotor 176 is rotating in its forward rotational direction may be set to 20°, and the lead angle during lead-angle control when the rotor 176 is rotating in its reverse rotational direction may be set to 40°. More generally speaking, the lead angle during lead-angle control when the rotor 176 is rotating in its forward rotational direction may be selected, e.g., from the range of 18-30°, and the lead angle during lead-angle control when the rotor 176 is rotating in its reverse rotational direction may be selected, e.g., from the range of 31-43°. In any event, the lead angle when the rotor 176 is rotating in its forward rotational direction is preferably greater than the lead angle when the rotor 176 is rotating in its reverse rotational direction, e.g., preferably greater by 5° or more.

In the rebar tying tool 2 of the present working example, when the rotor 188 of the twisting motor 76 is caused to rotate in its forward rotational direction (i.e., while the ends of the wire W are being twisted together), a large torque acts on the twisting motor 76. That is, at this time, the twisting motor 76 is operating in the range of the speed-torque relationships shown in FIG. 33 that is rightward of the intersection of the three lines. Therefore, by setting the lead angle during lead-angle control for the twisting operation to be smaller, the rotational speed can be increased (as compared to using a larger lead angle at this time, as shown in FIG. 33), and thereby the time required by the twisting process can be shortened. In addition, by setting the lead angle during lead-angle control to be smaller at this time, the electric current that flows to the twisting motor 76 can be made smaller (decreased as compared to using a larger lead angle) while still achieving the desired motor output torque, and thereby the generation of heat by the twisting motor 76 and the inverter circuit 214 can be reduced as compared to using a larger lead angle during the twisting process.

Conversely, when the twisting motor 76 is caused to rotate in its reverse rotational direction (i.e., when the twisting mechanism 30 is caused to return to the initial state), the torque that acts on the twisting motor 76 is not very large. That is, at this time, the twisting motor 76 is operating in the range of the speed-torque relationships shown in FIG. 33 that is leftward of the intersection of the three lines. Therefore, by setting the lead angle during lead-angle control for the initial-state return operation to be larger (i.e. by increasing the lead angle at this time), the rotational speed can be increased (as compared to using a smaller lead angle at this time, as shown in FIG. 33), and thereby the time required by the initial-state returning process can be shortened. It is noted that, by setting the lead angle during lead-angle control is set to be larger at this time, the electric current becomes larger. However, because the electric current of the twisting motor 76 in the initial-state returning process is relatively small from the start, the generation of extra heat by the twisting motor 76 and the inverter circuit 214 does not present a problem.

In the present working example, with regard to the twisting motor 76, the lead angle during lead-angle control when the rotor 188 is rotating in the forward rotational direction is set, e.g., to 25°, and the lead angle during lead-angle control when the rotor 188 is rotating in its reverse rotational direction is set to 35°. Thereby, it is possible to achieve a shortening of the time required by the initial-state returning process while achieving a shortening of the time required by the twisting process and a reduction in the electric current during the twisting process while still achieving the desired motor output torque. It is noted that the lead angles during lead-angle control when the rotor 188 is rotating in its forward rotational direction and when the rotor 188 is rotating in its reverse rotational direction are not limited to the above-mentioned numerical values; for example, the lead angle when the rotor 188 is rotating in its forward rotational direction may be set to 20°, and the lead angle when the rotor 188 is rotating in its reverse rotational direction may be set to 40°. More generally speaking, the lead angle during lead-angle control when the rotor 188 is rotating in its reverse rotational direction may be selected, e.g., from the range of 18-30°, and the lead angle during lead-angle control when the rotor 188 is rotating in its forward rotational direction may be selected, e.g., from the range of 31-43°. In any event, the lead angle when the rotor 188 is rotating in its reverse rotational direction is preferably greater than the lead angle when the rotor 188 is rotating in its forward rotational direction, e.g., preferably greater by 5° or more.

It is noted that, in the above-explained working example, the Hall-effect sensors 180, 192 are respectively disposed on the sensor boards 178, 190 such that, while the rotor 176 of the feed motor 32 or the rotor 188 of the twisting motor 76 is rotating in its forward rotational direction, the respective Hall-effect sensors 180, 192 output Hall-effect sensor signals Hu1, Hv1, Hw1, Hu2, Hv2, Hw2 in the state in which their electrical angles lead by 25°, and such that, when the rotor 176 of the feed motor 32 or the rotor 188 of the twisting motor 76 is rotating in in its reverse rotational direction, the respective Hall-effect sensors 180, 192 output Hall-effect sensor signals Hu1, Hv1, Hw1, Hu2, Hv2, Hw2 in the state in which their electrical angles lag by 25°.

However, it is also possible to modify the above-explained working example by respectively disposing the Hall-effect sensors 180, 192 on the sensor boards 178, 190 such that Hall-effect sensor signals Hu1, Hv1, Hw1, Hu2, Hv2, Hw2 from the Hall-effect sensors 180, 192 do not have lead angles and lag angles for forward rotation and reverse rotation of the rotor 176 of the feed motor 32 and the rotor 188 of the twisting motor 76. In such a modified embodiment, motor-control signals UH, VH, WH, UL, VL, WL may be output, by performing a lead-angle calculating process in the MCU 202, at desired lead angles relative to Hall-effect sensor signals Hu, Hv, Hw.

More specifically, in such a modified embodiment, the MCU 202 measures the time required for the electrical angle to advance by 60° relative to Hall-effect sensor signals Hu, Hv, Hw. Then, the MCU 202 calculates, using the measured time, the time corresponding to an electrical angle of 25° and the time corresponding to an electrical angle of 35°. Finally, based on this calculated time, the MCU 202 changes the timing at which motor-control signals UH, VH, WH, UL, VL, WL are output during forward rotation and during reverse rotation to set the appropriate lead angle.

Figure 35:
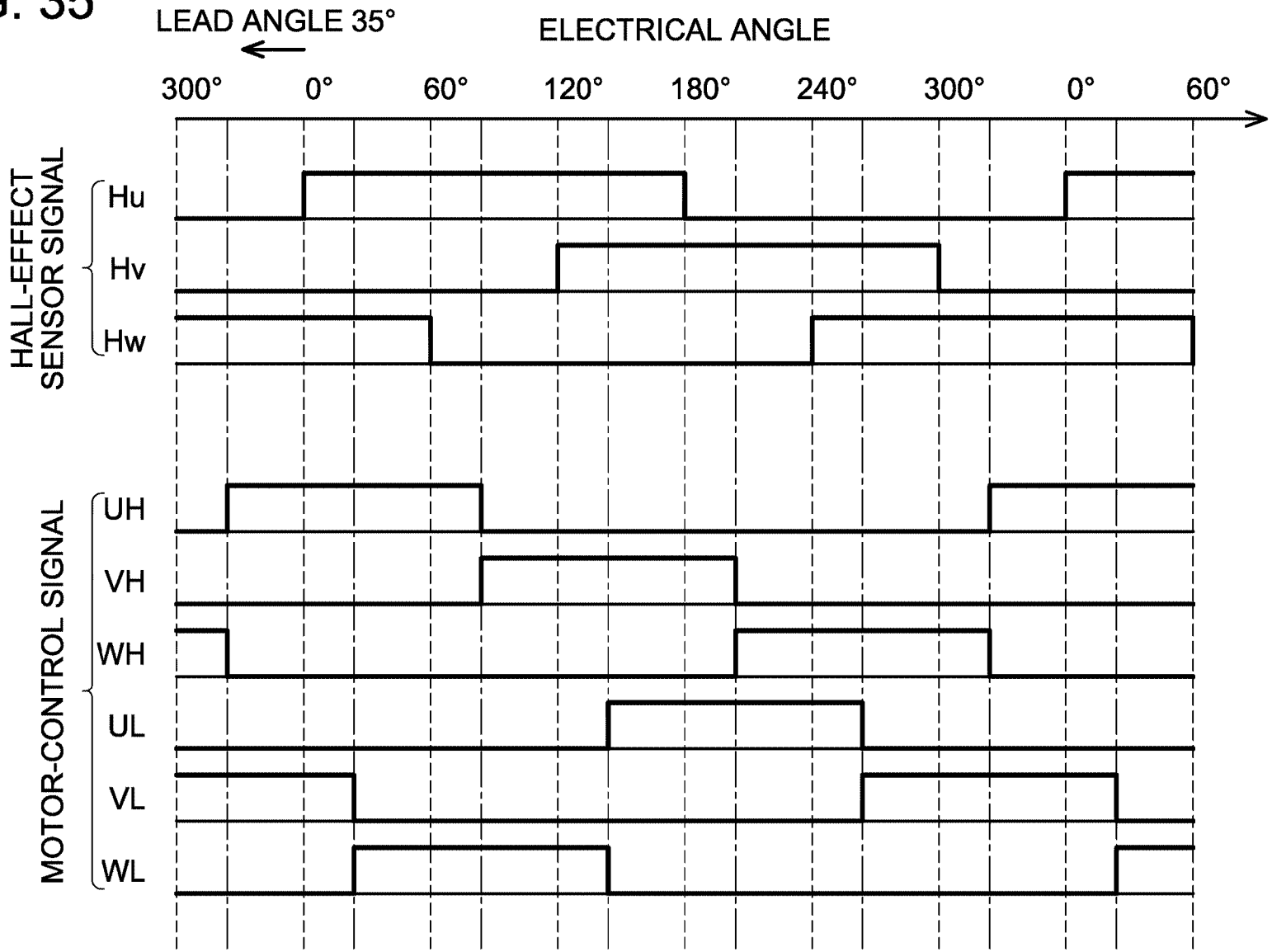
FIG. 35 is a timing chart of Hall-effect sensor signals Hu, Hv, Hw and motor-control signals UH, VH, WH, UL, VL, WL when the feed motor 32 and the twisting motor 76 of the rebar tying tool 2 according to a modified example are rotating forward.
Figure 36:
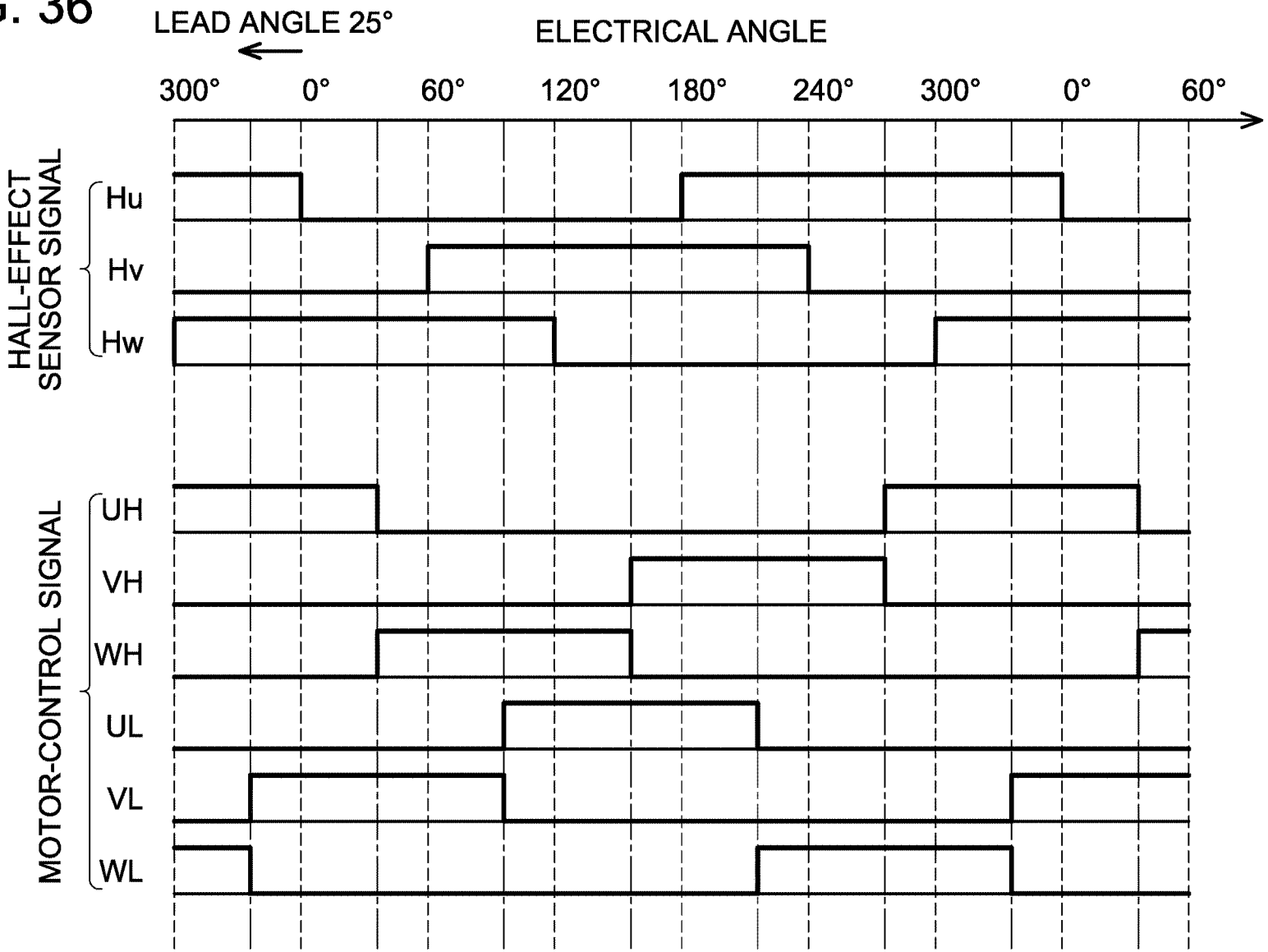
FIG. 36 is a timing chart of Hall-effect sensor signals Hu, Hv, Hw and motor-control signals UH, VH, WH, UL, VL, WL when the feed motor 32 and the twisting motor 76 of the rebar tying tool 2 according to the modified example are rotating in reverse.

FIG. 35 shows a timing chart of Hall-effect sensor signals Hu, Hv, Hw and motor-control signals UH, VH, WH, UL, VL, WL using such a modified technique while 25°-lead-angle control is performed and the rotor of the brushless motor is rotating in its forward rotational direction. FIG. 36 shows a timing chart of Hall-effect sensor signals Hu, Hv, Hw and motor-control signals UH, VH, WH, UL, VL, WL using such a modified technique while 35°-lead-angle control is performed and the rotor of the brushless motor is rotating in its reverse rotational direction. It is noted that, when such a technique is used, every time the rotational speed of the feed motor 32 or the twisting motor 76 changes, it is necessary to recalculate the time corresponding to an electrical angle of 25° and the time corresponding to an electrical angle of 35°. On the other hand, in (unmodified) working example 1 described above, because the Hall-effect sensors 180, 192 are provided at appropriate locations on the sensor boards 178, 190, the lead angle can still be controlled (set) to a desired lead angle for forward rotation and for reverse rotation, without performing a special process in the MCU 202, even if the rotational speed of the feed motor 32 or the twisting motor 76 changes in the configuration in which the lead angles during lead-angle control for forward rotation and for reverse rotation are set.

Processes Performed (Algorithms Executed) by MCU 202

Figure 37:
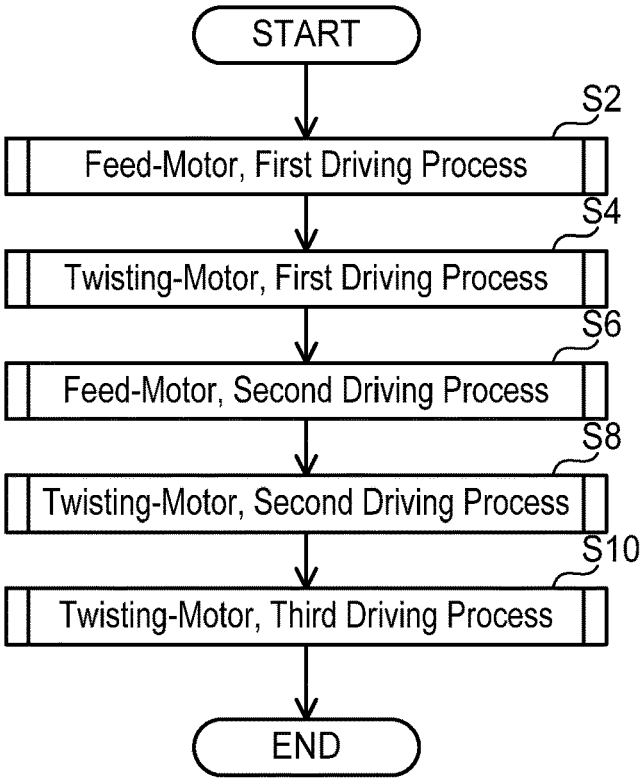
FIG. 37 is a flow chart of a process performed by an MCU 202 of the rebar tying tool 2 according to working example 1.

When the trigger switch 9 switches from OFF to ON, the MCU 202 performs (executes) the process (algorithm) shown in FIG. 37. In the process shown in FIG. 37, the MCU 202 performs, in order, a feed-motor, first driving process, i.e., a first driving process (control) for the feed motor 32 (refer to FIG. 38) in S2, a twisting-motor, first driving process, i.e., a first driving process (control) for the twisting motor 76 (refer to FIG. 39) in S4, a feed-motor, second driving process, i.e., a second driving process (control) for the feed motor 32 (refer to FIG. 40) in S6, a twisting-motor, second driving process, i.e., a second driving process (control) for the twisting motor 76 (refer to FIG. 41) in S8, and a twisting-motor, third driving process, i.e., a third driving process (control) for the twisting motor 76 (refer to FIG. 42) in S10.

Feed-Motor, First Driving Process

Figure 38:
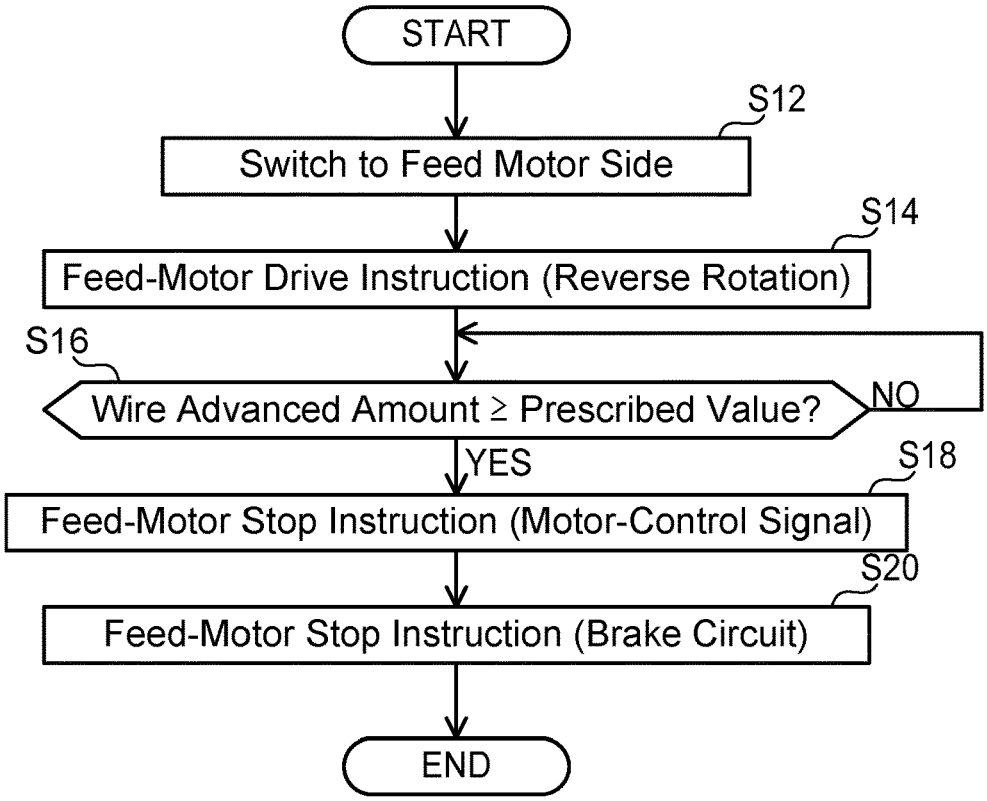
FIG. 38 is a flow chart that shows the details of a feed-motor, first driving process of S2 in FIG. 37.

The details of the feed-motor, first driving process will be explained below, with reference to FIG. 38. In S12, the MCU 202 outputs the H potential as switching signal SW, and thereby the motor-control-signal-output-destination-switching circuit 204 and the motor-rotation-signal-input-source-switching circuit 206 each switch to the feed motor 32 side. In other words, the motor-control-signal-output-destination-switching circuit 204 switches to supplying motor-control signals UH1, VH1, WH1, UL1, VL1, WL1 to the gate driver 208 and thus to the feed motor 32; in addition, the motor-rotation-signal-input-source-switching circuit 206 switches to supplying (inputting) Hall-effect signals Hu1, Hv1, Hw1 to the motor-rotation-signal input port 202*b*.

In S14, the MCU 202 outputs motor-control signals UH, VH, WH, UL, VL, WL so as to cause the rotor 176 of the feed motor 32 to rotate in its reverse rotational direction. Thereby, the advancing process, in which the rotor 176 of the feed motor 32 rotates in its reverse rotational direction and the wire W is thereby advanced, is started.

In S16, the MCU 202 stands by until the advanced amount of the wire W reaches a prescribed value (length). The advanced amount of the wire W can be calculated by, for example, counting Hall-effect sensor signals Hu, Hv, Hw. This calculation can be performed based on the elapsed time since the drive of the feed motor 32 was started in S14. When the advanced amount of the wire W reaches the prescribed value (i.e., when the result becomes YES in S16), the process proceeds to S18.

In S18, the MCU 202 outputs a short-circuit brake signal as motor-control signals UH, VH, WH, UL, VL, WL so as to cause the rotor 176 of the feed motor 32 to stop. Thereby, braking is applied to the feed motor 32.

In S20, the MCU 202 outputs the H potential as brake signal BR1. Thereby, the brake circuit 218 maintains motor-control signals UL1, VL1, WL1 at the H potential. It is noted that, if the brake circuit 218 were to instead (hypothetically) first maintain (set) motor-control signals UL1, VL1, WL1 at (to) the H potential before the MCU 202 outputs the short-circuit brake signal, then there is a risk that an electric current could flow from the brake circuit 218 to the motor-control-signal output port 202*a* of the MCU 202. In the present working example, however, by using a configuration in which the brake circuit 218 maintains motor-control signals UL1, VL1, WL1 at the H potential in S20 after the MCU 202 has previously output the short-circuit brake signal in S18, the flow of electric current from the brake circuit 218 to the motor-control-signal output port 202*a* of the MCU 202 can be prevented. After the process in S20 has been performed, the process shown in FIG. 38 ends.

Twisting-Motor, First Driving Process

The details of the twisting-motor, first driving process will be explained below, with reference to FIG. 39. In S22, the MCU 202 outputs the L potential as switching signal SW, and thereby the motor-control-signal-output-destination-switching circuit 204 and the motor-rotation-signal-input-source-switching circuit 206 each switch to the twisting motor 76 side. In other words, the motor-control-signal-output-destination-switching circuit 204 switches to supplying motor-control signals UH2, VH2, WH2, UL2, VL2, WL2 to the gate driver 210 and thus to the twisting motor 76 and the motor-rotation-signal-input-source-switching circuit 206 switches to supplying (inputting) Hall-effect signals Hu2, Hv2, Hw2 to the motor-rotation-signal input port 202*b*. It is noted that, at the point in time when the process in S22 is performed, the brake circuit 218 maintains motor-control signals UL1, VL1, WL1 at the H potential. Therefore, the application of braking to the feed motor 32 is maintained by the brake circuit 218 even when (i.e. after) the motor-control-signal-output-destination-switching circuit 204 switches to the twisting motor 76 side and thereby the MCU 202 is no longer outputting the short-circuit brake signal to the feed motor 32 via the motor-control-signal-output-destination-switching circuit 204.

In S24, the MCU 202 outputs motor-control signals UH, VH, WH, UL, VL, WL so as to cause the rotor 188 of the twisting motor 76 to rotate in its forward rotational direction. Thereby, the tip-holding (wire tip-holding) process, in which the rotor 188 of the twisting motor 76 rotates in its forward rotational direction and the tip of the wire W is held (clamped), is started.

In S26, the MCU 202 stands by for a prescribed period of time until a first stop-determination interval (time period) is started in S28. That is, the first stop-determination interval is an interval (time period) that is started by the MCU 202 after a first prescribed time period starting from the application of the braking (i.e. short-circuit brake signal) to the feed motor 32 in S18 has elapsed. The first prescribed period of time is set to be the amount of time that is assumed (expected) that the feed motor 32 has already stopped after application of the brake signal in S18. During the first stop-determination interval, the MCU 202 checks whether the rotor 176 of the feed motor 32 is still rotating, because the rotor 176 should no longer be rotating after the first stop-determination interval has been started. As noted above, the first stop-determination interval will be started after the first prescribed amount of time since the application of the short-circuit brake signal in S18 has elapsed. Thus, when, for example, the prescribed time since the application of the braking to the feed motor 32 started in S18 shown in FIG. 38 has elapsed, the MCU 202 starts the first stop-determination interval. When the first stop-determination interval starts (i.e., when the result becomes YES in S26), the process proceeds to S28.

In S28, to check whether the rotor 176 is still rotating, the MCU 202 determines (checks) during the first stop-determination interval whether there is any change in Hall-effect sensor signals Hu1, Hv1, Hw1 from the feed motor 32, which are being monitored by one of the general-purpose I/O ports 202*c*. If a change in one or more of Hall-effect sensor signals Hu1, Hv1, Hw1 (i.e., YES in S28) is detected by the MCU 202 during the first stop-determination interval, then the process proceeds to S30. In S30, the MCU 202 determines that an error has occurred (because the rotor 176 of the feed motor 32 should not be rotating at this time) and performs an error process. That is, if any change in Hall-effect sensor signals Hu1, Hv1, Hw1 from the feed motor 32 is detected during the first stop-determination interval, it means that the rotor 176 is still rotating when it should not be rotating and thus some type of abnormality or error has occurred. On the other hand, if no change in Hall-effect sensor signals Hu1, Hv1, Hw1 (i.e., NO in S28) is detected during the first stop-determination interval, then the process proceeds S32, because the rotor 176 is not, in fact, rotating.

In S32, the MCU 202 determines whether the first stop-determination interval has ended. If, for example, a second prescribed time since the start of the first stop-determination interval in S26 has elapsed, then the MCU 202 determines that the first stop-determination interval has ended. On the other hand, if the first stop-determination interval has not yet ended (i.e., NO in S36), then the process returns to S28. When the first stop-determination interval ends (i.e., YES in S36), the process proceeds to S34.

In S34, the MCU 202 outputs the L potential as brake signal BR1. Thereby, the maintenance of motor-control signals UL1, VL1, WL1 at the H potential by the brake circuit 218 is canceled.

In S36, the MCU 202 stands by until the tip of the wire W is in the state of being held (clamped) by the sandwiching member 90. Whether or not the tip of the wire W is being held (clamped) can be determined based on a detection signal output by the grip-detection sensor 138. When it is determined that the tip of the wire W is in the state of being held or gripped (i.e., clamped) by the sandwiching member 90 (i.e., when the result becomes YES in S36), the process proceeds to S38.

In S38, the MCU 202 outputs a short-circuit brake signal as motor-control signals UH, VH, WH, UL, VL, WL so as to cause the rotor 188 of the twisting motor 76 to stop promptly. Thereby, braking is applied to the twisting motor 76.

In S40, the MCU 202 outputs the H potential as brake signal BR2. Thereby, the brake circuit 220 maintains motor-control signals UL2, VL2, WL2 at the H potential. Because the present working example is configured/adapted such that the brake circuit 220 maintains motor-control signals UL2, VL2, WL2 at the H potential after the MCU 202 has output the short-circuit brake signal in S38, the flow of electric current from the brake circuit 220 to the motor-control-signal output port 202*a* of the MCU 202 can be prevented. After the process in S40 has been performed, the process shown in FIG. 39 ends.

Feed-Motor, Second Driving Process

Figure 40:
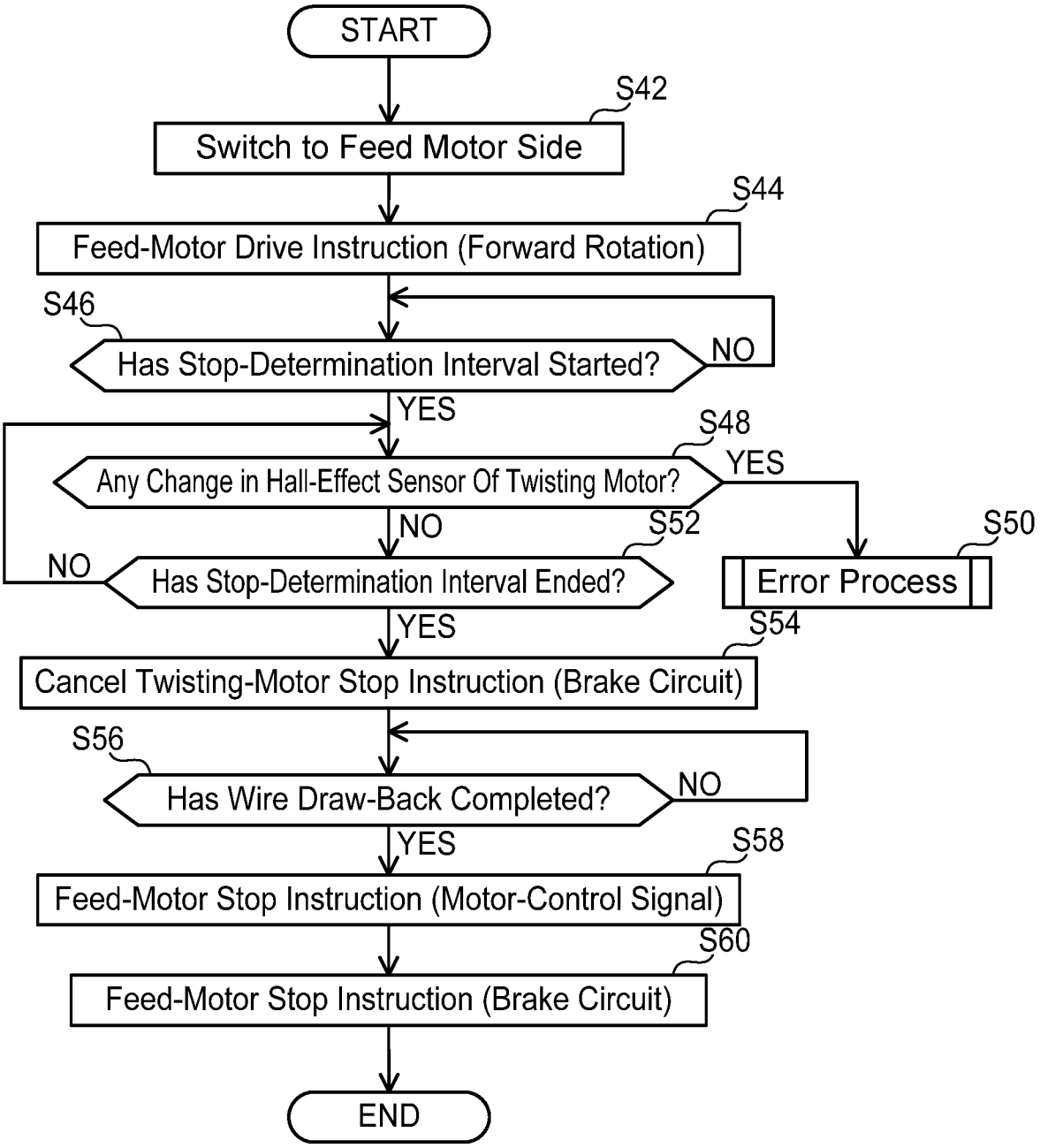
FIG. 40 is a flow chart that shows the details of a feed-motor, second driving process of S6 in FIG. 37.

The details of the feed-motor, second driving process will be explained below, with reference to FIG. 40. In S42, the MCU 202 outputs the H potential as switching signal SW, and thereby the motor-control-signal-output-destination-switching circuit 204 and the motor-rotation-signal-input-source-switching circuit 206 each switch back to the feed motor 32 side. It is noted that, at the point in time when the process in S42 is performed, the brake circuit 220 is continuing to maintain motor-control signals UL2, VL2, WL2 at the H potential. Therefore, the application of braking to the twisting motor 76 is maintained even when (i.e. after) the motor-control-signal-output-destination-switching circuit 204 switches to the feed motor 32 side and consequently the MCU 202 is no longer outputting the short-circuit brake signal to the twisting motor 76 via the motor-control-signal-output-destination-switching circuit 204.

In S44, the MCU 202 outputs motor-control signals UH, VH, WH, UL, VL, WL so as to cause the rotor 176 of the feed motor 32 to rotate in its forward rotational direction. Thereby, the draw-back (wire draw-back) process, in which the rotor 176 of the feed motor 32 rotates in its forward rotational direction and the wire W is drawn back (reeled back in) to cinch (tighten) the looped wire W around the rebars R, is started. Thus, during the draw-back process, the diameter of the loop of wire W around the rebars R is reduced.

In S46, the MCU 202 stands by for a prescribed period of time until a second stop-determination interval is started. For example, when a third prescribed time since braking of the twisting motor 76 was started in S38 shown in FIG. 39 has elapsed, the MCU 202 starts the second stop-determination interval. When the second stop-determination interval starts (i.e., when the result becomes YES), the process proceeds to S48. Similar to the first stop-determination interval, the MCU 202 checks during the second stop-determination interval whether the rotor 188 of the twisting motor 76 is still rotating, because the rotor 188 should no longer be rotating after the second stop-determination interval has been started. As noted above, the second stop-determination interval will be started after the third prescribed amount of time from application of the short-circuit brake signal in S28 has elapsed. It is noted that the first and second stop-determination intervals may be the same amount of time or may be different. In addition or in the alternative, the first and third prescribed times may be the same or different.

In S48, during the second stop-determination interval, the MCU 202 determines whether there is any change in Hall-effect sensor signals Hu2, Hv2, Hw2 from the twisting motor 76, which are being monitored by one of the general-purpose I/O ports 202*c*, which may be different from the general-purpose I/O port 202*c* that monitors the Hall-effect sensor signals Hu1, Hv1, Hw1 from the feed motor 32. If a change in one or more of Hall-effect sensor signals Hu2, Hv2, Hw2 (i.e., YES in S48) is detected by the MCU 202 during the second stop-determination interval, then the process proceeds to S50. In S50, the MCU 202 determines that an error has occurred (because the rotor 188 of the twisting motor 76 should not be rotating at this time) and performs an error process. On the other hand, if no change in Hall-effect sensor signals Hu2, Hv2, Hw2 (i.e., NO in S48) is detected, then the process proceeds to S52.

In S52, the MCU 202 determines whether the second stop-determination interval has ended. For example, when a fourth prescribed time since the second stop-determination interval started in S46 has elapsed, then the MCU 202 determines that the second stop-determination interval has ended. On the other hand, if the second stop-determination interval has not yet ended (i.e., NO in S52), then the process returns to S48. When the second stop-determination interval ends (i.e., YES in S52), the process proceeds to S54. The second and fourth prescribed times may be the same or may be different.

In S54, the MCU 202 outputs the L potential as brake signal BR2. Thereby, the maintenance of motor-control signals UL2, VL2, WL2 at the H potential by the brake circuit 220 is canceled.

In S56, the MCU 202 stands by until the drawing back (cinching) of the wire W has completed. For example, when the current-detection circuit 216 detects an electric-current value that is a prescribed value (current threshold) or higher, the MCU 202 determines that the drawing back of the wire W has completed and thus the loop of wire W has been sufficiently tightened around the rebars R. When the drawing back of the wire W has completed (i.e., when the result becomes YES in S56), the process proceeds to S58. The prescribed value (current threshold) may be factory-set or user-settable.

In S58, the MCU 202 outputs short-circuit brake signals as motor-control signals UH, VH, WH, UL, VL, WL so as to cause the rotor 176 of the feed motor 32 to stop. Thereby, braking is applied to the feed motor 32.

In S60, the MCU 202 outputs the H potential as brake signal BR1. Thereby, the brake circuit 218 maintains motor-control signals UL1, VL1, WL1 at the H potential. After the process in S60 has been performed, the process shown in FIG. 40 ends.

Twisting-Motor, Second Driving Process

The details of the twisting-motor, second driving process will be explained below, with reference to FIG. 41. In S62, the MCU 202 outputs the L potential as switching signal SW, and thereby the motor-control-signal-output-destination-switching circuit 204 and the motor-rotation-signal-input-source-switching circuit 206 switch back to the twisting motor 76 side. It is noted that, at the point in time when the process in S62 is performed, because the brake circuit 218 maintains motor-control signals UL1, VL1, WL1 at the H potential, the application of braking to the feed motor 32 is maintained even when (i.e. after) the motor-control-signal-output-destination-switching circuit 204 switches to the twisting motor 76 side and consequently the MCU 202 is no being longer outputting the short-circuit brake signal to the feed motor 32 via the motor-control-signal-output-destination-switching circuit 204.

In S64, the MCU 202 outputs motor-control signals UH, VH, WH, UL, VL, WL so as to cause the rotor 188 of the twisting motor 76 to rotate in its forward rotational direction. Thereby, (i) the rear-end holding (wire-rear-portion clamping) process, in which the twisting motor 76 rotates in its forward rotational direction and a rear end (rear end portion) of the wire W is held (clamped), (ii) the cutting process, in which the wire W is cut (severed), (iii) the pulling process (wire-end straightening process), in which the two ends of the wire W are pulled (straightened) and thereby further cinching the loop of wire W around the rebars R, and (iv) the twisting process, in which the two end portions of the wire W are twisted together, are performed in this order.

In S66, the MCU 202 stands by for a prescribed time period until a third stop-determination interval is started. For example, when a fifth prescribed time since the application of braking to the feed motor 32 was started in S58 (as shown in FIG. 40) has elapsed, the MCU 202 starts the third stop-determination interval. When the third stop-determination interval has started (i.e., when the result becomes YES), the process proceeds to S68. The third stop-determination interval may be the same as the first and/or the second stop-determination interval or may be different from one or both. Similarly, the fifth prescribed time may be the same as the first and/or the third prescribed time or may be different from one or both.

In S68, during the fifth stop-determination interval, the MCU 202 determines whether there is any change in Hall-effect sensor signals Hu1, Hv1, Hw1 from the feed motor 32, which are being monitored by the same one of the general-purpose I/O ports 202*c* that was mentioned above. If a change in one or more of Hall-effect sensor signals Hu1, Hv1, Hw1 (i.e., YES in S68) is detected by the MCU 202 during the fifth stop-determination interval, then the process proceeds to S70. In S70, the MCU 202 determines that an error has occurred (because the rotor 176 of the feed motor 32 should not be rotating at this time) and therefore performs an error process. On the other hand, if no change in Hall-effect sensor signals Hu1, Hv1, Hw1 (i.e., NO in S68) is detected, then the process proceeds to S72.

In S72, the MCU 202 determines whether the third stop-determination interval has ended. If, for example, a sixth prescribed time since the stop-determination interval started in S66 has elapsed, then the MCU 202 determines that the third stop-determination interval has ended. On the other hand, if the third stop-determination interval has not yet ended (i.e., NO in S72), then the process returns to S68. When the third stop-determination interval ends (i.e., when the result becomes YES in S72), the process proceeds to S74. The sixth prescribed time may be the same as the second and/or the fourth prescribed time or may be different from one or both.

In S74, the MCU 202 outputs the L potential as brake signal BR1. Thereby, the maintenance of motor-control signals UL1, VL1, WL1 at the H potential by the brake circuit 218 is canceled.

In S76, the MCU 202 stands by until the twisting of the two end portions of the wire W has completed. For example, when the electric-current value detected by the current-detection circuit 216 reaches or exceeds an electric-current value that corresponds to a user-set value (which corresponds to an amount of peak torque output by the twisting motor 76) for the desired tying strength of the wire W, the MCU 202 determines that the twisting together of the two ends of the wire W has completed. When the twisting together of the two ends of the wire W has completed (i.e., when the result becomes YES in S76), the process proceeds to S78.

In S78, the MCU 202 outputs a short-circuit brake signal as motor-control signals UH, VH, WH, UL, VL, WL so as to cause rotor 188 of the twisting motor 76 to stop. Thereby, braking is applied to the twisting motor 76.

In S80, the MCU 202 stands by until the twisting motor 76 stops. Whether the twisting motor 76 has stopped can be determined based on Hall-effect sensor signals Hu2, Hv2, Hw2 from the twisting motor 76, which are being input to the motor-rotation-signal input port 202*b*. When the rotor 188 of the twisting motor 76 has stopped (i.e., when the result becomes YES in S80), the process shown in FIG. 41 ends.

(Twisting-Motor, Third Driving Process)

Figure 42:
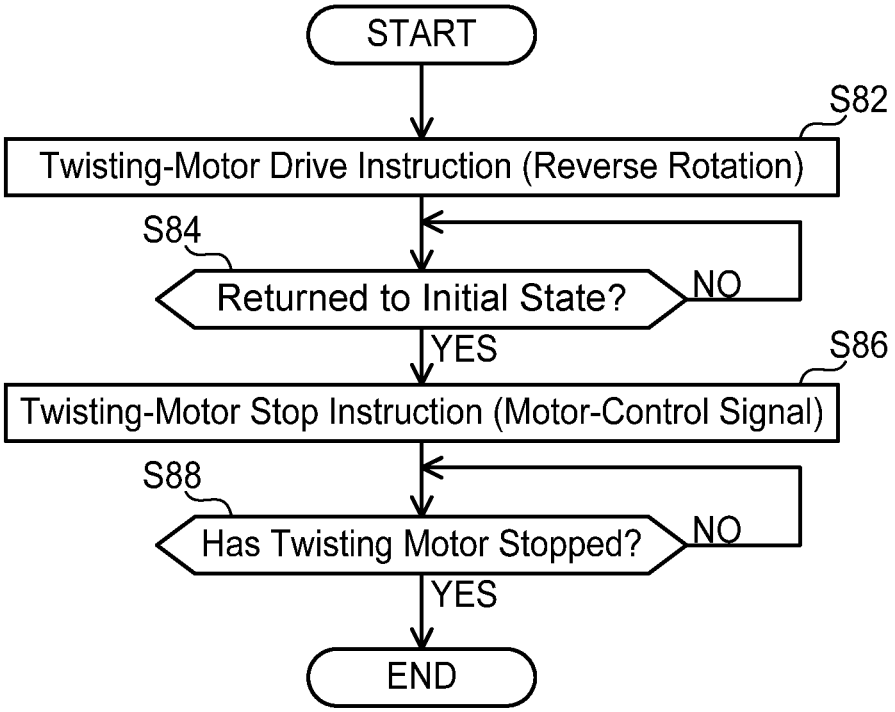
FIG. 42 is a flow chart that shows the details of a twisting-motor, third driving process of S10 in FIG. 37.

The details of the twisting-motor, third driving process will be explained below, with reference to FIG. 42.

In S82, the MCU 202 outputs motor-control signals UH, VH, WH, UL, VL, WL so as to cause the rotor 188 of the twisting motor 76 to rotate in its reverse rotational direction. Thereby, the initial-state return process, in which the rotor 188 of the twisting motor 76 rotates in its reverse rotational direction and the twisting mechanism 30 returns to the (its) initial state, is started.

In S84, the MCU 202 stands by until the twisting mechanism 30 returns to the (its) initial state. Whether the twisting mechanism 30 has returned to the initial state can be determined based on a detection signal output by the initial-state detection sensor 136. When the twisting mechanism 30 has returned to the (its) initial state (i.e., when the result becomes YES in S84), the process proceeds to S86.

In S86, the MCU 202 outputs a short-circuit brake signal as motor-control signals UH, VH, WH, UL, VL, WL so as to cause the rotor 188 of the twisting motor 76 to stop. Thereby, braking is applied to the twisting motor 76.

In S88, the MCU 202 stands by until the rotor 188 of the twisting motor 76 has stopped. Whether the rotor 188 of the twisting motor 76 has stopped can be determined based on Hall-effect sensor signals Hu2, Hv2, Hw2 from the twisting motor 76, which are being input to the motor-rotation-signal input port 202*b*. When the rotor 188 of the twisting motor 76 has stopped (i.e., when the result becomes YES in S88), the process shown in FIG. 42 ends.

Figure 43:
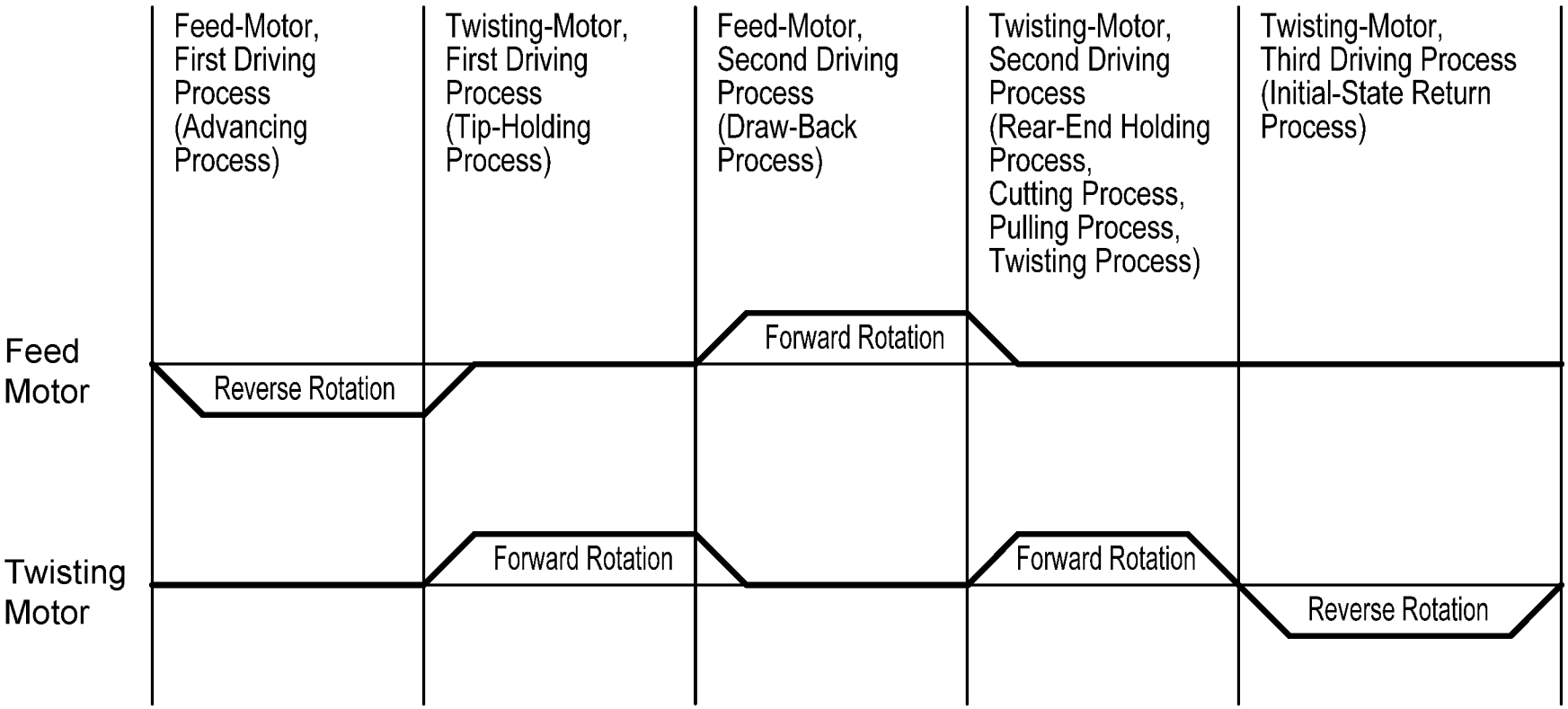
FIG. 43 is a diagram for explaining the operation timing of the feed motor 32 and the twisting motor 76 of the rebar tying tool 2 according to working example 1.

FIG. 43 shows aspects of the operation of the feed motor 32 and the twisting motor 76 in the series of processes shown in FIG. 37 to FIG. 42. In the above-described processes, the twisting motor 76 is energized to start the rotor 188 rotating in its forward rotational direction in the twisting-motor, first driving process before the rotor 176 of the feed motor 32 has completely stopped after the application of braking to the feed motor 32 was started in the feed-motor, first driving process. Thereby, the time required to tie the rebars R using the wire W can be made shorter in the present working example than in an embodiment in which the rotor 176 of the feed motor 32 comes to a complete stop before the twisting motor 76 is energized to start rotating the rotor 188 in its forward rotational direction. In addition, in the above-mentioned processes, the feed motor 32 is energized to start the rotor 176 rotating in its forward rotational direction in the feed-motor, second driving process before the rotor 188 of the twisting motor 76 has completely stopped after the application of braking to the twisting motor 76 was started in the twisting-motor, first driving process. Thereby, the time required to tie the rebars R using the wire W can be made shorter in the present working example than in an embodiment in which the rotor 188 of the twisting motor 76 comes to a complete stop before the feed motor 32 is energized to start the rotor 176 rotating in its forward rotational direction. Furthermore, in the above-mentioned processes, the twisting motor 76 is energized to start the rotor 188 rotating in its forward rotational direction in the twisting-motor, second driving process before the feed motor 32 has completely stopped after the application of braking to the feed motor 32 was started in the feed-motor, second driving process. Thereby, the time required to tie the rebars R using the wire W can be made shorter in the present working example than in an embodiment in which the rotor 176 of the feed motor 32 comes to a complete stop before the twisting motor 76 is energized to start the rotor 188 rotating in its forward rotational direction.

Working Example 2

In working example 2, rebar tying tool 302 comprises substantially the same structural elements as those of the rebar tying tool 2 of working example 1. Therefore, the rebar tying tool 302 of the present working example will be explained below only with respect to those points (structures, processes, etc.) that differ from the rebar tying tool 2 of working example 1; structural elements that are the same as those of the rebar tying tool 2 of working example 1 are assigned the same symbols, and detailed descriptions thereof are omitted.

Figure 44:
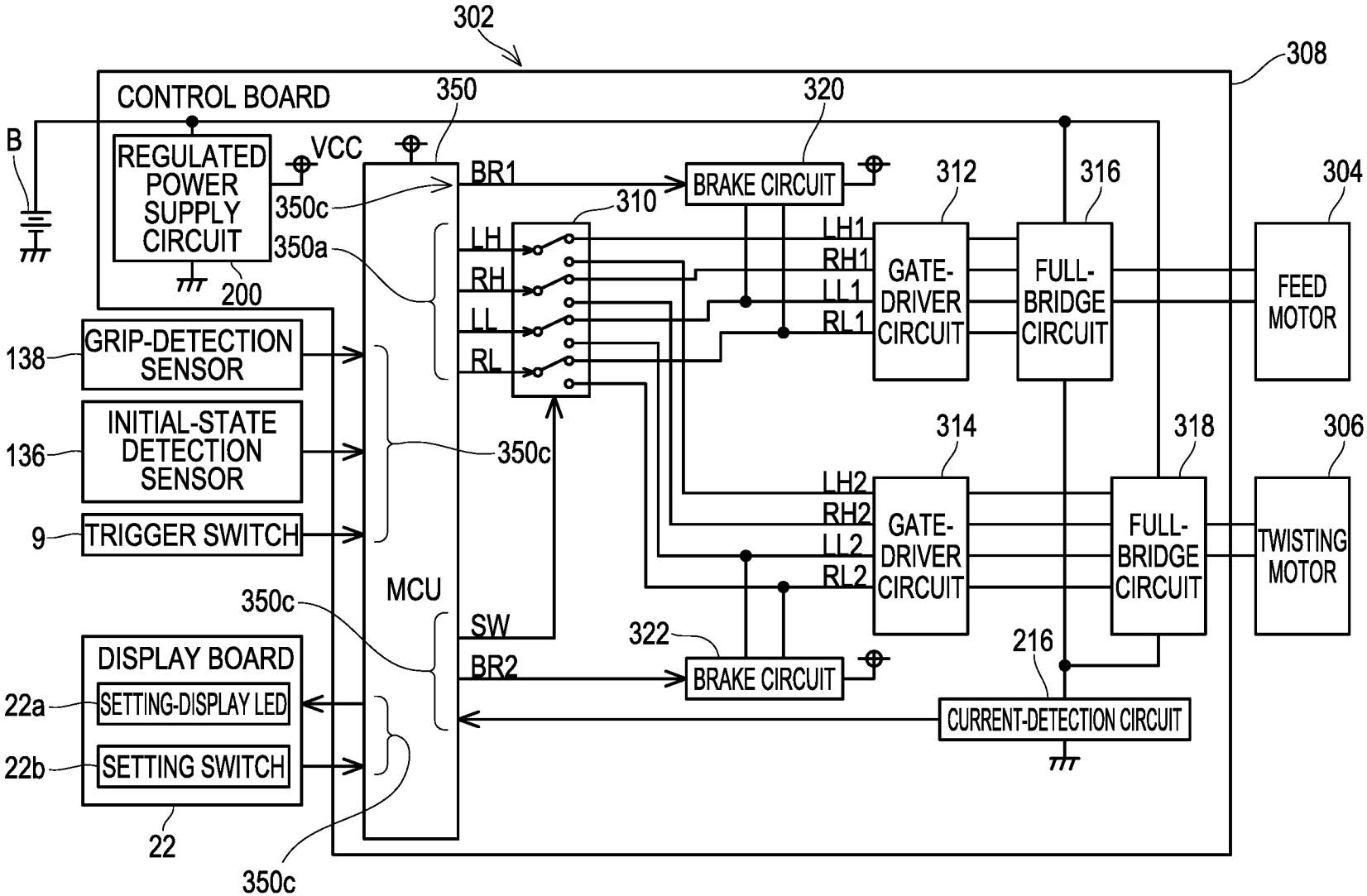
FIG. 44 is a diagram that shows the circuit configuration of a control board 308 of a rebar tying tool 302 according to working example 2.

As shown in FIG. 44, the rebar tying tool 302 of the present working example comprises feed motor 304 instead of the feed motor 32. The feed motor 304 is a brushed motor. In addition, the rebar tying tool 302 of the present working example comprises twisting motor 306 instead of the twisting motor 76. The twisting motor 306 is also a brushed motor.

The rebar tying tool 302 of the present working example comprises control board 308 instead of the control board 20. The regulated power supply circuit 200, MCU 350 (microcontroller unit), motor-control-signal-output-destination-switching circuit 310 (i.e. a circuit that switches the output destination of motor-control signals), gate-driver circuits 312, 314, full-bridge circuits 316, 318, the current-detection circuit 216, brake circuits 320, 322, etc. are provided on the control board 308.

Figure 45:
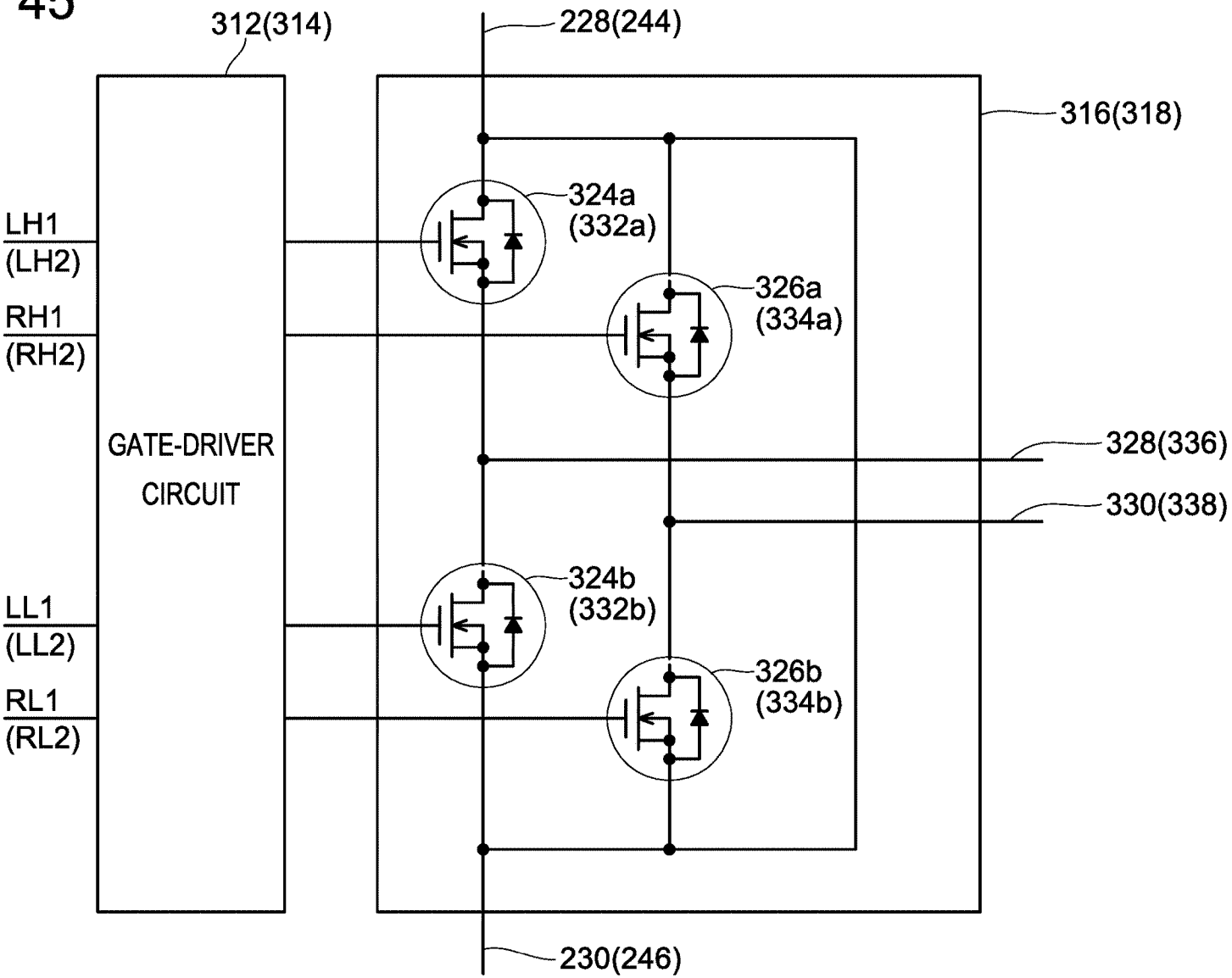
FIG. 45 is a diagram that shows an example of the circuit configuration of full-bridge circuits 316, 318 of the rebar tying tool 302 according to working example 2.

As shown in FIG. 45, the full-bridge circuit 316 comprises four switching devices 324*a*, 324*b*, 326*a*, 326*b*. Each of the switching devices 324*a*, 324*b*, 326*a*, 326*b* is a field-effect transistor (FET) and, preferably, is a MOSFET having an insulated gate (isolated gate), e.g., a so-called power MOSFET. The switching device 324*a* connects a positive-electrode-side, electric-potential line 228 and a motor-power line 328. The switching device 324*b* connects the negative-electrode-side, electric-potential line 230 and the motor-power line 328. The switching device 326*a* connects the positive-electrode-side, electric-potential line 228 and a motor-power line 330. The switching device 326*b* connects the negative-electrode-side, electric-potential line 230 and the motor-power line 330. The positive-electrode-side, electric-potential line 228 is connected to the positive-electrode-side, power-supply, electric potential of the battery B. The negative-electrode-side, electric-potential line 230 is connected to the current-detection circuit 216. The motor-power lines 328, 330 are connected to respective coils (not shown) of the feed motor 304.

Likewise, the full-bridge circuit 318 comprises four switching devices 332*a*, 332*b*, 334*a*, 334*b*. Each of the switching devices 332*a*, 332*b*, 334*a*, 334*b* is also a field-effect transistor (FET) and, preferably, is a MOSFET having an insulated gate (isolated gate), e.g., a so-called power MOSFET. The switching device 332*a* connects the positive-electrode-side, electric-potential line 244 and a motor-power line 336. The switching device 332*b* connects the negative-electrode-side, electric-potential line 246 and the motor-power line 336. The switching device 334*a* connects the positive-electrode-side, electric-potential line 244 and a motor-power line 338. The switching device 334*b* connects the negative-electrode-side, electric-potential line 246 and the motor-power line 338. The positive-electrode-side, electric-potential line 244 is connected to the positive-electrode-side, power-supply, electric potential of the battery B. The negative-electrode-side, electric-potential line 246 is connected to the current-detection circuit 216. The motor-power lines 336, 338 are connected to respective coils (not shown) of the twisting motor 306.

The gate-driver circuit 312 controls the operation of the feed motor 304 by switching each of the switching devices 324*a*, 324*b*, 326*a*, 326*b* of the full-bridge circuit 316, in accordance with motor-control signals LH1, RH1, LL1, RL1, between the conducting state and the nonconducting state. It is noted that, when the rotor of the feed motor 304 is rotating and the gate-driver circuit 312 sets all the switching devices 324*a*, 324*b*, 326*a*, 326*b* to the nonconducting state, even though the supply of electric power to the feed motor 304 is cut off, the rotor of the feed motor 304 will continue to rotate due to inertia for a period of time until the rotor of the feed motor 304 eventually stops. On the other hand, when the rotor of the feed motor 304 is rotating and the gate-driver circuit 312 sets the switching devices 324*a*, 326*a* to the nonconducting state while also setting the switching devices 324*b*, 326*b* to the conducting state, so-called short-circuit braking is applied to the feed motor 304, thereby causing the rotor of the feed motor 304 to stop rotating much more quickly. It is noted that, hereinbelow, the situation in which LL1 and RL1 of motor-control signals LH1, RH1, LL1, RL1 are both at the H potential (in this situation, the switching devices 324*b*, 326*b* will be in the conducting state) is also referred to as a short-circuit brake signal.

Likewise, the gate-driver circuit 314 controls the operation of the twisting motor 306 by switching each of the switching devices 332*a*, 332*b*, 334*a*, 334*b* of the full-bridge circuit 318, in accordance with motor-control signals LH2, RH2, LL2, RL2, between the conducting state and the nonconducting state. It is noted that, when the rotor of the twisting motor 306 is rotating and the gate-driver circuit 314 sets all the switching devices 332*a*, 332*b*, 334*a*, 334*b* to the nonconducting state, even though the supply of electric power to the twisting motor 306 is cut off, the rotor of the twisting motor 306 will continue to rotate due to inertia for a period of time until the rotor of the twisting motor 306 eventually stops. On the other hand, when the rotor of the twisting motor 306 is rotating and the gate-driver circuit 314 sets the switching devices 332*a*, 334*a* to the nonconducting state while also setting the switching devices 332*b*, 334*b* to the conducting state, so-called short-circuit braking is applied to the twisting motor 306, thereby causing the rotor of the twisting motor 306 to stop rotating much more quickly. It is noted that, hereinbelow, when LL2, RL2 of motor-control signals LH2, RH2, LL2, RL2 are both at the H potential (in this situation, the switching devices 332*b*, 334*b* will be in the conducting state), it will also be referred to as a short-circuit brake signal.

As shown in FIG. 44, the current-detection circuit 216 is disposed between the full-bridge circuit 316 and the full-bridge circuit 318 on one side and the negative-electrode-side, power-supply, electric potential of the battery B on the other side. The current-detection circuit 216 detects the magnitude of the electric current that flows through the full-bridge circuit 316 and the full-bridge circuit 318. The current-detection circuit 216 outputs the value of the detected electric current to the MCU 350.

The MCU 350 comprises a motor-control-signal output port 350*a* and general-purpose I/O ports 350*c*. The motor-control-signal output port 350*a* is provided for outputting motor-control signals LH, RH, LL, RL to the brushed motors (i.e., the motor-control-signal output port 202*a* has six pins for respectively outputting the six motor-control signals UH, VH, WH, UL, VL, WL) and is capable of (is configured/adapted to perform) signal processing at a speed higher than that of the general-purpose I/O ports 350*c*. The setting-display LED 22*a* and the setting switch 22*b* of the display board 22, the trigger switch 9, the initial-state detection sensor 136, the grip-detection sensor 138, and the current-detection circuit 216 are respectively connected to two or more of the general-purpose I/O ports 350*c* of the MCU 350. Similar to working example 1, the manipulatable part (e.g., a button) 12*c*, the setting switch 22*b* and the MCU 350 are preferably configured/adapted to enable the user to manually set (input) a desired tying strength for twisting the wire W by depressing the manipulatable part (e.g., a button) 12*c*. The selected tying strength may be displayed by (on) the setting-display LED 22*a*. Similar to working example 1, the tying strength corresponds to the peak output torque applied by the twisting motor 306 to the end portions of the wire W during the twisting process.

The motor-control-signal output port 350*a* (i.e., the six pins thereof) of the MCU 350 is connected to the motor-control-signal-output-destination-switching circuit 310. The motor-control-signal-output-destination-switching circuit 310 switches the output destinations of the motor-control signals LH, RH, LL, RL, which are output from the motor-control-signal output port 350*a*, between the gate-driver circuit 312 and the gate-driver circuit 314 in accordance with switching signal SW output from one of the general-purpose I/O ports 350*c* of the MCU 350. The circuit configuration of the motor-control-signal-output-destination-switching circuit 310 is substantially the same as that of the motor-control-signal-output-destination-switching circuit 204 of working example 1.

Figure 46:
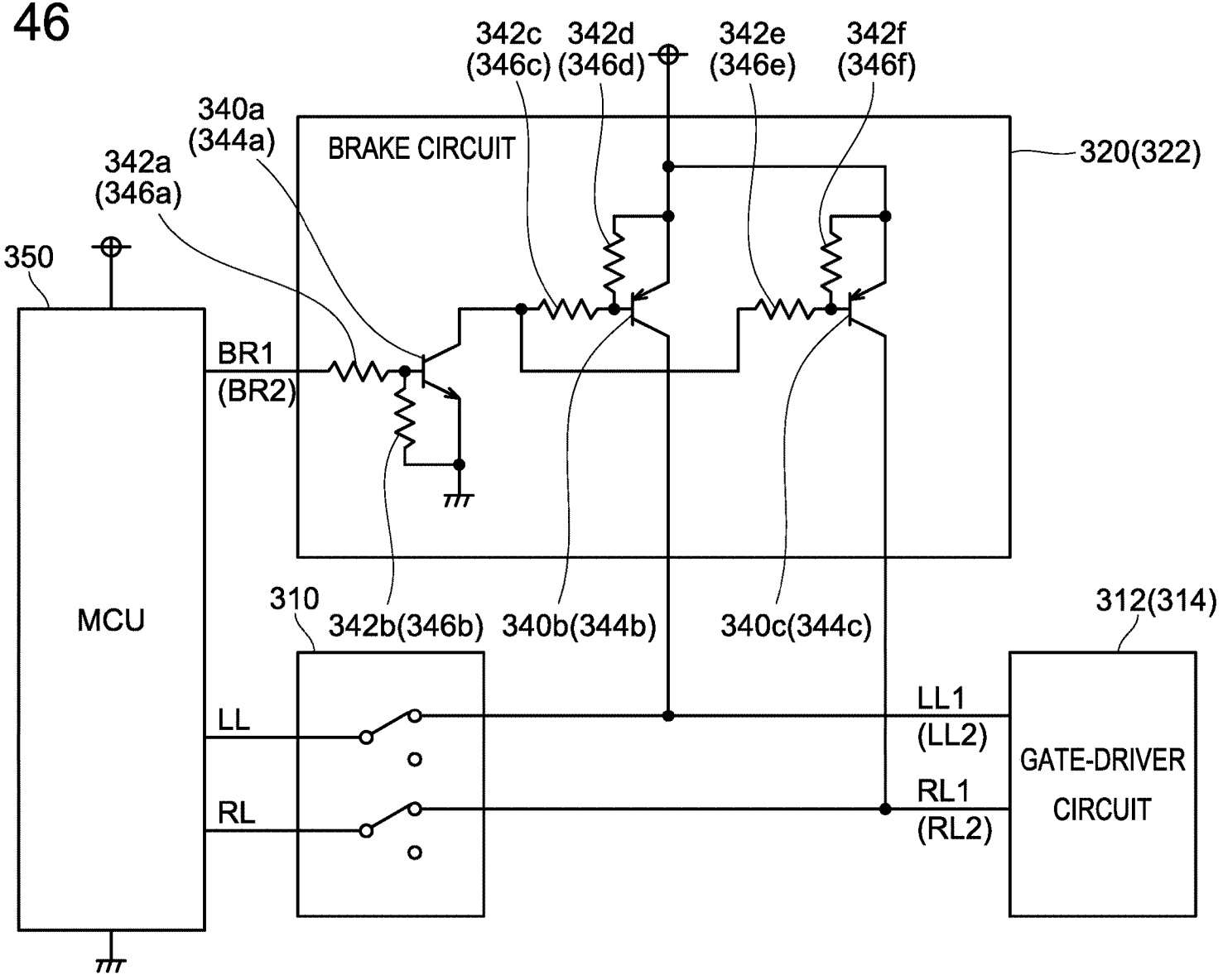
FIG. 46 is a diagram that shows an example of the circuit configuration of brake circuits 320, 322 of the rebar tying tool 302 according to working example 2.

As shown in FIG. 46, the brake circuit 320 is connected to signal lines of motor-control signals LL1, RL1 output from the motor-control-signal-output-destination-switching circuit 310 to the gate-driver circuit 312. The brake circuit 320 applies short-circuit braking to the feed motor 304 in response to the output of brake signal BR1 from one of the general-purpose I/O ports 350*c* of the MCU 350. The brake circuit 320 comprises transistors 340*a*, 340*b*, 340*c* and resistors 342*a*, 342*b*, 342*c*, 342*d*, 342*e*, 342*f* When brake signal BR1 output from the MCU 350 is at the L potential, the transistor 340*a* turns OFF, which causes all the transistors 340*b*, 340*c* to turn OFF. Therefore, motor-control signals LL1, RL1 output from the motor-control-signal-output-destination-switching circuit 310 are input, as is, into the gate-driver circuit 312. On the other hand, when brake signal BR1 output from the MCU 350 is at the H potential, the transistor 340*a* turns ON, which causes all the transistors 340*b*, 340*c* to turn ON. Therefore, all the motor-control signals LL1, RL1 input to the gate-driver circuit 312 are at the H potential. In other words, a short-circuit brake signal is input to the gate-driver circuit 312, and thereby short-circuit braking is applied to the feed motor 304.

As shown in FIG. 46, the brake circuit 322 may be constructed in the same way as the brake circuit 320. That is, as shown in parentheses in FIG. 46, the brake circuit 322 is connected to signal lines of motor-control signals LL2, RL2 output from the motor-control-signal-output-destination-switching circuit 310 to the gate-driver circuit 314. The brake circuit 322 applies short-circuit braking to the twisting motor 306 in response to the output of brake signal BR2 from one of the general-purpose I/O ports 350*c* of the MCU 350. The brake circuit 322 comprises transistors 344*a*, 344*b*, 344*c* and resistors 346*a*, 346*b*, 346*c*, 346*d*, 346*e*, 346*f* When brake signal BR2 output from the MCU 350 is at the L potential, the transistor 344*a* turns OFF, which causes all the transistors 344*b*, 344*c* to turn OFF. Therefore, motor-control signals LL2, RL2 output from the motor-control-signal-output-destination-switching circuit 310 are input, as is, to the gate-driver circuit 314. On the other hand, when brake signal BR2 output from the MCU 350 is at the H potential, the transistor 344*a* turns ON, which causes all the transistors 344*b*, 344*c* turn ON. Therefore, all motor-control signals LL2, RL2 input from the gate-driver circuit 314 change to the H potential. In other words, a short-circuit brake signal is input to the gate-driver circuit 314, and thereby short-circuit braking is applied to the twisting motor 306.

When the trigger switch 9 switches from OFF to ON, the MCU 350 basically performs the same processes as shown in FIG. 37 to FIG. 42. However, it is noted that, in the present working example, because the feed motor 304 and the twisting motor 306 do not comprise Hall-effect sensors, the process in S26-S32 shown in FIG. 39, the process in S46-S52 shown in FIG. 40, the process in S66-S72 shown in FIG. 41, and the like are not performed. In addition, in the present working example, in the process in S16 shown in FIG. 39, the calculation of the wire advanced amount is performed based on, for example, the elapsed time since the reverse rotation of the rotor the feed motor 304 was started in S14. Furthermore, in the present working example, in the process in S80 shown in FIG. 41, the determination of whether rotation of the rotor of the twisting motor 306 has stopped is performed based on, for example, the elapsed time since the instruction (short-circuit brake signal) to stop the rotation of the rotor of the twisting motor 306 was issued in S78. Likewise, in the present working example, in the process in S88 shown in FIG. 42, the determination of whether the rotation of the rotor of twisting motor 306 has stopped is performed based on, for example, the elapsed time since the instruction (short-circuit brake signal) to stop the rotation of the rotor of twisting motor 306 was issued in S86.

In the rebar tying tool 302 of the present working example, too, the rotor of the twisting motor 306 is caused to start rotating in its forward rotational direction in the twisting-motor, first driving process before the rotor of the feed motor 304 has completely stopped after the application of braking to the feed motor 304 was started in the feed-motor, first driving process. Thereby, the time required to tie the rebars R using the wire W can be made shorter than in an embodiment in which initiation of the forward rotation of the rotor of the twisting motor 306 is started after the rotor of the feed motor 304 has completely stopped. In addition, in the rebar tying tool 302 of the present working example, too, the rotor of the feed motor 304 is caused to start rotating in its forward rotational direction in the feed-motor, second driving process before the rotor of the twisting motor 306 has completely stopped after the application of braking to the twisting motor 306 was started in the twisting-motor, first driving process. Thereby, the time required to tie the rebars R using the wire W can be made shorter than in an embodiment in which initiation of the forward rotation of the rotor of the feed motor 304 is started after the rotor of the twisting motor 306 has completely stopped. Furthermore, in the above-mentioned processes, the rotor of the twisting motor 306 is caused to start rotating in its forward rotational direction in the twisting-motor, second driving process before the rotor of the feed motor 304 has completely stopped after the application of braking to the feed motor 304 was started in the feed-motor, second driving process. Thereby, the time required to tie the rebars R using the wire W can be made shorter than in an embodiment in which initiation of the forward rotation of the rotor of the twisting motor 306 is started after the rotor of the feed motor 304 has completely stopped.

Working Example 3

In working example 3, rebar tying tool 402 comprises substantially the same structural elements as those of the rebar tying tool 2 of working example 1 and the rebar tying tool 302 of working example 2. Therefore, the rebar tying tool 402 of the present working example will be explained below only with respect to those points (structures, processes, etc.) that differ from the rebar tying tool 2 of working example 1 and the rebar tying tool 302 of working example 2; structural elements that are the same as those of the rebar tying tool 2 of working example 1 and the rebar tying tool 302 of working example 2 are assigned the same symbols, and detailed descriptions thereof are omitted.

Figure 47:
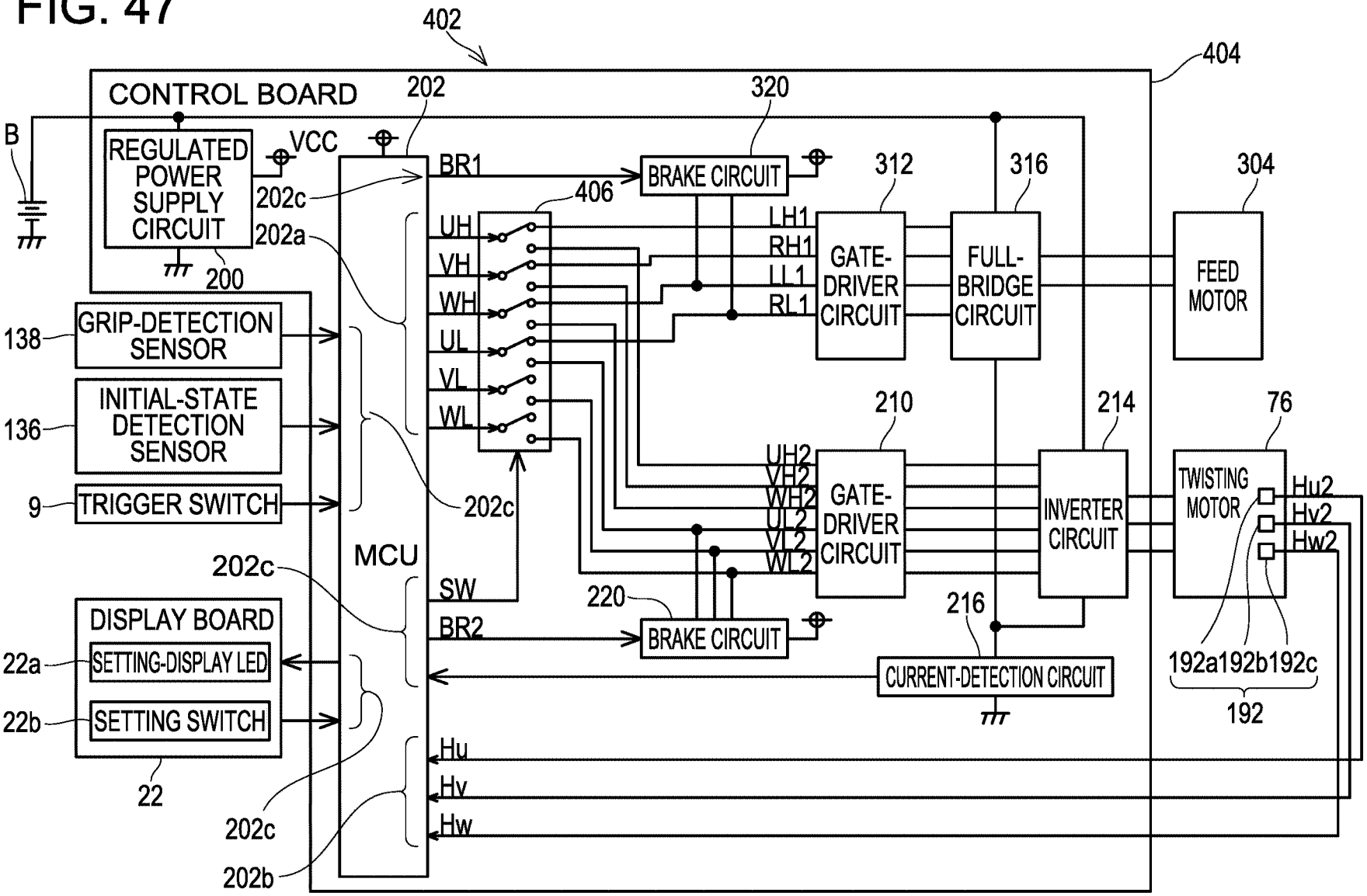
FIG. 47 is diagram that shows the circuit configuration of a control board 404 of a rebar tying tool 402 according to working example 3.

As shown in FIG. 47, the rebar tying tool 402 of the present working example comprises the feed motor 304, which is a brushed motor, and the twisting motor 76, which is a brushless motor.

The rebar tying tool 402 of the present working example comprises control board 404 instead of the control board 20. The regulated power supply circuit 200, the MCU 202 (microcontroller unit), motor-control-signal-output-destination-switching circuit 406, the gate-driver circuits 210, 312, the inverter circuit 214, the full-bridge circuit 316, the current-detection circuit 216, the brake circuits 220, 320, etc. are provided on the control board 404.

The motor-control-signal-output-destination-switching circuit 406 is connected to the motor-control-signal output port 202*a* of the MCU 202. The motor-control-signal-output-destination-switching circuit 406 switches, in accordance with switching signal SW output from one of the general-purpose I/O ports 202*c* of the MCU 202, the output destination of the motor-control signals UH, VH, WH, UL, VL, WL output from the motor-control-signal output port 202*a*, between the gate-driver circuit 210 and the gate-driver circuit 312. It is noted that the MCU 202 outputs motor-control signals LH, RH, LL, RL, which are used in the control of a brushed motor, as motor-control signals UH, VH, WH, UL when controlling (energizing) the feed motor 304, and outputs motor-control signals UH, VH, WH, UL, VL, WL, which are used in the control of a brushless motor, when controlling (energizing) the twisting motor 76.

In the rebar tying tool 402 of the present working example, the Hall-effect sensor 192 of the twisting motor 76 is connected to the motor-rotation-signal input port 202*b* of the MCU 202. When controlling (energizing) the twisting motor 76, the MCU 202 outputs motor-control signals UH, VH, WH, UL, VL, WL based on Hall-effect sensor signals Hu, Hv, Hw input to the motor-rotation-signal input port 202*b*.

Figure 39:
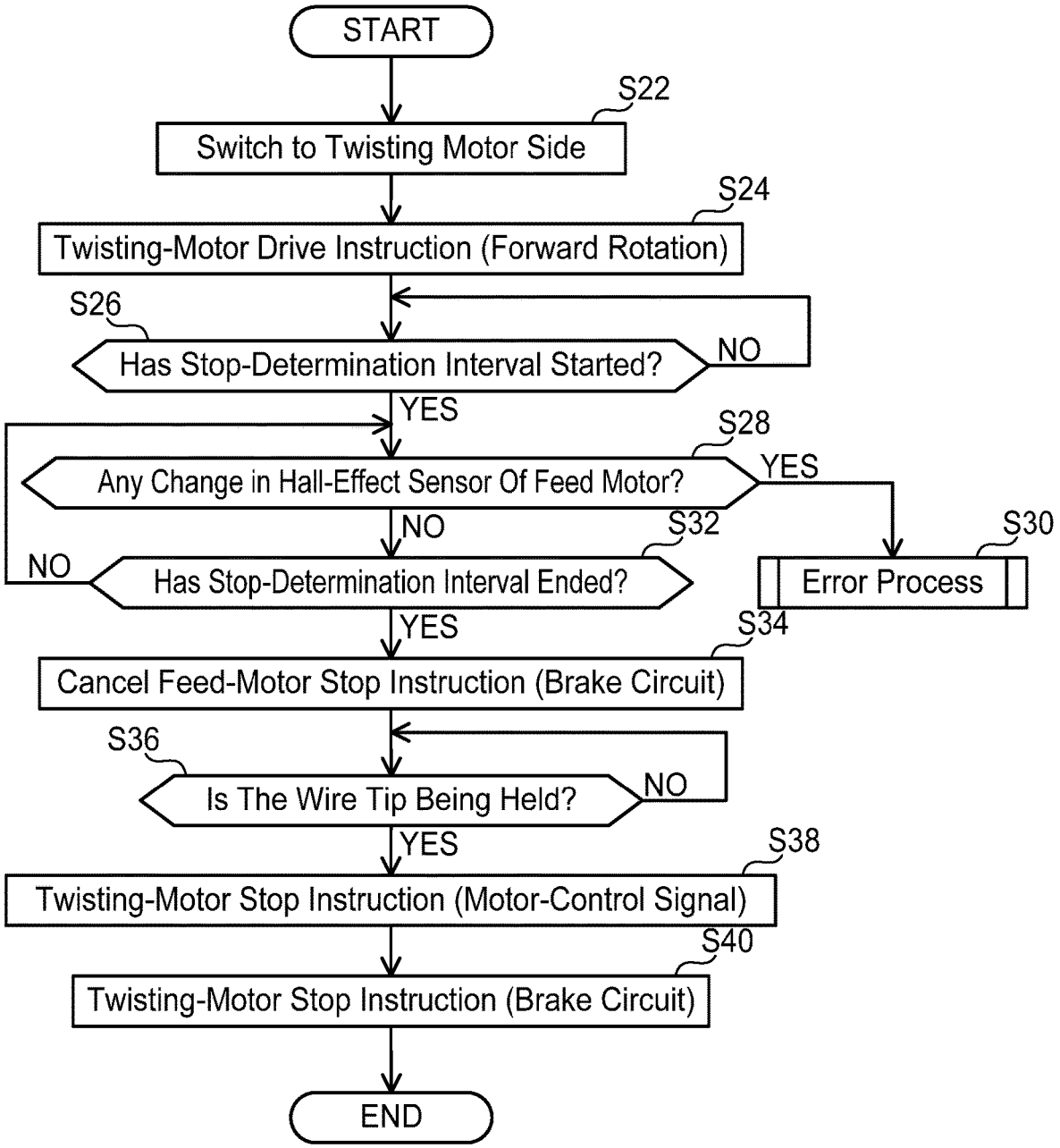
FIG. 39 is a flow chart that shows the details of a twisting-motor, first driving process of S4 in FIG. 37.
Figure 41:
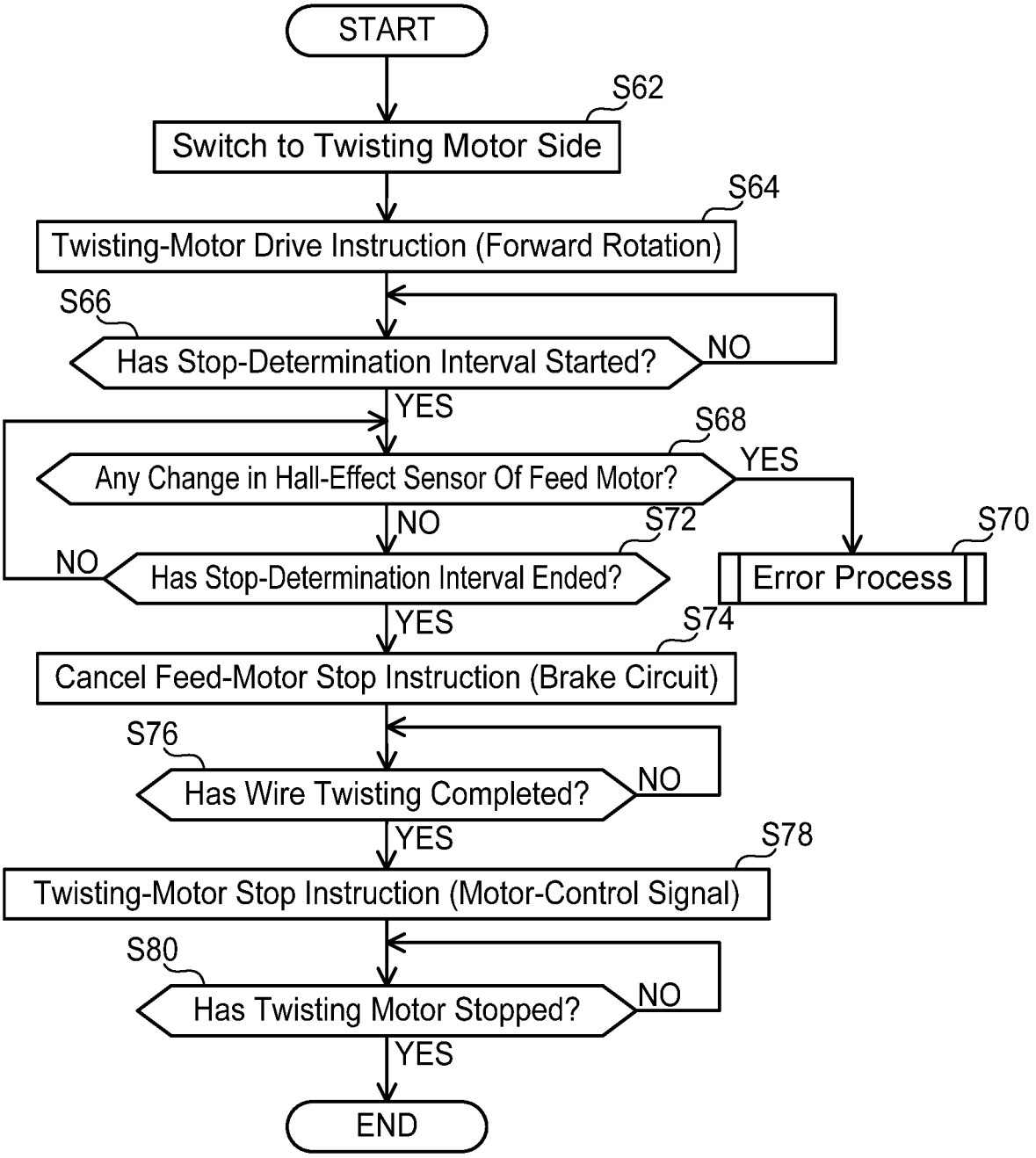
FIG. 41 is a flow chart that shows the details of a twisting-motor, second driving process of S8 in FIG. 37.

When the trigger switch 9 switches from OFF to ON, the MCU 202 basically performs the same processes as in FIG. 37 to FIG. 42. However, it is noted that, in the present working example, because the feed motor 304 does not comprise the Hall-effect sensors, the processes in S26-S32 shown in FIG. 39 and the processes in S66-S72 shown in FIG. 41 are not performed. In addition, in the present working example, the calculation of the wire advance amount in the process in S16 shown in FIG. 39 is performed based on, for example, the elapsed time since the reverse rotation of the rotor of the feed motor 304 was started in S14.

In the rebar tying tool 402 of the present working example, too, the rotor 188 of the twisting motor 76 is caused to start rotating in its forward rotational direction in the twisting-motor, first driving process before the rotor of the feed motor 304 has completely stopped after the application of braking to the feed motor 304 was started in the feed-motor, first driving process. Thereby, the time required to tie the rebars R using the wire W can be made shorter than in an embodiment in which the rotor 188 of the twisting motor 76 is caused to start rotating in its forward rotational direction after the rotor of the feed motor 304 has completely stopped. In addition, in the rebar tying tool 402 of the present working example, too, the rotor of the feed motor 304 is caused to start rotating in its forward rotational direction in the feed-motor, second driving process before the rotor 188 of the twisting motor 76 has completely stopped after the application of braking to the twisting motor 76 was started in the twisting-motor, first driving process. Thereby, the time required to tie the rebars R using the wire W can be made shorter than in an embodiment in which the rotor of the feed motor 304 is caused to start rotating in its forward rotational direction after the rotor 188 of the twisting motor 76 has completely stopped. Furthermore, in the above-mentioned processes, the rotor 188 of the twisting motor 76 is caused to start rotating in its forward rotational direction in the twisting-motor, second driving process before the rotor of the feed motor 304 has completely stopped after the application of braking to the feed motor 304 was started in the feed-motor, second driving process. Thereby, the time required to tie the rebars R using the wire W can be made shorter than in an embodiment in which the rotor 188 of the twisting motor 76 is caused to rotate in its forward rotational direction after the rotor of the feed motor 304 has completely stopped.

As described above, in one or more of the embodiments, the rebar tying tool 2, 302, 402 comprises: the feed mechanism 24, which comprises the feed motor 32, 304 (example of the first motor) and feeds the wire W; the twisting mechanism 30, which comprises the twisting motor 76, 306 (example of the second motor) and twists the wire W; the MCU 202, 350 (example of the control unit), which controls the feed motor 32, 304 and the twisting motor 76, 306; and the motor-control-signal-output-destination-switching circuit 204, 310, 406. The MCU 202, 350 comprises the general-purpose I/O port 202*c*, 350*c* and the motor-control-signal output port 202*a*, 350*a*. The motor-control-signal-output-destination-switching circuit 204, 310, 406 outputs, to one motor selected from the feed motor 32, 304 and the twisting motor 76, 306, motor-control signals UH, VH, WH, UL, VL, WL (or LH, RH, LL, RL) from the MCU 202, 350. The motor-control-signal-output-destination-switching circuit 204, 310, 406 selects, in accordance with switching signal SW (example of the output-switching signal), one of the feed motor 32, 304 or the twisting motor 76, 306.

According to the above-mentioned configuration, motor-control signals UH1, VH1, WH1, UL1, VL1, WL1 (or LH1, RH1, LL1, RL1) to the feed motor 32, 304 and motor-control signals UH2, VH2, WH2, UL2, VL2, WL2 (or LH2, RH2, LL2, RL2) to the twisting motor 76, 306 can be selectively output from the motor-control-signal output port 202*a*, 350*a*, which corresponds to one (i.e. a single) motor. By using such a configuration, both the feed motor 32, 304 of the feed mechanism 24 and the twisting motor 76, 306 of the twisting mechanism 30 can be accurately controlled, without leading to a large increase in cost.

In one or more of the embodiments, switching signal SW is output from one of the general-purpose I/O ports 202*c*, 350*c* of the MCU 202, 350.

According to the above-mentioned configuration, the switching of the motor-control-signal-output-destination-switching circuit 204, 310, 406 can be performed in accordance with the timing of a process performed by the MCU 202, 350.

In one or more of the embodiments, the motor-control-signal output-destination-switching circuit 204, 310, 406 comprises the demultiplexer 260.

According to the above-mentioned configuration, the motor-control-signal-output-destination-switching circuit 204, 310, 406 can be implemented using a simple configuration.

In one or more of the embodiments, the rebar tying tool 2, 302, 402 further comprises the brake circuit 218, 320 (example of the first brake circuit), which outputs a short-circuit brake signal to the feed motor 32, 304. When the motor-control-signal-output-destination-switching circuit 204, 310, 406 switches from the state in which the feed motor 32, 304 is selected to the state in which the twisting motor 76, 306 is selected, the brake circuit 218, 320 outputs a short-circuit brake signal to the feed motor 32, 304.

According to the above-mentioned configuration, because short-circuit braking is applied to the feed motor 32, 304 by the brake circuit 218, 320 when the MCU 202, 350 switches from the state in which it controls the feed motor 32, 304 to the state in which it controls the twisting motor 76, 306, the rotation of the rotor of the feed motor 32, 304 can be stopped more quickly than in an embodiment in which no short-circuit braking is applied.

In one or more of the embodiments, when the motor-control-signal-output-destination-switching circuit 204, 310, 406 switches from the state in which the feed motor 32, 304 is selected to the state in which the twisting motor 76, 306 is selected, the rotation of the rotor of the twisting motor 76, 306 starts before the rotation of the rotor of the feed motor 32, 304 has completely stopped.

According to the above-mentioned configuration, the time required to tie the rebars R can be made shorter than in an embodiment in which rotation of the rotor of the twisting motor 76, 306 starts after rotation of the rotor of the feed motor 32, 304 has stopped.

In one or more of the embodiments, before the motor-control-signal-output-destination-switching circuit 204, 310, 406 switches from the state in which the feed motor 32, 304 is selected to the state in which the twisting motor 76, 306 is selected, the brake circuit 218, 320 outputs a short-circuit brake signal to the feed motor 32, 304.

When the motor-control-signal-output-destination-switching circuit 204, 310, 406 switches from the state in which the feed motor 32, 304 is selected to the state in which the twisting motor 76, 306 is selected, if the rotor of the feed motor 32, 304 continues to rotate due to inertia, then there is a risk that a regenerated electric current will be generated, leading to deterioration or failure of the battery B. According to the above-mentioned configuration, however, when the motor-control-signal-output-destination-switching circuit 204, 310, 406 switches from the state in which the feed motor 32, 304 is selected to the state in which the twisting motor 76, 306 is selected, rotation of the rotor of the feed motor 32, 304 due to inertia can be curtailed, i.e. brought to a reduced speed or stopped more quickly owing to the application of the short-circuit brake signal.

In one or more of the embodiments, before the brake circuit 218,320 outputs a short-circuit brake signal to the feed motor 32, 304, the MCU 202, 350 outputs a short-circuit brake signal to the feed motor 32, 304.

If the brake circuit 218, 320 were to instead output a short-circuit brake signal to the feed motor 32, 304 before the MCU 202, 350 outputs a short-circuit brake signal to the feed motor 32, 304, there is a risk that electric current will flow from the brake circuit 218, 320 into the MCU 202, 350. According to the above-mentioned configuration, however, it is possible to curtail the flow of electric current from the brake circuit 218, 320 into the MCU 202, 350 owing to the fact that the MCU 202, 350 outputs a short-circuit brake signal to the feed motor 32, 304 before the brake circuit 218,320 outputs a short-circuit brake signal to the feed motor 32, 304.

In one or more of the embodiments, the rebar tying tool 2, 302, 402 further comprises the brake circuit 220, 322 (example of the second brake circuit), which outputs a short-circuit brake signal to the twisting motor 76, 306. When the motor-control-signal-output-destination-switching circuit 204, 310, 406 switches from the state in which the twisting motor 76, 306 is selected to the state in which the feed motor 32, 304 is selected, the brake circuit 220, 322 outputs a short-circuit brake signal to the twisting motor 76, 306.

According to the above-mentioned configuration, when the MCU 202, 350 switches from the state in which it controls the twisting motor 76, 306 to the state in which it controls the feed motor 32, 304, rotation of the rotor of the twisting motor 76, 306 can be stopped more quickly because short-circuit braking is applied to the twisting motor 76, 306 by the brake circuit 220, 322.

In one or more of the embodiments, when the motor-control-signal-output-destination-switching circuit 204, 310, 406 switches from the state in which the twisting motor 76, 306 is selected to the state in which the feed motor 32, 304 is selected, the rotation of the rotor of the feed motor 32, 304 starts before the rotation of the rotor of the twisting motor 76, 306 has completely stopped.

According to the above-mentioned configuration, the time required to tie the rebars R can be made shorter than in an embodiment in which rotation of the rotor of the feed motor 32, 304 starts after rotation of the rotor of the twisting motor 76, 306 has stopped.

In one or more of the embodiments, before the motor-control-signal-output-destination-switching circuit 204, 310, 406 switches from the state in which the twisting motor 76, 306 is selected to the state in which the feed motor 32, 304 is selected, the brake circuit 220, 322 may output a short-circuit brake signal to the twisting motor 76, 306.

When the motor-control-signal-output-destination-switching circuit 204, 310, 406 switches from the state in which the twisting motor 76, 306 is selected to the state in which the feed motor 32, 304 is selected, if the rotor of the twisting motor 76, 306 were to continue to rotate due to inertia, then there would be a risk that a regenerated electric current will be generated, leading to deterioration or failure of the battery B. According to the above-mentioned configuration, however, when the motor-control-signal-output-destination-switching circuit 204, 310, 406 switches from the state in which the twisting motor 76, 306 is selected to the state in which the feed motor 32, 304 is selected, rotation of the rotor of the twisting motor 76, 306 due to inertia can be curtailed, i.e. brought to a reduced speed or stopped more quickly.

In one or more of the embodiments, before the brake circuit 220, 322 outputs a short-circuit brake signal to the twisting motor 76, 306, the MCU 202, 350 outputs a short-circuit brake signal to the twisting motor 76, 306.

Assuming that the brake circuit 220, 322 outputs a short-circuit brake signal to the twisting motor 76, 306 before the MCU 202, 350 outputs a short-circuit brake signal to the twisting motor 76, 306, there would be a risk that electric current will flow from the brake circuit 220, 322 to the MCU 202, 350. According to the above-mentioned configuration, however, it is possible to curtail or even prevent the flow of electric current from the brake circuit 220, 322 to the MCU 202, 350.

In one or more of the embodiments, the feed motor 32 is a brushless motor (example of the first brushless motor).

According to the above-mentioned configuration, the life of the feed motor 32 can be lengthened (as compared to a brushed motor), and the frequency of maintenance can be reduced.

In one or more of the embodiments, the twisting motor 76 is a brushless motor (example of the second brushless motor).

According to the above-mentioned configuration, the life of the twisting motor 76 can be lengthened (as compared to a brushed motor), and the frequency of maintenance can be reduced.

In one or more of the embodiments, the rebar tying tool 2 may further comprise the motor-rotation-signal-input-source-switching circuit 206. The feed motor 32 is a brushless motor (example of the first brushless motor). The twisting motor 76 is a brushless motor (example of the second brushless motor). The feed motor 32 comprises the Hall-effect sensor 180 (example of the first Hall-effect sensor). The twisting motor 76 comprises the Hall-effect sensor 192 (example of the second Hall-effect sensor). The MCU 202 further comprises the motor-rotation-signal input port 202*b*. The motor-rotation-signal-input-source-switching circuit 206 inputs, into the motor-rotation-signal input port 202*b*, one (set of signals) selected from (either) first Hall-effect sensor signals Hu1, Hv1, Hw1 from the Hall-effect sensor 180 and second Hall-effect sensor signals Hu2, Hv2, Hw2 from the Hall-effect sensor 192. The motor-rotation-signal-input-source-switching circuit 206 selects, in accordance with switching signal SW (example of the input-switching signal), the one (set of signals) selected from (either) first Hall-effect sensor signals Hu1, Hv1, Hw1 and second Hall-effect sensor signals Hu2, Hv2, Hw2.

In an embodiment in which the feed motor 32 and the twisting motor 76 are brushless motors, the MCU 202 is provided with the motor-rotation-signal input port 202*b* that is preferably capable of high-speed signal processing, and by inputting Hall-effect sensor signals Hu, Hv, Hw into the high-speed motor-rotation-signal input port 202*b*, it becomes possible to control the brushless motors more accurately owing to the high-speed processing of the motor-rotation-signal input port 202*b*. According to the above-mentioned configuration, first Hall-effect sensor signals Hu1, Hv1, Hw1 of the feed motor 32 and second Hall-effect sensor signals Hu2, Hv2, Hw2 of the twisting motor 76 can be selectively input to the motor-rotation-signal input port 202*b*, which corresponds to one brushless motor. According to such a configuration, both the feed motor 32 and the twisting motor 76 can be accurately controlled using a single high-speed motor-rotation-signal input port 202*b*, thereby avoiding a large increase in cost that would be required in an embodiment of MCU 202 having two high-speed motor-rotation-signal input ports 202*b*.

In one or more of the embodiments, switching signal SW is output from one of the general-purpose I/O ports 202*c* of the MCU 202.

According to the above-mentioned configuration, switching of the motor-rotation-signal-input-source-switching circuit 206 can be performed in accordance with the timing of a process performed by the MCU 202.

In one or more of the embodiments, the motor-rotation-signal-input-source-switching circuit 206 comprises the multiplexer 282.

According to the above-mentioned configuration, the motor-rotation-signal-input-source-switching circuit 206 can be implemented using a simple configuration.

In one or more of the embodiments, first Hall-effect sensor signals Hu1, Hv1, Hw1 are also input to one of the general-purpose I/O ports 202*c* of the MCU 202. Second Hall-effect sensor signals Hu2, Hv2, Hw2 are also input to one of the general-purpose I/O ports 202*c* of the MCU 202, preferably to a different one of the general-purpose I/O ports 202*c* of the MCU 202 than the general-purpose I/O port 202*c* that is inputting the first Hall-effect sensor signals Hu1, Hv1, Hw1.

According to the above-mentioned configuration, the signals from among first Hall-effect sensor signals Hu1, Hv1, Hw1 and second Hall-effect sensor signals Hu2, Hv2, Hw2 that are not selected by the motor-rotation-signal-input-source-switching circuit 206 to be input to the motor-rotation-signal input port 202*b* can also be monitored by the MCU 202.

In one or more of the embodiments, if, after a prescribed time has elapsed since the point in time when the motor-rotation-signal-input-source-switching circuit 206 switched from the state in which a first set of signals selected from first Hall-effect sensor signals Hu1, Hv1, Hw1 or second Hall-effect sensor signals Hu2, Hv2, Hw2 is selected to be input to the motor-rotation-signal input port 202*b* to the state in which the other (second) set of signals is selected to be input to the motor-rotation-signal input port 202*b*, a change is detected in the first set of signals, the MCU 202 determines that an error has occurred.

For example, when the motor-rotation-signal-input-source-switching circuit 206 switches from the state in which first Hall-effect sensor signals Hu1, Hv1, Hw1 are selected to be input to the motor-rotation-signal input port 202*b* to the state in which second Hall-effect sensor signals Hu2, Hv2, Hw2 are selected to be input to the motor-rotation-signal input port 202*b*, it is expected that the rotor 176 of the feed motor 32 will stop after a prescribed time has elapsed because the MCU 202 does not control (energize) the feed motor 32 after second Hall-effect sensor signals Hu2, Hv2, Hw2 have been selected to be input to the motor-rotation-signal input port 202*b*. When the feed motor 32 is stopped, first Hall-effect sensor signals Hu1, Hv1, Hw1 should not change. Therefore, if a change were to occur in first Hall-effect sensor signals Hu1, Hv1, Hw1 (during the time when there should be no change in first Hall-effect sensor signals Hu1, Hv1, Hw1), then it can be concluded that some type of abnormality or error has occurred. According to the above-mentioned configuration, the occurrence of such an abnormality can be quickly detected.

In one or more of the embodiments, the motor-rotation-signal-input-source-switching circuit 206 and the motor-control-signal-output-destination-switching circuit 204 switch in accordance with (in response to) the same switching signal SW.

According to the above-mentioned configuration, because the motor-rotation-signal-input-source-switching circuit 206 and the motor-control-signal-output-destination-switching circuit 204 are switched using (by) a common signal, the circuit configuration can be simplified.

In one or more of the embodiments, the rebar tying tool 2, 302, 402 (example of the electric work machine) comprises: the feed motor 32, 304 (example of the first motor); the twisting motor 76, 306 (example of the second motor); the MCU 202, 350 (example of the control unit), which controls the feed motor 32, 304 and the twisting motor 76, 306; and the motor-control-signal-output-destination-switching circuit 204, 310, 406. The MCU 202, 350 comprises the general-purpose I/O ports 202*c*, 350*c* and the motor-control-signal output port 202*a*, 350*a*. The motor-control-signal-output-destination-switching circuit 204, 310, 406 outputs motor-control signals UH, VH, WH, UL, VL, WL (or LH, RH, LL, RL) from the MCU 202, 350 to one motor selected from the feed motor 32, 304 and the twisting motor 76, 306. The motor-control-signal-output-destination-switching circuit 204, 310, 406 selects, in accordance with (in response to) switching signal SW (example of the output-switching signal), the one motor from the feed motor 32, 304 and the twisting motor 76, 306.

According to the above-mentioned configuration, motor-control signals UH1, VH1, WH1, UL1, VL1, WL1 (or LH1, RH1, LL1, RL1) to the feed motor 32, 304 and motor-control signals UH2, VH2, WH2, UL2, VL2, WL2 (or LH2, RH2, LL2, RL2) to the twisting motor 76, 306 can be selectively output from the (one, sole) motor-control-signal output port 202*a*, which corresponds to one (is configured to control a single) motor. By using such a configuration, both the feed motor 32, 304 and the twisting motor 76, 306 can be accurately controlled using a single motor-control-signal output port 202*a*, thereby simplifying the construction of the MCU 202 and avoiding an increase in cost.

Although some aspects of the present disclosure have been described in the context of a device, it is to be understood that these aspects also represent a description of a corresponding method, so that each block or component of a device, such as a controller or microprocessor (e.g., MCU 202, 350), is also understood as a corresponding method step or as a feature of a method step. In an analogous manner, aspects which have been described in the context of or as a method step also represent a description of a corresponding block or detail or feature of a corresponding device, such as the controller or microprocessor (e.g., MCU 202, 350).

Depending on certain implementation requirements, exemplary embodiments of the controller or microprocessor (e.g., MCU 202, 350) of the present disclosure may be implemented in hardware and/or in software. The implementation can be configured using a digital storage medium, for example one or more of a ROM, a PROM, an EPROM, an EEPROM or a flash memory, on which electronically readable control signals (program code) are stored, which interact or can interact with a programmable hardware component such that the respective method is performed.

A programmable hardware component can be formed by a processor, a computer processor (CPU=central processing unit), an application-specific integrated circuit (ASIC), an integrated circuit (IC), a computer, a system-on-a-chip (SOC), a programmable logic element, or a field programmable gate array (FGPA) including a microprocessor.

The digital storage medium can therefore be machine- or computer readable. Some exemplary embodiments thus comprise a data carrier or non-transient computer readable medium which includes electronically readable control signals which are capable of interacting with a programmable computer system or a programmable hardware component such that one of the methods described herein is performed. An exemplary embodiment is thus a data carrier (or a digital storage medium or a non-transient computer-readable medium) on which the program for performing one of the methods described herein is recorded.

In general, exemplary embodiments of the present disclosure, in particular the controller or microprocessor (e.g., MCU 202, 350), are implemented as a program, firmware, computer program, or computer program product including a program, or as data, wherein the program code or the data is operative to perform one of the methods if the program runs on a processor or a programmable hardware component. The program code or the data can for example also be stored on a machine-readable carrier or data carrier. The program code or the data can be, among other things, source code, machine code, bytecode or another intermediate code.

A program according to an exemplary embodiment can implement one of the methods during its performing, for example, such that the program reads storage locations or writes one or more data elements into these storage locations, wherein switching operations or other operations are induced in transistor structures, in amplifier structures, or in other electrical, optical, magnetic components, or components based on another functional principle. Correspondingly, data, values, sensor values, or other program information can be captured, determined, or measured by reading a storage location. By reading one or more storage locations, a program can therefore capture, determine or measure sizes, values, variable, and other information, as well as cause, induce, or perform an action by writing in one or more storage locations, as well as control other apparatuses, machines, and components.

Therefore, although some aspects of the controller or microprocessor (e.g., MCU 202, 350) may have been identified as "parts" or "steps", it is understood that such parts or steps need not be physically separate or distinct electrical components, but rather may be different blocks of program code that are executed by the same hardware component, e.g., one or more microprocessors.

This application hereby incorporates by reference the entire disclosure of application Ser. No. 17/115,045.

Additional embodiments of the present teachings include, but are not limited to:

1. A method for controlling operation of a rebar tying tool (2; 302; 402), the method comprising:

outputting motor-control signals from a control unit (202; 350) to a motor-control-signal-output-destination-switching circuit (204; 310; 406); and outputting an output-switching signal (SW) from the control unit (202; 350) to the motor-control-signal-output-destination-switching circuit (204; 310; 406);

wherein, in response to the output-switching signal (SW), the motor-control-signal-output-destination-switching circuit (204; 310; 406) selects an output destination for the motor-control signals from a first motor (32; 304) that drives a feed mechanism (24) for feeding a wire (W) and a second motor (76; 306) that drives a twisting mechanism (30) for twisting together ends of the wire (W).

2. The method according to the above-embodiment 1, wherein:

the motor-control signals are output from the control unit (202; 350) via a motor-control-signal output port (202*a*; 350*a*);

the output-switching signal (SW) is output from the control unit (202; 350) via a first general-purpose I/O port (202*c*; 350*c*);

preferably the motor-control-signal output port (202*a*; 350*a*) is capable of signal processing at a higher speed than the first general-purpose I/O port (202*c*; 350*c*).

3. The method according to the above-embodiment 1 or 2, further comprising:

outputting a short-circuit brake signal from a first brake circuit (218; 320) to the first motor (32; 304) either when or before the motor-control-signal-output-destination-switching circuit (204; 310; 406) switches from the state in which the first motor (32; 304) is selected to be driven with the motor-control signals to the state in which the second motor (76; 306) is selected to be driven with the motor-control signals.

4. The method according to the above-embodiment 3, further comprising:

prior to the first brake circuit (218; 320) outputting the short-circuit brake signal to the first motor (32; 304), outputting a short-circuit brake signal from the control unit (202; 350) to the first motor (32, 304).

5. The method according to any one of the above-embodiments 1-4, further comprising:

outputting a short-circuit brake signal from a second brake circuit (220; 322) to the second motor (76; 306) either when or before the motor-control-signal-output-destination-switching circuit (204; 310; 406) switches from the state in which the second motor (76; 306) is selected to be driven with the motor-control signals to the state in which the first motor (32; 304) is selected to be driven with the motor-control signals.

6. The method according to the above-embodiment 5, further comprising:

prior to the second brake circuit (220; 322) outputting the short-circuit brake signal to the second motor (76; 306), outputting a short-circuit brake signal from the control unit (202; 350) to the second motor (76; 306).

7. The method according to any one of the above-embodiments 1-6, further comprising:

outputting first Hall-effect sensor signals from a first Hall-effect sensor (180) mounted on the first motor (32, 304) to a motor-rotation-signal-input-source-switching circuit (206);

outputting second Hall-effect sensor signals from a second Hall-effect sensor (192) mounted on the second motor (76; 306) to the motor-rotation-signal-input-source-switching circuit (206); and outputting an input-switching signal (SW) from the control unit (202; 350) to the motor-rotation-signal-input-source-switching circuit (206);

wherein, in response to the input-switching signal (SW), the motor-rotation-signal-input-source-switching circuit (206) selects either the first Hall-effect sensor signals or the second Hall-effect sensor signals to be input to a motor-rotation-signal input port (202*b*) of the control unit (202).

8. The method according to the above-embodiment 7, further comprising:

inputting the first Hall-effect sensor signals and the second Hall-effect sensor signals to a general-purpose I/O port (202*c*) of the control unit (202).

9. The method according to the above-embodiment 8, wherein the first Hall-effect sensor signals and the second Hall-effect sensor signals are input to a different general-purpose I/O port (202*c*) than the general-purpose I/O port (202*c*) that outputs the output-switching signal (SW); and/or 10. The method according to the above-embodiment 8 or 9, wherein the output-switching signal (SW) and the input-switching signal (SW) are the same signal.

11. The method according to the above-embodiment 8, 9 or 10, further comprising:

after a prescribed time has elapsed since the point in time when the motor-rotation-signal-input-source-switching circuit (206) switched from the state in which a first set of signals selected from the first Hall-effect sensor signals and the second Hall-effect sensor signals is selected to be input the motor-rotation-signal input port (202*b*) to the state in which the other (second) one of the set of signals is selected to be input to the motor-rotation-signal input port (202*b*), detecting whether a change occurs in the first set of signals; and in response to a change being detected in the first set of signals, generating an error signal.

We claim:

1. A rebar tying tool comprising:

a feed mechanism configured to feed a wire and including a first motor having a first rotor;

a twisting mechanism configured to twist together ends of the wire and including a second motor having a second rotor;

a control unit configured to control the first motor and the second motor;

a first brake circuit configured to output a short-circuit brake signal to the first motor; and a motor-control-signal-output-destination-switching circuit;

wherein:

the control unit comprises a motor-control-signal output port;

the motor-control-signal-output-destination-switching circuit is configured to selectively output motor-control signals from the motor-control-signal output port of the control unit to either the first motor or the second motor;

the motor-control-signal-output-destination-switching circuit is configured to select one of the first motor or the second motor to be driven with the motor-control signals in response to input of an output-switching signal; and the control unit is configured to cause the first brake circuit to output the short-circuit brake signal from the first brake circuit to the first motor either when or before the motor-control-signal-output-destination-switching circuit switches from a first state in which the first motor is selected to be driven with the motor-control signals to a second state in which the second motor is selected to be driven with the motor-control signals.

2. The rebar tying tool according to claim 1, wherein:

the control unit is configured to output the output-switching signal from a first general-purpose I/O port of the control unit; and the motor-control-signal output port is configured to perform signal processing faster than the first general-purpose I/O port.

3. The rebar tying tool according to claim 1, wherein the motor-control-signal-output-destination-switching circuit comprises a demultiplexer.

4. The rebar tying tool according to claim 1, wherein the control unit is configured to energize the second motor to start rotation of the second rotor (i) in response to the motor-control-signal-output-destination-switching circuit switching from the first state to the second state and (ii) before rotation of the first rotor of the first motor has completely stopped.

5. The rebar tying tool according to claim 1, wherein the control unit is configured to cause the first brake circuit to output the short-circuit brake signal from the first brake circuit to the first motor before the motor-control-signal-output-destination-switching circuit switches from the first state to the second state.

6. The rebar tying tool according to claim 1, wherein the control unit is configured to output a short-circuit brake signal to the first motor via the motor-control-signal-output-destination-switching circuit before causing the first brake circuit to output the short-circuit brake signal to the first motor.

7. The rebar tying tool according to claim 1, further comprising:

a second brake circuit configured to output a short-circuit brake signal to the second motor;

wherein the control unit is configured to cause the second brake circuit to output the short-circuit brake signal from the second brake circuit to the second motor either when or before the motor-control-signal-output-destination-switching circuit switches from the second state to the first state.

8. The rebar tying tool according to claim 7, wherein the control unit is configured to energize the first motor to start rotation of the first rotor (i) in response to the motor-control-signal-output-destination-switching circuit switching from the second state to the first state and (ii) before rotation of the second rotor of the second motor has completely stopped.

9. The rebar tying tool according to claim 7, wherein the control unit is configured to cause the second brake circuit to output the short-circuit brake signal from the second brake circuit to the second motor before the motor-control-signal-output-destination-switching circuit switches from the second state to the first state.

10. The rebar tying tool according to claim 7, wherein the control unit is configured to output a short-circuit brake signal to the second motor via the motor-control-signal-output-destination-switching circuit before causing the second brake circuit to output the short-circuit brake signal to the second motor.

11. The rebar tying tool according to claim 1, wherein the first motor is a brushless motor.

12. The rebar tying tool according to claim 1, wherein the second motor is a brushless motor.

13. The rebar tying tool according to claim 10, wherein:

the control unit is configured to output the output-switching signal from a first general-purpose I/O port of the control unit;

the motor-control-signal output port is configured to perform signal processing faster than the first general-purpose I/O port;

the motor-control-signal-output-destination-switching circuit comprises a demultiplexer; and the control unit is configured to:

energize the second motor to start rotation of the second rotor (i) in response to the motor-control-signal-output-destination-switching circuit switching from the first state to the second state and (ii) before rotation of the first rotor of the first motor has completely stopped;

cause the first brake circuit to output the short-circuit brake signal from the first brake circuit to the first motor before the motor-control-signal-output-destination-switching circuit switches from the first state to the second state;

output a short-circuit brake signal to the first motor via the motor-control-signal-output-destination-switching circuit before causing the first brake circuit to output the short-circuit brake signal to the first motor;

energize the first motor to start rotation of the first rotor (i) in response to the motor-control-signal-output-destination-switching circuit switching from the second state to the first state and (ii) before rotation of the second rotor of the second motor has completely stopped; and cause the second brake circuit to output the short-circuit brake signal from the second brake circuit to the second motor before the motor-control-signal-output-destination-switching circuit switches from the second state to the first state.

14. The rebar tying tool according to claim 13, further comprising:

a motor-rotation-signal-input-source-switching circuit that comprises a multiplexer;

wherein:

the first motor is a first brushless motor;

the second motor is a second brushless motor;

the first brushless motor comprises a first Hall-effect sensor;

the second brushless motor comprises a second Hall-effect sensor;

the control unit further comprises a motor-rotation-signal input port;

the motor-rotation-signal-input-source-switching circuit is configured to input one set of signals selected from first Hall-effect sensor signals from the first Hall-effect sensor and second Hall-effect sensor signals from the second Hall-effect sensor to the motor-rotation-signal input port;

the motor-rotation-signal-input-source-switching circuit is configured to select the one set of signals to be input the motor-rotation-signal input port in response to input of an input-switching signal to the motor-rotation-signal-input-source-switching circuit;

the input-switching signal is output from the first general-purpose I/O port of the control unit;

the first Hall-effect sensor signals are also input to a second general-purpose I/O port of the control unit; and the second Hall-effect sensor signals are also input to a third general-purpose I/O port of the control unit.

15. The rebar tying tool according to claim 1, further comprising:

a motor-rotation-signal-input-source-switching circuit;

wherein:

the first motor is a first brushless motor;

the second motor is a second brushless motor;

the first brushless motor comprises a first Hall-effect sensor;

the second brushless motor comprises a second Hall-effect sensor;

the control unit further comprises a motor-rotation-signal input port;

the motor-rotation-signal-input-source-switching circuit is configured to input one set of signals selected from first Hall-effect sensor signals from the first Hall-effect sensor and second Hall-effect sensor signals from the second Hall-effect sensor to the motor-rotation-signal input port; and the motor-rotation-signal-input-source-switching circuit is configured to select the one set of signals to be input the motor-rotation-signal input port in response to input of an input-switching signal to the motor-rotation-signal-input-source-switching circuit.

16. The rebar tying tool according to claim 15, wherein the input-switching signal and the output-switching signal are the same signal.

17. A rebar tying tool according to claim 1, further comprising:

a feed mechanism configured to feed a wire and including a first motor having a first rotor;

a twisting mechanism configured to twist together ends of the wire and including a second motor having a second rotor;

a control unit configured to control the first motor and the second motor;

a motor-control-signal-output-destination-switching circuit; and a motor-rotation-signal-input-source-switching circuit;

wherein:

the control unit comprises a motor-control-signal output port;

the motor-control-signal-output-destination-switching circuit is configured to selectively output motor-control signals from the motor-control-signal output port of the control unit to either the first motor or the second motor; and the motor-control-signal-output-destination-switching circuit is configured to select one of the first motor or the second motor to be driven with the motor-control signals in response to input of an output-switching signal;

the first motor is a first brushless motor;

the second motor is a second brushless motor;

the first brushless motor comprises a first Hall-effect sensor;

the second brushless motor comprises a second Hall-effect sensor;

the control unit further comprises a motor-rotation-signal input port;

the motor-rotation-signal-input-source-switching circuit is configured to input one set of signals selected from first Hall-effect sensor signals from the first Hall-effect sensor and second Hall-effect sensor signals from the second Hall-effect sensor to the motor-rotation-signal input port;

the motor-rotation-signal-input-source-switching circuit is configured to select the one set of signals to be input the motor-rotation-signal input port in response to input of an input-switching signal to the motor-rotation-signal-input-source-switching circuit; and the input-switching signal and the output-switching signal are the same signal.

18. The rebar tying tool according to claim 17, wherein the input-switching signal is output from a first general-purpose I/O port of the control unit.

19. The rebar tying tool according to claim 17, wherein the motor-rotation-signal-input-source-switching circuit comprises a multiplexer.

20. The rebar tying tool according to claim 18, wherein:

the first Hall-effect sensor signals are also input to a second general-purpose I/O port of the control unit; and the second Hall-effect sensor signals are also input to a third general-purpose I/O port of the control unit.

21. The rebar tying tool according to claim 20, wherein the control unit is configured to:

wait for a predetermined time to elapse after the motor-rotation-signal-input-source-switching circuit has switched from a first state in which a first one of the first Hall-effect sensor signals and the second Hall-effect sensor signals is selected to be input to the motor-rotation-signal input port to a second state in which a second one of the first Hall-effect sensor signals and the second Hall-effect sensor signals is selected to be input to the motor-rotation-signal input port;

then monitor the first one of the first Hall-effect sensor signals and the second Hall-effect sensor signals; and in response to detecting a change in the first one of the first Hall-effect sensor signals and the second Hall-effect sensor signals, determine that an error has occurred.

22. A rebar tying tool comprising:

a first motor;

a second motor;

a control unit configured to control the first motor and the second motor;

a brake circuit configured to output a short-circuit brake signal to the first motor; and a motor-control-signal-output-destination-switching circuit;

wherein:

the control unit comprises a motor-control-signal output port;

the motor-control-signal-output-destination-switching circuit is configured to selectively output motor-control signals from the motor-control-signal output port of the control unit to one of the first motor or the second motor; and the motor-control-signal-output-destination-switching circuit is configured to select the one of the first motor and the second motor to be driven by the motor-control signals in response to input of an output-switching signal; and the control unit is configured to cause the brake circuit to output the short-circuit brake signal from the brake circuit to the first motor either when or before the motor-control-signal-output-destination-switching circuit switches from a first state in which the first motor is selected to be driven with the motor-control signals to a second state in which the second motor is selected to be driven with the motor-control signals.

* * * * *